US012239271B1

(12) United States Patent
Brady

(10) Patent No.: US 12,239,271 B1
(45) Date of Patent: Mar. 4, 2025

(54) FLOOR MACHINE WITH ATTACHMENT SYSTEM

(71) Applicant: Square Scrub Holdings, LLC, Littleton, CO (US)

(72) Inventor: Kevin Douglas Brady, Jonesboro, AR (US)

(73) Assignee: SQUARE SCRUB HOLDINGS, LLC, Littleton, CO (US)

( * ) Notice: Subject to any disclaimer, the term of this patent is extended or adjusted under 35 U.S.C. 154(b) by 522 days.

(21) Appl. No.: 17/493,409

(22) Filed: Oct. 4, 2021

Related U.S. Application Data

(63) Continuation-in-part of application No. 16/694,966, filed on Nov. 25, 2019, now Pat. No. 11,134,820, which is a continuation-in-part of application No. 15/190,074, filed on Jun. 22, 2016, now Pat. No. 10,485,395.

(60) Provisional application No. 62/182,756, filed on Jun. 22, 2015.

(51) Int. Cl.
*A47L 11/40* (2006.01)
*A47L 11/26* (2006.01)
*A47L 11/162* (2006.01)

(52) U.S. Cl.
CPC ..... *A47L 11/4069* (2013.01); *A47L 11/26* (2013.01); *A47L 11/4036* (2013.01); *A47L 11/4075* (2013.01); *A47L 11/162* (2013.01)

(58) Field of Classification Search
CPC ..... A47L 11/14; A47L 11/162; A47L 11/24; A47L 11/282; A47L 11/4005; A47L 11/4036; A47L 11/4063; A47L 11/4069; A47L 11/4075
USPC ..... 15/22.1, 49.1, 50.1, 79.2, 97.1
See application file for complete search history.

(56) References Cited

U.S. PATENT DOCUMENTS 4,005,502 A * 2/1977 Stevens (Boyer) ..... A47L 11/4005 15/22.1
5,978,999 A * 11/1999 deBlois ..... A46B 13/008 15/97.1
7,527,696 B1 * 5/2009 Aus ..... A47L 13/022 15/93.1
7,786,626 B2 * 8/2010 Reishus ..... H02K 33/16 310/15
2016/0120375 A1 * 5/2016 Philips ..... A61H 23/0263 15/22.1

* cited by examiner

*Primary Examiner* — Randall E Chin
(74) *Attorney, Agent, or Firm* — Berg Hill Greenleaf Ruscitti LLP

(57) ABSTRACT

The floor machine provides an attachment system capable of securing a handle to the floor machine at multiple locations. A handle storing a power source, such as batteries, attaches to the housing to power the motor. A housing of the floor machine provides two attachment bodies located on the exterior of two different walls of the housing. By securing the handle to the different attachment points, the user can configure the footprint of the floor machine to increase the user's access to narrower and/or smaller confined areas. The power source electrically connects to the motor at a powering location separate from the attachment location of the handle to the housing. The distinct attachment location and powering locations enables different attachments of the handle to the housing.

16 Claims, 63 Drawing Sheets

FIG, 21

FLOOR MACHINE WITH ATTACHMENT SYSTEM

CROSS-REFERENCE TO RELATED APPLICATIONS

This application claims priority to and is a continuation in part of U.S. patent application Ser. No. 16/694,966 filed on Nov. 25, 2019 entitled "FLOOR MACHINE WITH ATTACHMENT SYSTEM" which is a continuation in part of U.S. patent application Ser. No. 15/190,074 filed on Jun. 22, 2016 entitled "FLOOR MACHINE WITH ATTACHMENT SYSTEM" that issued as U.S. Pat. No. 10,485,395 on Nov. 26, 2019 which is a continuation in part of U.S. Patent Application No. 62/182,756 filed on Jun. 22, 2015 entitled "FLOOR MACHINE WITH ATTACHMENT SYSTEM."

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

I. Field of the Invention

The present invention is related to a floor machine. More specifically, the present invention is related to a versatile floor machine capable of completing multiple tasks. The versatile floor machine of the present invention can accomplish preparation for re-coating, chemical stripping jobs, polishing, scrubbing, floor cleaning, baseboard cleaning, wall cleaning, carpet cleaning, grout cleaning, finish removal, floor repair, sanding, glue removal, gum removal, epoxy removal, stone polishing, and other floor needs. The versatile floor machine functions on tile, granite, hardwood, stone, carpet, stairs, grout, concrete, and other flooring surfaces.

To increase access to confined and/or narrow spaces, the present invention provides two attachment points for attaching the handle to the floor machine. The footprint of the floor machine is narrower in one direction than the other. By attaching the handle to the different attachment points, the user can configure the width of the footprint in relation to the handle. Such configuration increases the user's access to limited spaces.

The present invention also provides a rolling attachment for cleaning baseboards. The rolling attachment secures the floor machine to a set of wheels to allow side to side movement of the floor machine. The cleaning surface of the floor machine is positioned to clean the base board.

To increase the effectiveness and efficiency of the floor machine, the present invention revolves at treatment attachment in two different directions. The revolution in two different direction enables the machine to clean, prepare floors, and operate in two separate directions. Such revolution improves the operation of the machine.

Revolution in two different directions also increases the lifespan of a pad or other treatment attachment that is attached to the floor machine. The revolution in two different directions allows the user to maximize usage of the treatment attachment. The treatment attachment wears with use. Movement in one direction wears one side of the attachment. The user may alternate direction of movement of the attachment to use both sides of the attachment. The user can then use both sides of the attachment. Using both sides of the attachment increases the life span of the attachment. Using both sides also decreases the number of times that a user must change the attachment. The user increases productivity, decreases waste, and decreases costs.

II. Known Art

Patents and patent applications disclosing relevant information are disclosed below. These patents and patent applications are hereby expressly incorporated by reference in their entirety.

U.S. Pat. No. 8,276,236 issued to Goodman et al. on Oct. 2, 2012 ("the '236 patent") teaches a baseboard cleaning apparatus for cleaning a baseboard of a wall extending upright along the wall with respect to a floor includes a cleaning head and a block positioned in either side of a skid plate, and which are connected by a connector that extends through a slot formed in the skid plate. The skid plate taught by the '236 patent has a lower extremity formed with a skid, and the connector is movable along the slot between lowered positions of the baseboard cleaning head and the fixture toward the skid formed in the lower extremity of the skid plate, and raised positions of the baseboard cleaning head and the fixture away from the skid formed in the lower extremity of the skid plate.

U.S. Pat. No. 7,418,758 issued to Avila on Sep. 2, 2008 teaches an apparatus for cleaning a baseboard of a wall generally comprises an extendable handle to which a friction decreasing device such as a wheel, an adsorbent/desorbent pad and a pad compression device are assembled in a manner such that the lower end of said apparatus can be immersed in a bucket of water.

U.S. Pat. No. 7,296,943 issued to Sandoval on Nov. 20, 2007 ("the '943 patent") teaches an apparatus for cleaning a baseboard of a wall that may include pads and a handle. A front surface of at least one of the pads taught by the '943 patent may be configured to contact a portion of the baseboard during use. A liquid dispenser taught by the '943 patent may be provided to wet one or more of the pads during use. A portion of the handle taught by the '943 patent may be angled to extend away from the wall and rearward from the pad during use. Top pads taught by the '943 patent may be provided for cleaning a top face of the baseboard. The top pads taught by the '943 patent may be vertically and horizontally adjustable relative to a holder to accommodate baseboards of various dimensions.

U.S. Pat. No. 5,533,222 issued to Lelkes et al. on Jul. 9, 1996 ("the '222 patent") teaches a floor machine for cleaning a floor and/or wall and/or downward upstanding from the wall, includes at least one disc having a floor cleaning pad covering a lower surface and wall cleaning material projecting from its periphery. The wall cleaning material taught by the '222 patent may be bristles or a wrap-around separate strip of abrasive felted material, or a margin of the floor cleaning pad may be bent upwardly to form a vertical cylindrical surface. Alternatively, floor pads taught by the '222 patent may be stacked to present a vertical cylindrical wall cleaning surface. The disc taught by the '222 patent may be engaged with a drive shaft, or stacked discs may interengage with each other, the topmost being engaged with the drive shaft. The bottom disc taught by the '222 patent may have a bevel rising from the lower surface. Bristles taught by the '222 patent extend from the bevel at right angles. When the floor machine rests on the floor in operation position, the bristles extending from the bevel taught by the '222 patent are bent upwardly to be forced towards the angle between floor and wall.

U.S. Pat. No. 5,331,703 issued to Mejia et al. on Jul. 26, 1994 teaches a power driven floor and baseboard scrubber is provided having reciprocating plates with scrubbing pads thereon arranged to clean an area at an intersection of the floor and the baseboard, on a stair step and its riser. A handle taught by the '703 patent is provided for operational purposes and wheels for transportation.

U.S. Pat. No. 5,173,985 issued to Palmer on Dec. 29, 1992 ("the '985 patent") teaches a foot mounted scrubber device is provided for use in scrubbing and cleaning selected problem areas of a floor, and along adjacent baseboard surfaces and the like. The scrubber device taught by the '985 patent comprises a relatively flat sole plate, in combination with a toe upper and an elastic heel strap for securely mounting the sole plate onto a shoe in a position underlying the ball region and toes of a user's foot. The sole plate taught by the '985 patent defines an abrasive scrubber surface which can be applied against a problem area to be cleaned through the use of the leg muscles in combination with the user's body weight. In a preferred form, the '985 patent teaches that the sole plate and toe upper cooperatively define a pointed forward toe lined with an abrasive scrubber material for use in cleaning baseboard surfaces and corners and the like along the edge of the floor.

U.S. Pat. No. 4,024,597 issued to Fouracre on May 24, 1977 teaches a housing that contains a motor driven by an electrical source and a shaft connected to the motor drives a brush which can clean a tile floor while a bevelled gear attached to the shaft may drive a second bevelled gear connected to a perpendicular shaft which passes through the housing, a brush attached to the perpendicular shaft may clean a sideboard while if the edge of the sideboard cleaning brush is bevelled then the baseboard cleaning brush may also clean the bevelled corner between the floor and the baseboard.

U.S. Publication No. 20130061414 to Swist on Mar. 14, 2013 ("the '414 publication") teaches a cleaning system that is provided comprising a compliant pad and a consumable pad for use in conjunction with a variety of cleaning implements. The compliant pad taught by the '414 publication may according to embodiments of the invention provide for both compliance to the contour of the surface being cleaned but also allows for the compliant pad to provide for controlled release of fragrance, solvents, cleaning agents etc within the matrix or matrices provided in its construction. Likewise the consumable pad taught by the '414 publication may provide elements providing dust attraction/retention, abrasion, as well as controlled release of fragrance, solvents, cleaning agents etc within the materials provided in its construction. According to embodiments of the invention the compliant pad and/or consumable pad taught by the '414 publication are water soluble to provide this release wherein the water is provided either from within one or both of the compliant pad and consumable pad or from the cleaning implement to which they are attached.

U.S. Publication No. 20110191972 issued to Goodman on Aug. 11, 2011 ("the '972 publication") teaches a baseboard cleaning apparatus for cleaning a baseboard of a wall extending upright along the wall with respect to a floor includes a cleaning head and a block positioned in either side of a skid plate, and which are connected by a connector that extends through a slot formed in the skid plate. The skid plate taught by the '972 publication has a lower extremity formed with a skid, and the connector is movable along the slot between lowered positions of the baseboard cleaning head and the fixture toward the skid formed in the lower extremity of the skid plate, and raised positions of the baseboard cleaning head and the fixture away from the skid formed in the lower extremity of the skid plate.

U.S. Publication No. 20080145132 to Sandoval on Jun. 19, 2008 ("the '132 publication") teaches a device for cleaning trim of a room includes a head and a handle. The head taught by the '132 publication includes at least one first cleaning portion that can clean a first surface of the trim by moving the head in a lengthwise direction of the trim and at least one second cleaning portion that can clean a second surface of the trim by moving the head lengthwise direction of the trim, the second surface being above the first surface and not co-planar with the first surface. The head includes a removable cover. At least part of the first cleaning portion and at least part of the second cleaning portion are formed in the removable cover taught by the '132 publication.

U.S. Publication No. 20040083579 to Furr-Britt on May 6, 2004 ("the '579 publication") teaches a dual handle attachment for a floor appliance, e.g., vacuum cleaner, large push broom, mop, squeegee, etc., allows a user of the appliance to manipulate or maneuver the appliance using generally symmetrical upper body, arm, wrist, and hand forces and movements, thereby obviating the need for asymmetrical twisting and the greater strength required to manipulate such a device using only a single arm and hand. The present attachment taught by the '579 publication comprises a single central bracket which attaches to the conventional single handlebar of such an appliance, with a left and a right handgrip adjustably extending from the central bracket. The two handgrips taught by the '579 publication may be pivotally adjusted by the user as desired and may be interchanged for handgrips having different shapes or configurations as desired. One embodiment taught by the '579 publication may be removably secured to the appliance, with another embodiment providing for permanent attachment as an integral part of the appliance at the time of manufacture.

SUMMARY OF THE INVENTION

The present invention is related to a floor machine for re-coating, stripping, polishing, scrubbing, cleaning, finish removal, floor repair, sanding, and other floor needs. The present invention provides a handle attached to a motor and housing. A floor treatment attachment attaches to an attachment surface of a driver plate secured to the housing. The treatment body treats the flooring. The treatment body varies according to the desired task to be accomplished by the floor machine.

The shaft of the motor attaches to an eccentric to offset position to revolve the treatment attachment around the offset attachment. The motor revolves the treatment attachment to complete the desired task on the floor. Such attachment appears to vibrate the treatment attachment. In another embodiment, the motor vibrates the treatment attachment. In one embodiment, the motor can revolve the treatment body in different directions to adjust usage of the treatment body.

The housing also provides a first retention finger and a second retention finger extending vertically above the top of the housing. Slotted weights are secured onto the retention fingers to increase the weight of the present invention for treatment of the floor The housing also provides a first attachment body and a second attachment body for securing the handle. The attachment bodies are located on different sides of the housing to adjust the configuration of the floor machine. The housing of one embodiment provides a bottom gripping surface that forms a rectangle. In such an embodiment, the length of the bottom gripping surface is different than the width of the bottom gripping surface. The multiple attachment bodies enable the handle to attach to different points of the housing. The different attachment points enable the floor machine to access areas that would not be accessible when the handle is attached to the other attachment body.

The multiple attachment bodies also provide increased functionality to the floor machine. The user can attach the handle to one attachment body for using the floor machine on the floor. The multiple attachment bodies enable the user to orient the floor machine according to the user's preferences. The additional attachment body enables the user to attach to a rolling attachment. Attaching the floor machine to the rolling attachment orients the floor machine differently for increased functionality. The multiple attachment bodies enable the floor machine to be used for treating floors. The user can then reorient the floor machine using the attachment body to treat walls, baseboards, and other surfaces.

The different attachment points also enable the floor machine to attach to a rolling attachment for side to side movement. The rolling attachment supports the floor machine above the ground to allow for simpler movement. The rolling attachment also orients the driver plate from a downward position to a forward position. Orienting the driver plate in the forward position directs the treatment attachment toward the wall and baseboards.

The present invention also provides a power supply stored within the handle that allows wireless usage of the floor machine. The power supply within the handle disconnects from the housing to allow the user to switch handles to change power source if needed. The disconnected power source can then be charged for usage.

It is an object of the present invention to provide a versatile floor machine capable of accomplishing multiple tasks.

It is another object of the present invention to provide a motor attached to a housing.

It is another object of the present invention to offset the attachment of the motor with the treatment attachment.

It is another object of the present invention to vary the weight of the floor machine by adding or removing slotted weights on to the retention fingers extending vertically above the housing of the floor machine.

It is another object of the present invention to provide a gripping surface for attaching the preparing body for performing the desired function on the floors.

It is another object of the present invention to provide multiple attachment bodies for securing a handle to the floor machine.

It is another object of the present invention to provide attachment points at different locations on the floor device to adjust the alignment of the handle on the machine.

It is another object of the present invention to vary the direction of revolution of the treatment attachment.

It is another object of the present invention to increase the usable surface of the treatment attachment.

It is another object of the present invention to increase the lifespan of the treatment attachment.

It is another objection of the present invention to treat the floor with revolutions in two different directions.

It is another object of the present invention to increase the access of the floor machine into difficult to reach areas.

It is another object of the present invention to provide a rolling attachment to simplify movement of the floor machine.

It is another object of the present invention to position the floor machine on its side to direct the finishing surface towards the baseboards.

It is another object of the present invention to provide a removable power source to allow for wireless (cordless) usage of the floor machine.

It is another object of the present invention to provide a removable power source to allow replacement of the power source.

These and other objects and advantages of the present invention, along with features of novelty appurtenant thereto, will appear or become apparent by reviewing the following detailed description of the invention.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
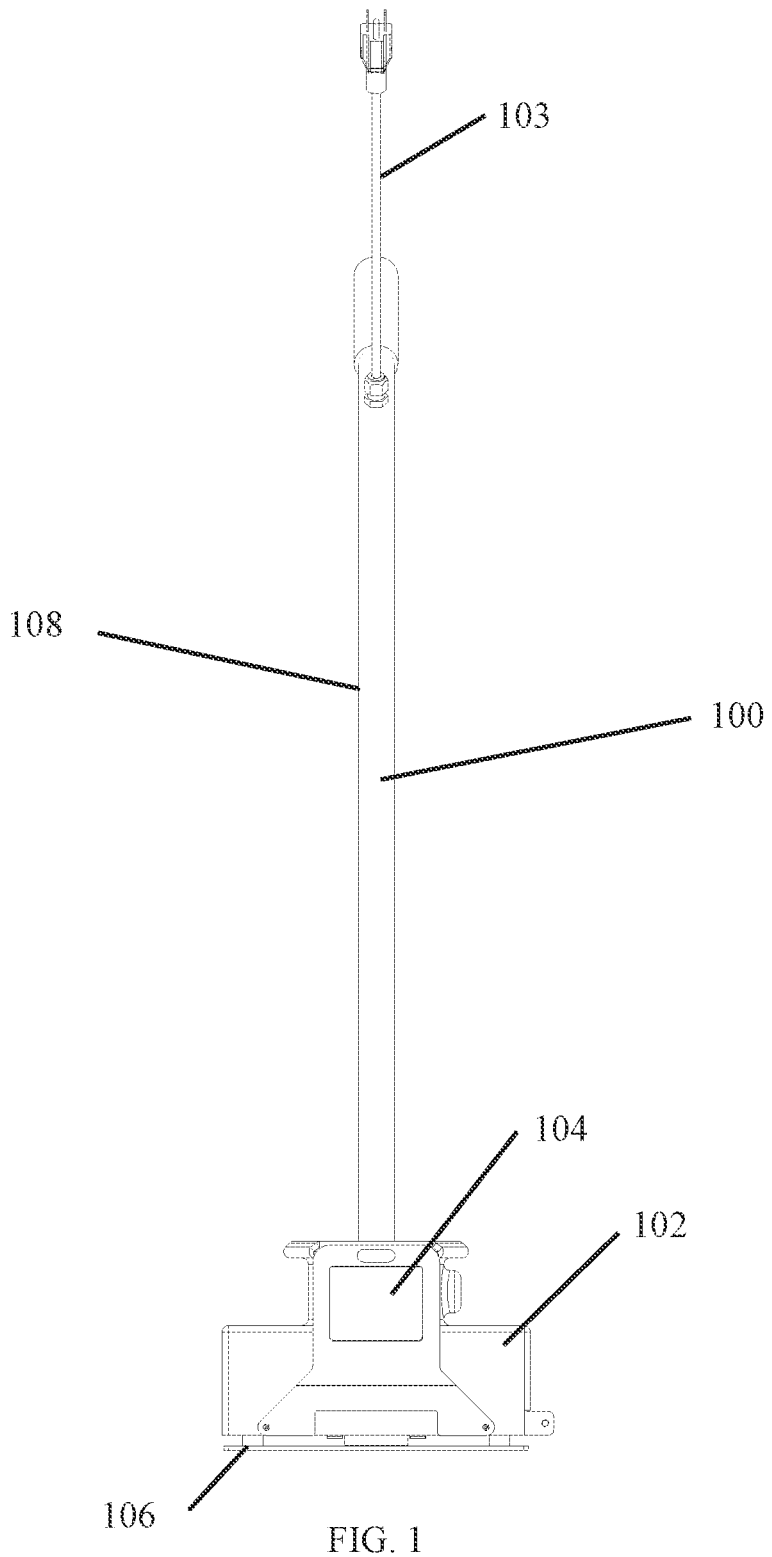
FIG. 1 is a front environmental view of one embodiment of the present invention.
Figure 2A:
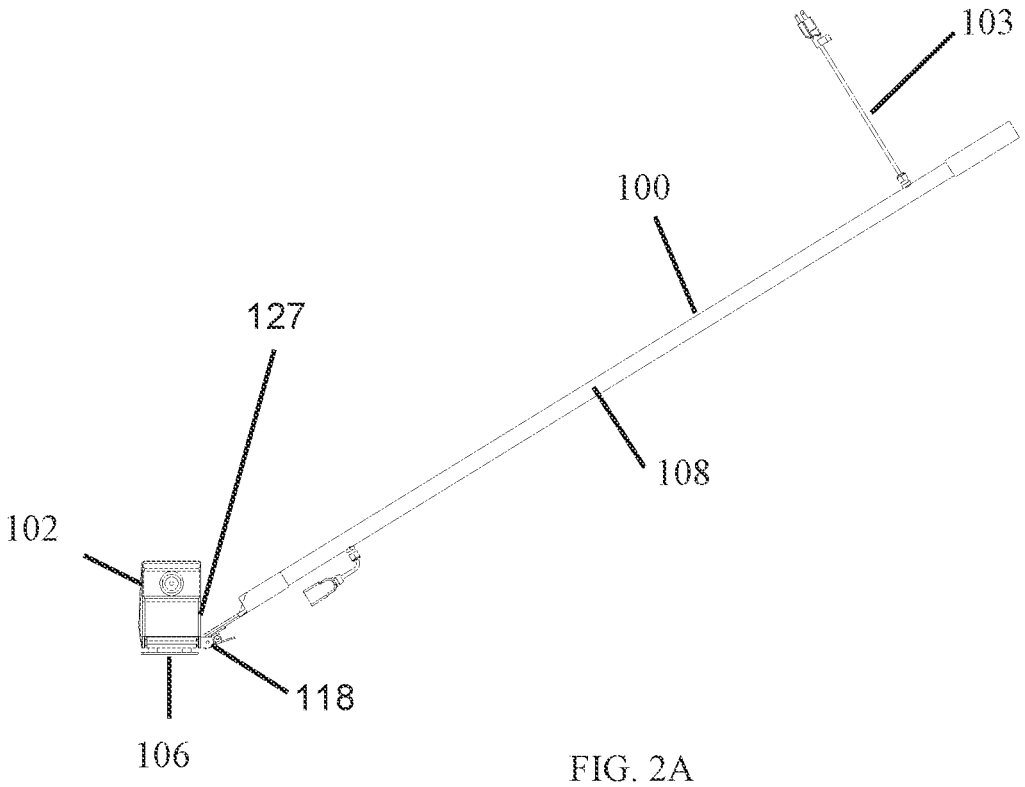
FIG. 2A is a right side view thereof.
Figure 2B:
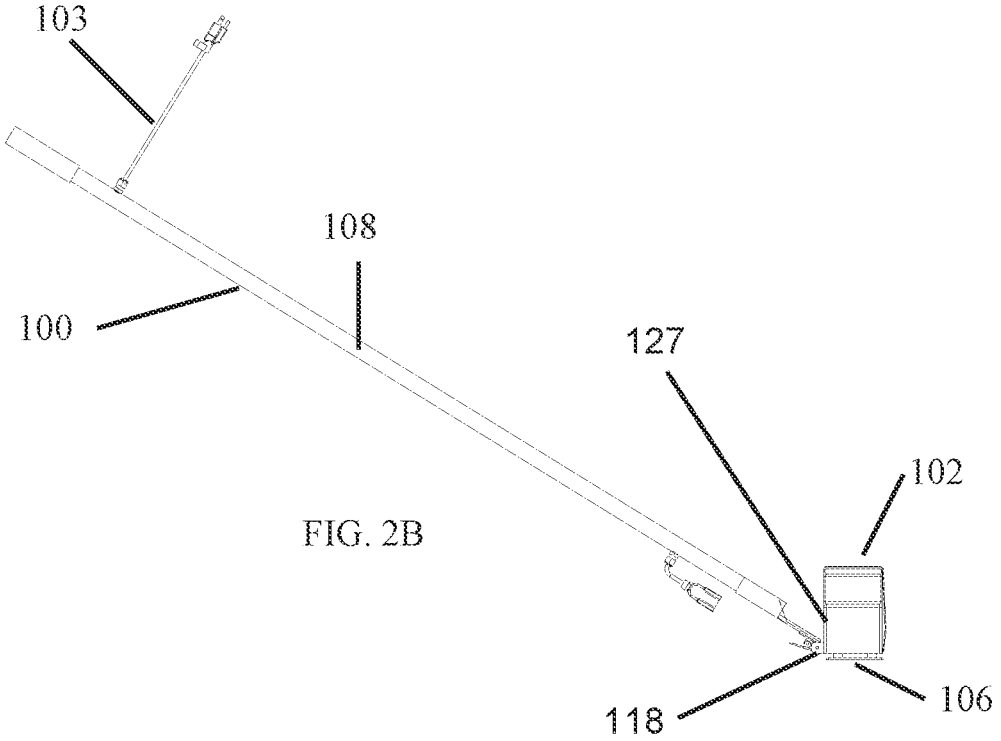
FIG. 2B is a left side view thereof.
Figure 3:
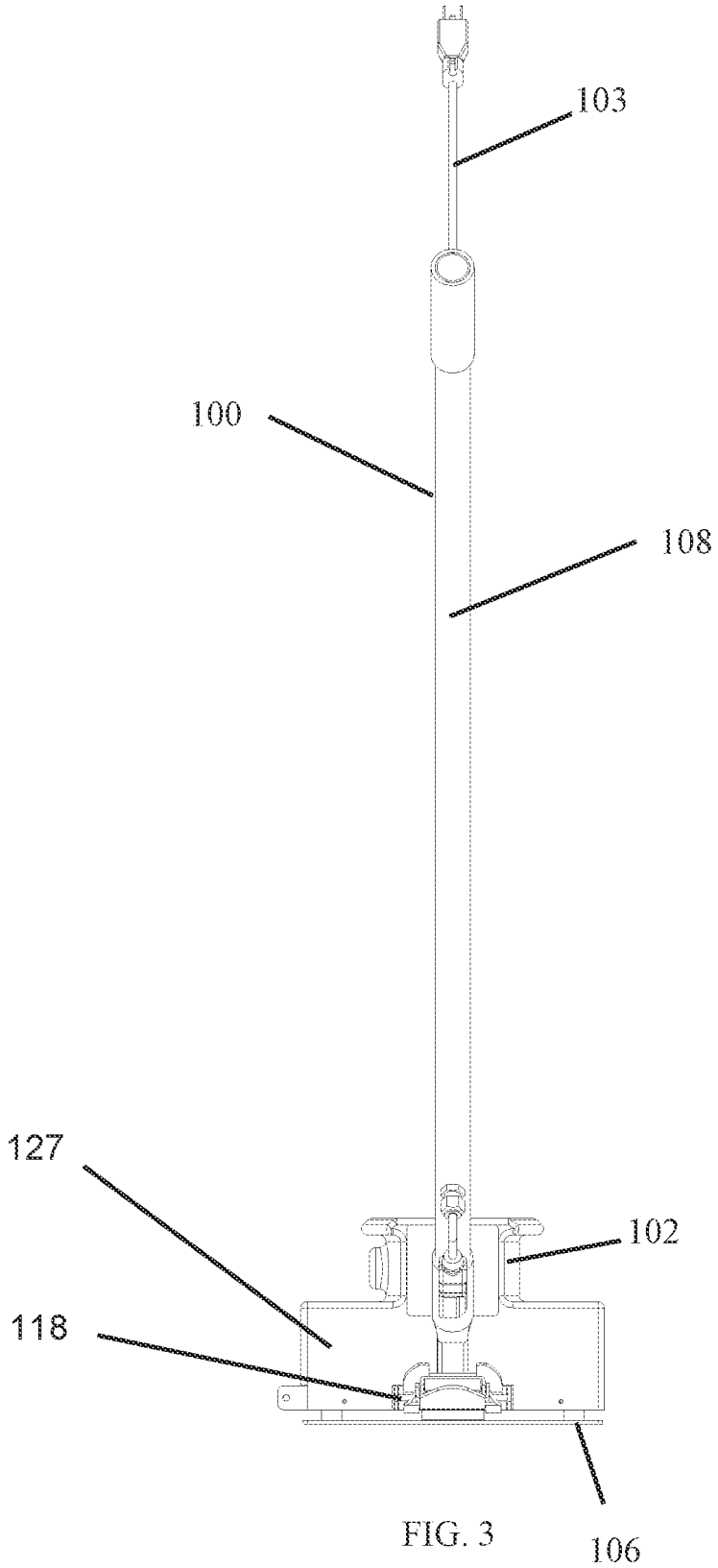
FIG. 3 is a rear view thereof.

FIGS. 1-3 show the floor machine 100 with multiple attachment bodies located on different sides of housing 102. The multiple attachment bodies provide different attachment points for securing the handle 108 to housing 102 in different orientations. In one embodiment, attaching the handle 108 to the different attachment points changes the orientation with the handle by 90 degrees. Power cord 103 is plugged into a power source that powers the motor 104. The motor 104 revolves housing 102 and the driver plate 106 that secures to the treatment attachment.

The treatment attachment secures to the driver plate 106 for contacting the floor. Different types of preparation bodies may attach to the housing depending on the floor surface and the task to be completed. Examples of preparation bodies may include an SQP pad, an SHO pad, a microfiber pad, a wet pad, a tile and grout wet pad, a scrubber, a scrub brush, a tile and grout brush, a carpet cleaning pad, a sandscreen, sandpaper, an abrader plate, stone polishing pads, vacuum braised diamond, resin diamonds, polypads, polishing pads, tooltip diamonds, a sponge, and an enhancer pad, as well as other floor treatment materials. In one embodiment, a gripping surface that includes protrusions, hooks, fasteners, loops, grips, or other fasteners is located on the bottom surface of the driver plate 106. The treatment attachment then attaches to the gripping surface.

Figure 12:
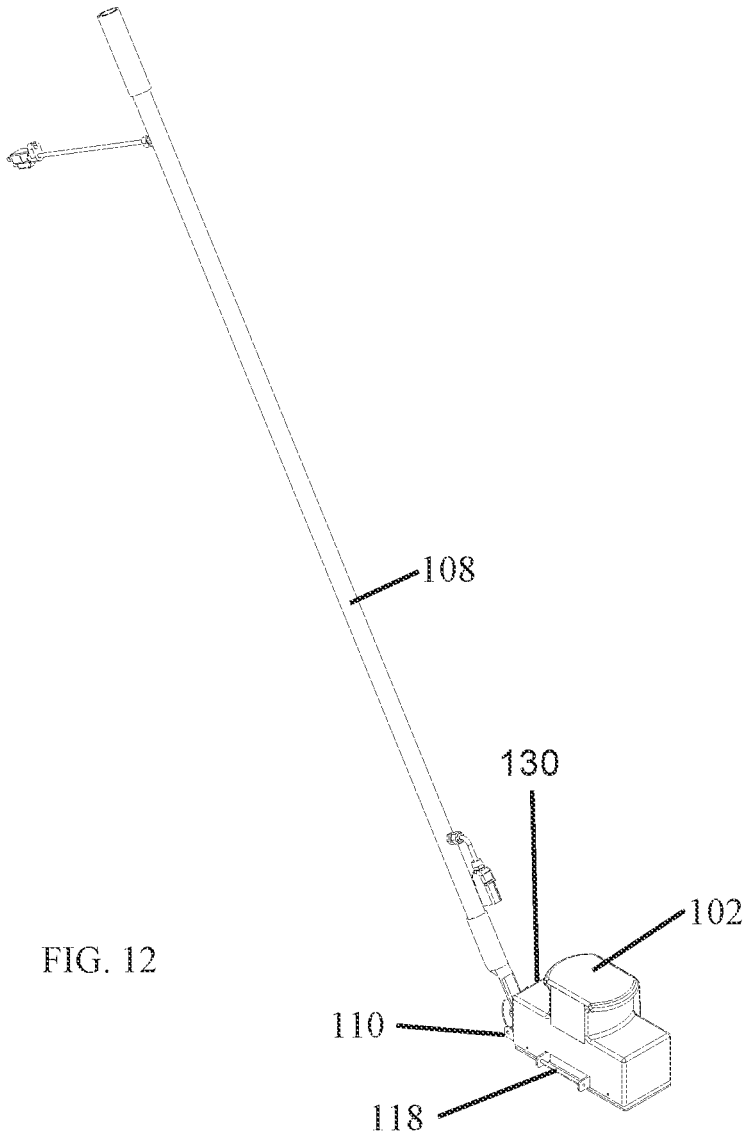
FIG. 12 is an environmental view thereof.
Figure 13:
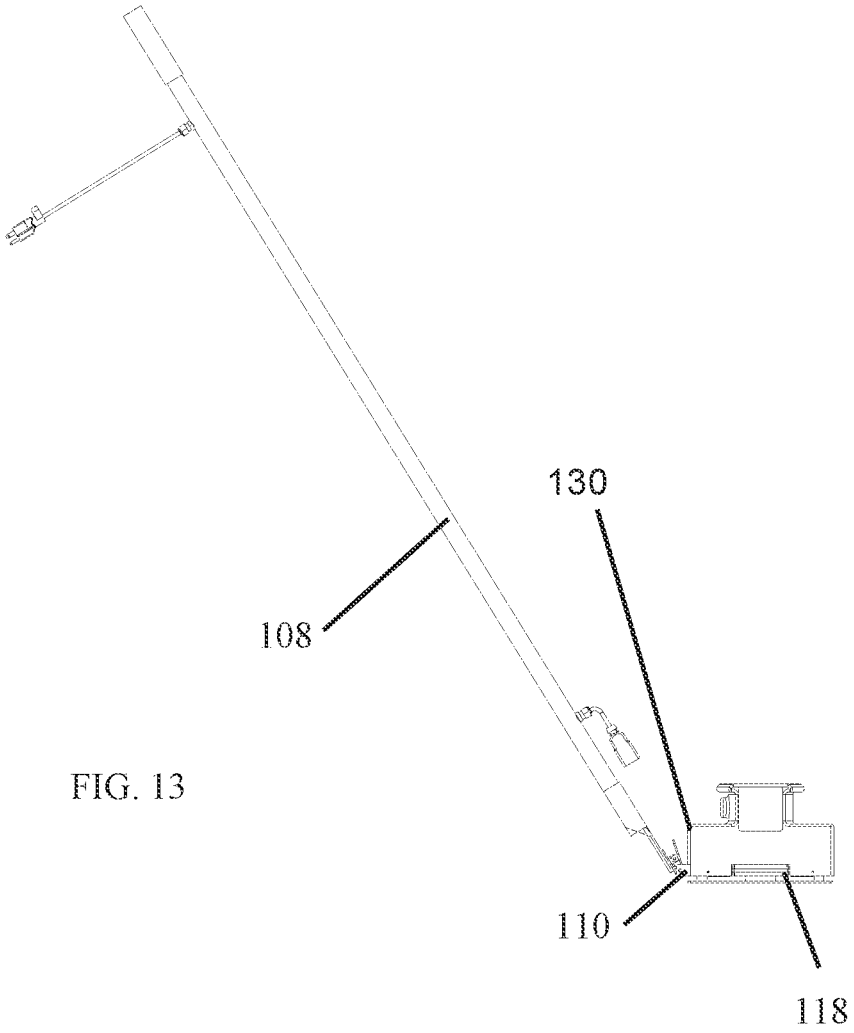
FIG. 13 is a rear view thereof.

FIGS. 1-3 and FIGS. 12-13 show the different attachments of the handle 108 to housing 102 to adjust the orientation of the driver plate 106 in relation to the handle 108. The handle 108 releasably attaches to the housing 102 so that the housing 102 and handle 108 can form at least two different configurations. FIGS. 1-3 show the handle 108 attached to the attachment body 118 at the rear wall 127 of the housing 102. FIGS. 12-13 show the handle 108 attached to the attachment body 110 at the side wall 130.

The handle 108 attaches to one of the attachment bodies located on the rear wall and the side wall. If the user needs to adjust the configuration of the floor machine 100, the user simply removes the handle 108 from one attachment body and reconnects the handle at another attachment body. Such configurability of the attachment of the handle 108 with the housing 102 increases the functionality of the floor machine 100 and increases access to the difficult to reach areas.

FIG. 1 shows a front view with the housing 102. The user attaches the handle 108 to the attachment body located at the rear wall to increase the width of the cleaning surface. In one embodiment, the width of the driver plate 106 is greater than the depth of the driver plate 106. Such differences in sizes enables attachment of preparation bodies of different depth and width to the driver plate 106.

FIGS. 4-9 show more detailed views of the floor machine 100 and the housing 102. The power cord 103 secures to the motor within housing 102 to power the motor. One embodiment of the present invention provides two attachment bodies 110, 118. Attachment body 110 is located on side wall 130. Attachment body 118 is located on rear wall 127.

Each attachment body 110, 118 provides attachment shoulders 112, 116, 120, 124 that extend laterally from the wall of the housing 102. The attachment shoulders 112, 116, 120, 124 limit lateral movement of the handle 108 in relation to the housing when the handle is attached to the housing 102.

An attachment neck 114, 122 is located between the attachment shoulders 112, 116, 120, 124. An attachment head of the handle 108 attaches to the attachment neck 114, 122 to secure the handle 108 to the housing 102. The attachment neck 114, 122 extends longitudinally along the wall to which the respective attachment body is secured. The attachment neck 114, 122 provides an attachment aperture between the attachment neck and the wall to which the attachment body is secured.

Figure 5:
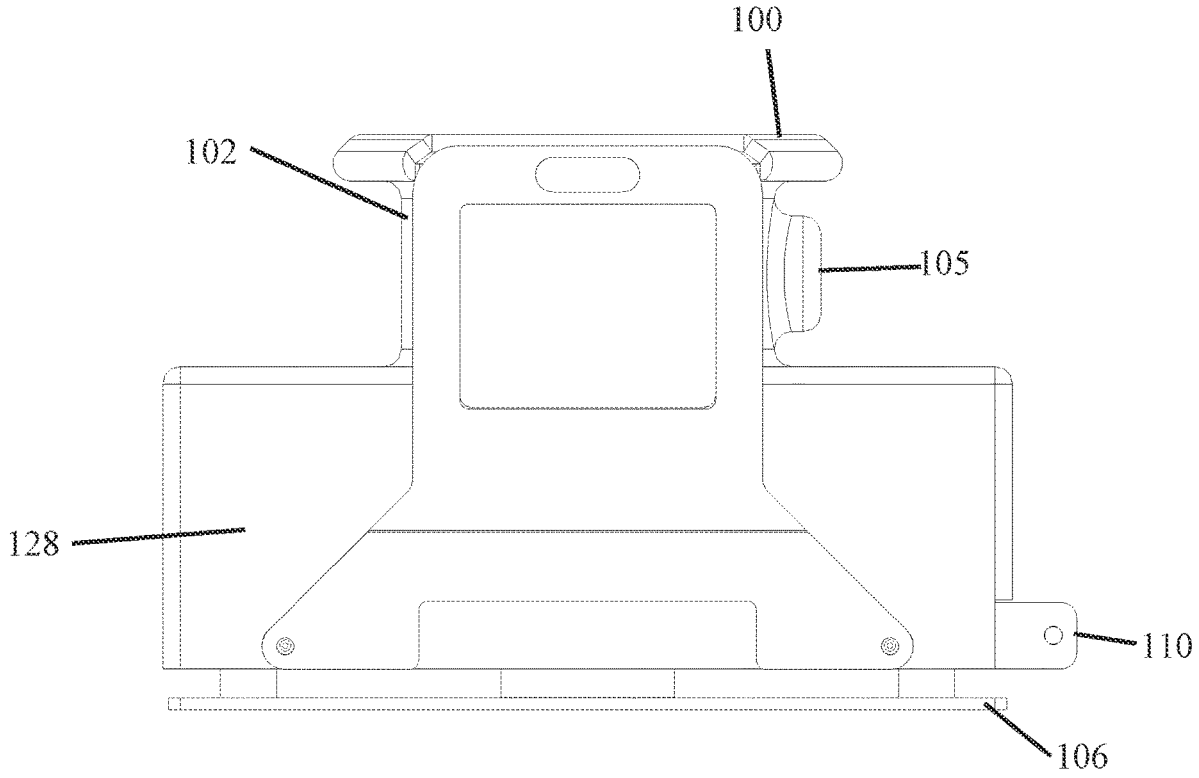
FIG. 5 is a front view thereof.

FIG. 5 shows the front wall 128 of the housing 102 of the floor machine 102. Attachment body 110 is located on one of the side walls in relation to front wall 128.

Figure 6:
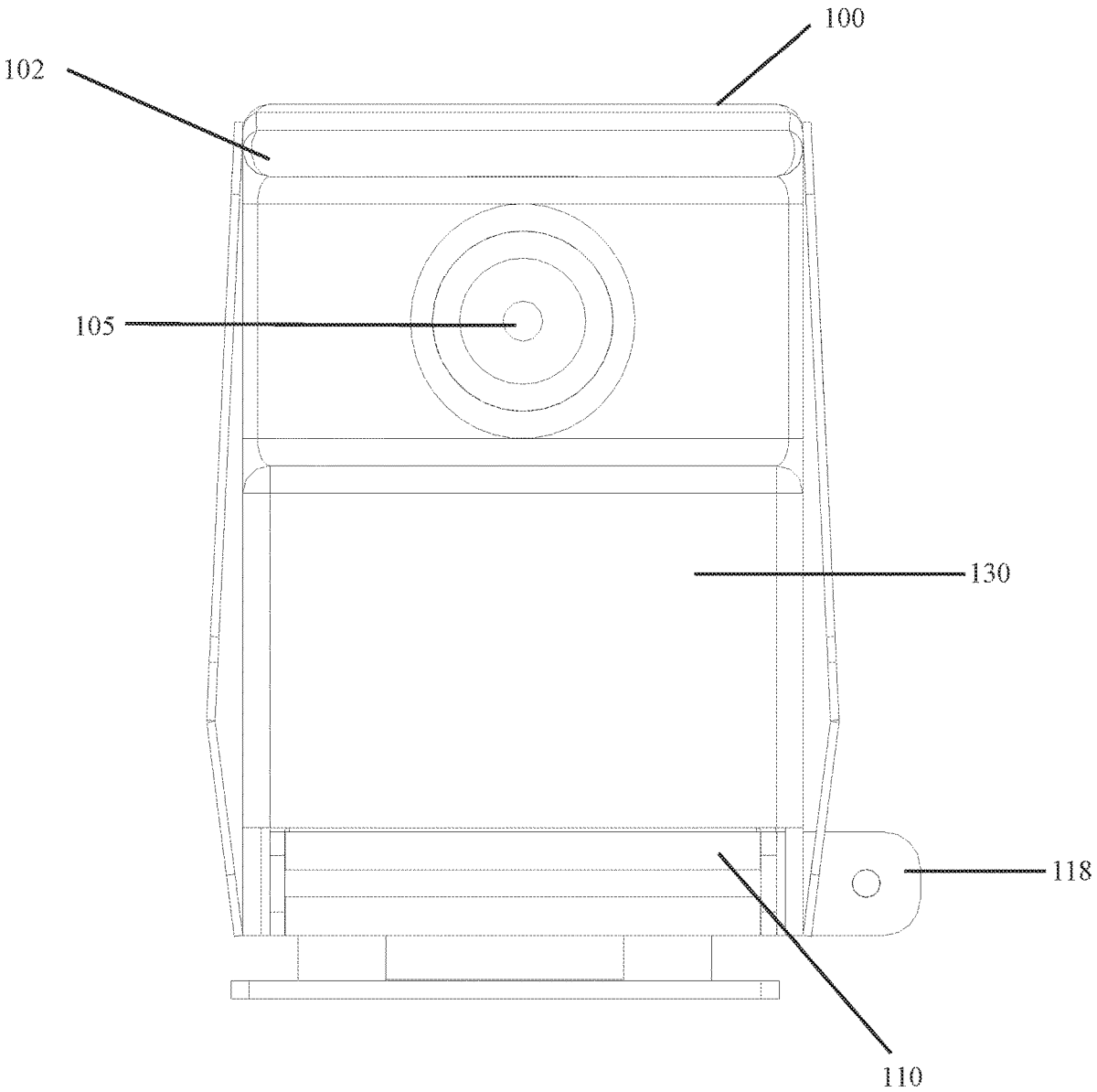
FIG. 6 is a right side view thereof.

FIG. 6 shows the side wall 130 and attachment body 110 extending laterally from side wall 130. The housing 102 also provides a power connection 105 for the power cord 103 to enter the housing to power the motor and the floor machine 100. FIG. 6 also shows attachment body 118 to show the two different attachment points, attachment body 110 and attachment body 118, for securing the handle to the housing 102.

The user can attach the handle to the different attachment points to change the configuration of the treatment attachment and the driver plate in relation to the handle. Changing the configuration of the treatment attachment in relation to the handle alters operation of the floor machine. If the user needs access to narrower spaces, the user may attach the handle to attachment body 110 for use of the floor machine 100. If the user requires larger surface coverage, the user attaches the handle to attachment body 118 to increase the width of the surface treated with each push/pull of the handle 108.

Figure 7:
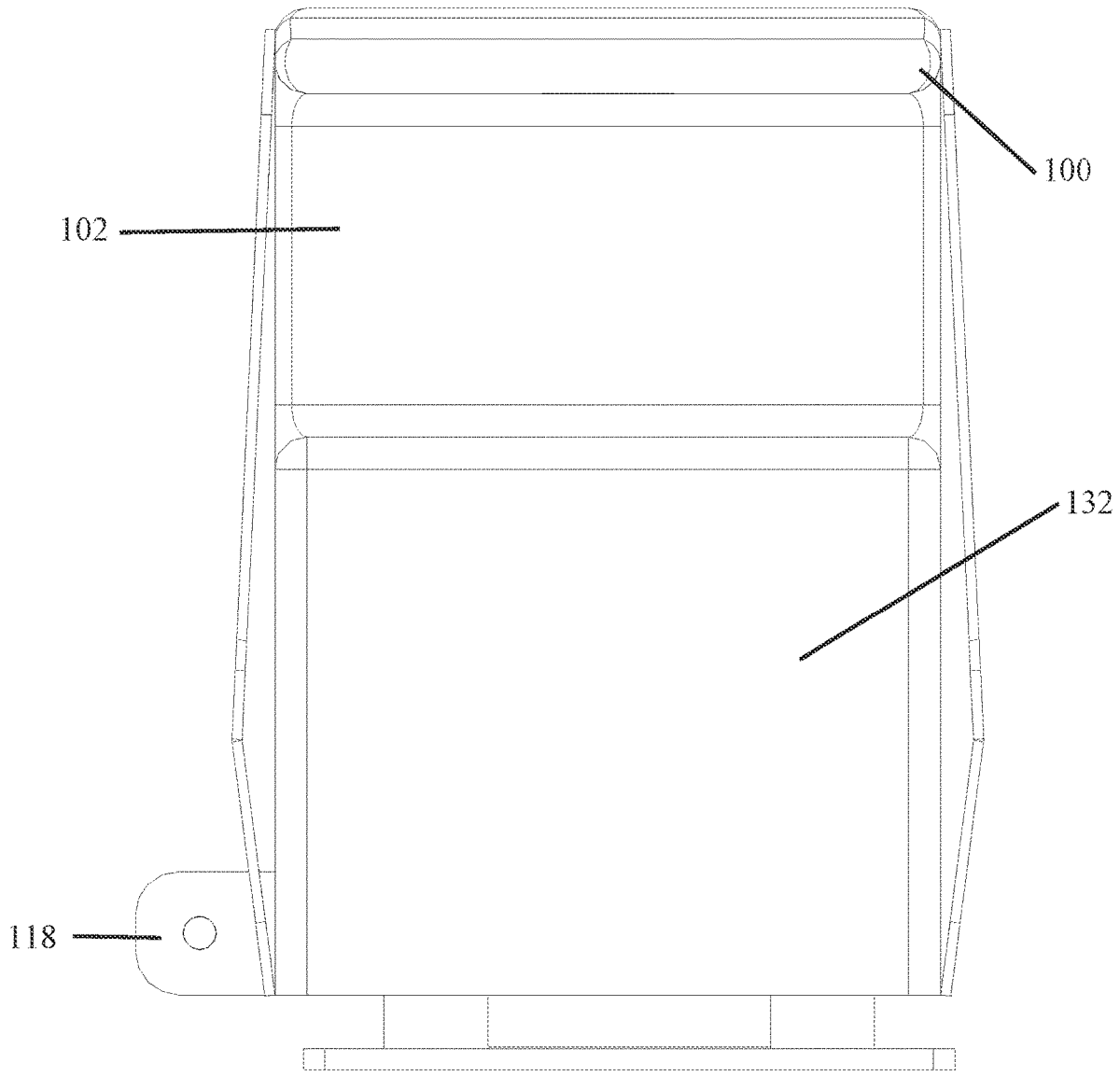
FIG. 7 is a left side view thereof.

FIG. 7 shows side wall 132 of housing 102 of the floor machine 100. FIG. 7 also shows attachment body 118 and its relation to the side wall 132.

Figure 8:
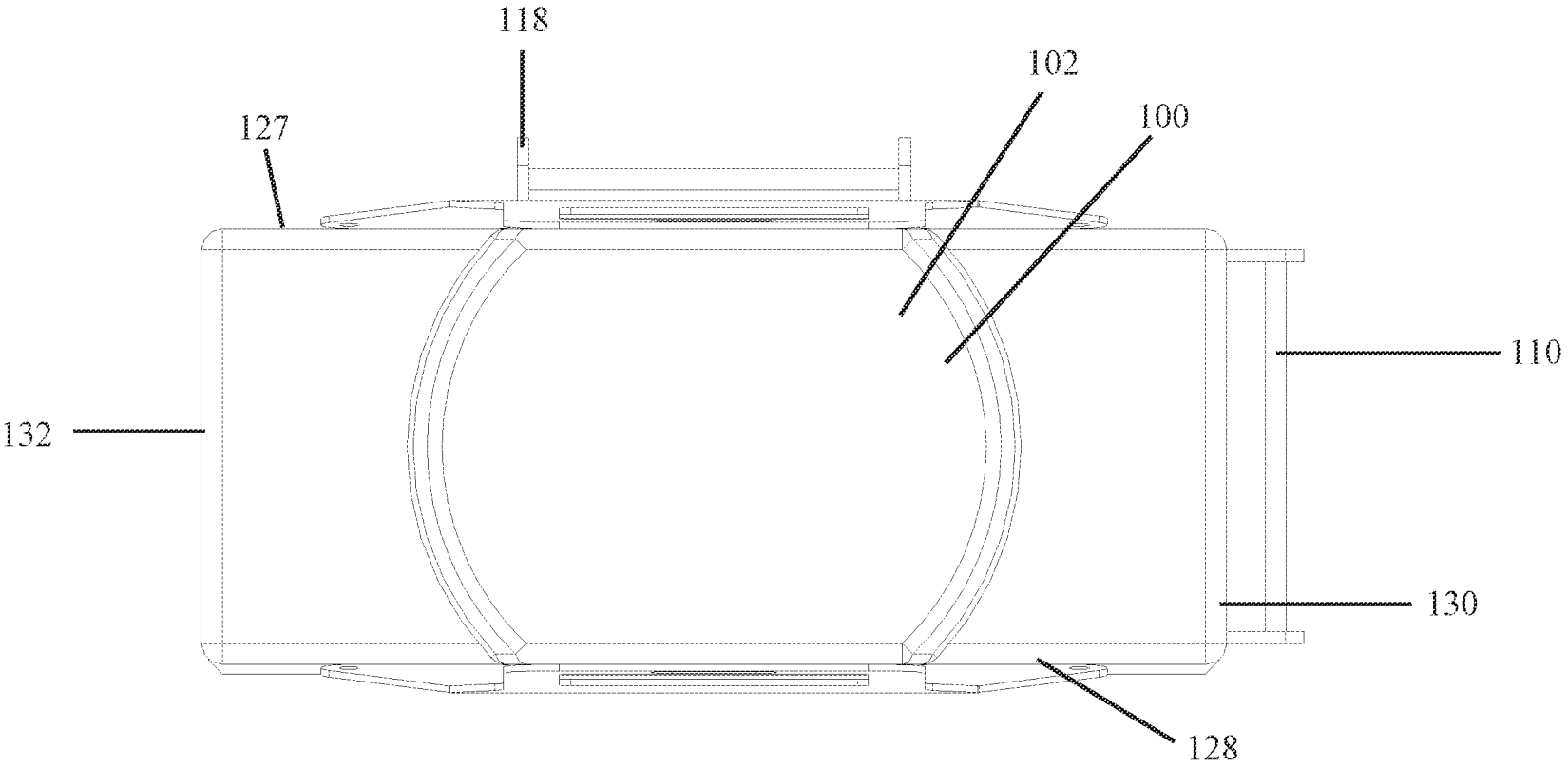
FIG. 8 is a top view thereof.

FIG. 8 shows a top view of the housing 102 and floor machine 100. The width of the housing 102, the distance from side wall 130 to side wall 132, is greater than the depth of the housing 102, the distance from front wall 128 to rear wall 127. By attaching the handle to the attachment body 110, the user can configure the floor machine to have a narrower footprint to gain access to narrower areas. The user can increase the width of the footprint by attaching the handle to the attachment body 118.

Figure 9:
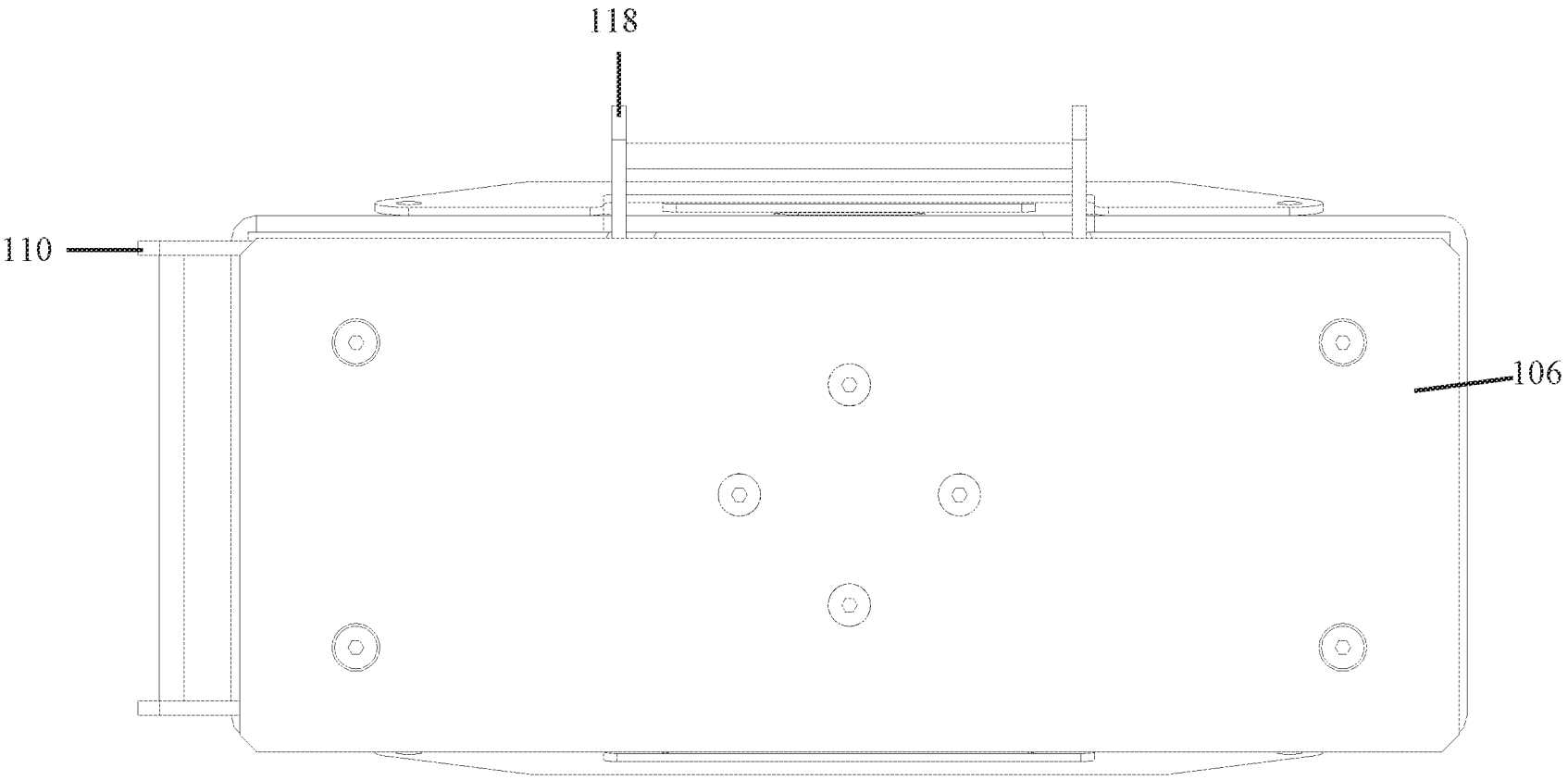
FIG. 9 is a bottom view thereof.
Figure 33:
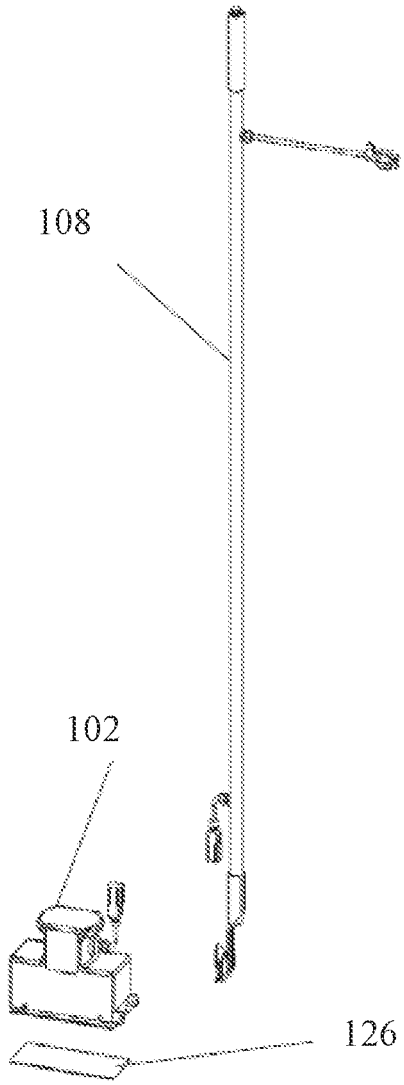
FIG. 33 is an exploded view of one embodiment of the present invention.

FIGS. 9 and 33 show the driver plate 106 to which the gripping surface 126 attaches as shown in FIG. 33. Gripping feet extend from the gripping surface 126. The gripping feet provide protrusions extending laterally from the gripping surface 126 to secure a treatment attachment to the gripping surface 126. FIG. 9 also shows the attachment bodies 110, 118 in relation to the driver plate 106 and the gripping surface to emphasize the user's ability to configure the footprint of the floor machine 100 through attachment of the handle.

FIG. 9 also shows the bottom of the driver plate 106 at which the bottom gripping surface is located. The bottom gripping surface provides a surface to which the treatment attachment attaches. The bottom gripping surface is located on the bottom of the housing 102 and secures the treatment attachment to the driver plate 106 and the floor machine 100.

Figure 10:
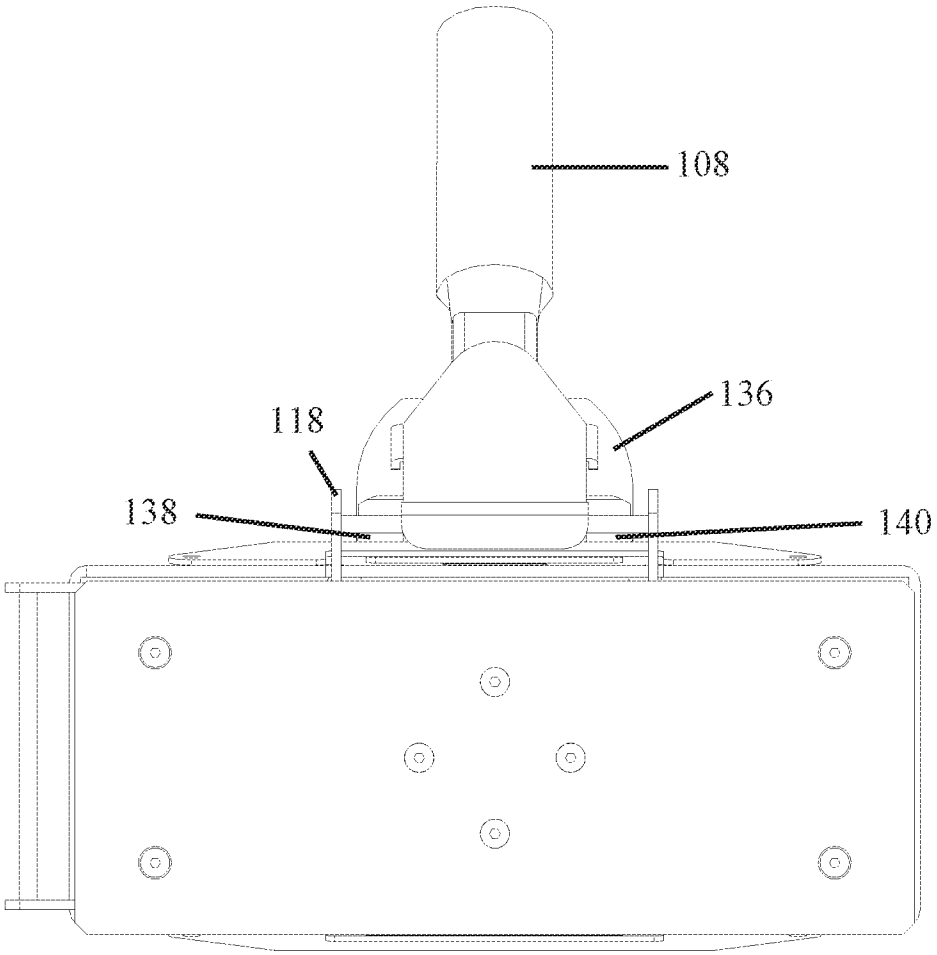
FIG. 10 is a bottom view thereof.
Figure 11:
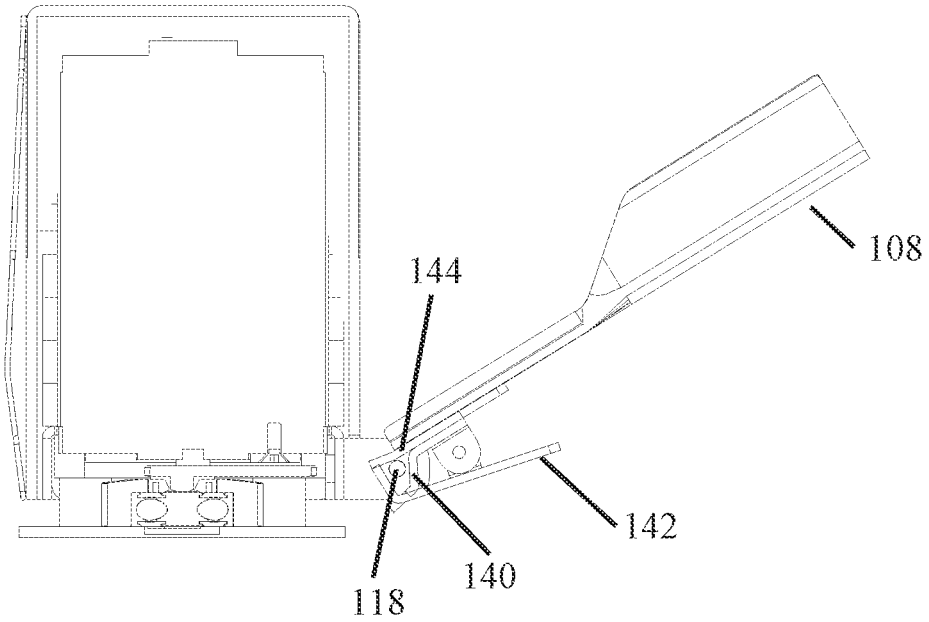
FIG. 11 is a sectional view thereof.

FIGS. 10-11 show the attachment of handle 108 to attachment body 118. The handle 108 attaches to one attachment body 118 at a time. The attachment head 136 provides an upper jaw 142 and a lower jaw 144 that clip around the attachment neck, such as a pin, bar, rod, or other fastener. Attachment teeth 138, 140 secure to lower jaw 144 and extend vertically upward from lower jaw 144 towards upper jaw 142. The attachment teeth 138, 140 create an opening located between the lower jaw 144 and the attachment teeth 138, 140. The attachment neck of attachment body 118 is then placed within the opening below the attachment teeth 138, 140 between the attachment teeth 138, 140 and lower jaw 144.

The upper jaw 142 and lower jaw 144 are then adjusted to the closed position to secure the handle to the housing. In one embodiment, the upper jaw 142 and lower jaw 144 are biased to the closed position to secure the handle to the closed position. The user can adjust the upper jaw 142 and lower jaw 144 to the open position to release the handle from the housing.

FIGS. 12 and 13 show the handle 108 secured to the attachment body 110 of housing 102. Attachment of the handle 108 to adjustment body 110 adjusts the orientation of housing 102 in relation to the handle 108. The differences in the orientation of the housing 102 in relation to the handle 108 are demonstrated at FIGS. 12-13 and FIGS. 1-3. FIGS. 1-3 show the handle 108 secured to adjustment body located on the rear wall 127.

Figure 14:
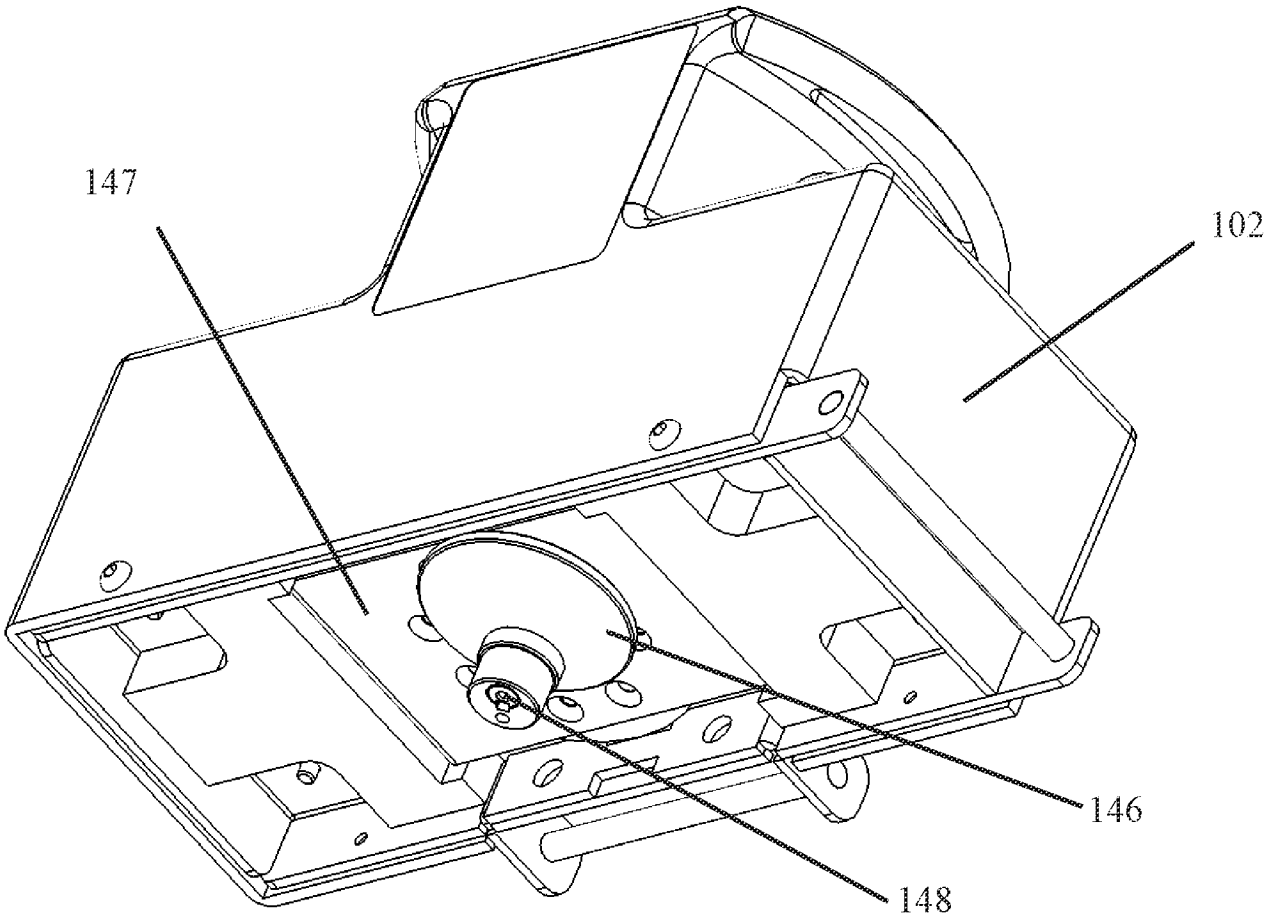
FIG. 14 is a bottom partial view thereof.

FIG. 14 shows a bottom view of the housing 102 in which the driver plate 106 has been removed to show the eccentric assembly 146 and shaft fastener 148. The bearing cup of the eccentric assembly 146 attaches to driver plate 106. Eccentric assembly 146 offsets the attachment of the driver plate 106 with the motor. Shaft fastener 148 secures the eccentric assembly 146 with the motor. Offsetting shaft fastener 148 in relation to the driver plate 106 enables the driver plate to revolve around the shaft fastener 148.

Figure 15:
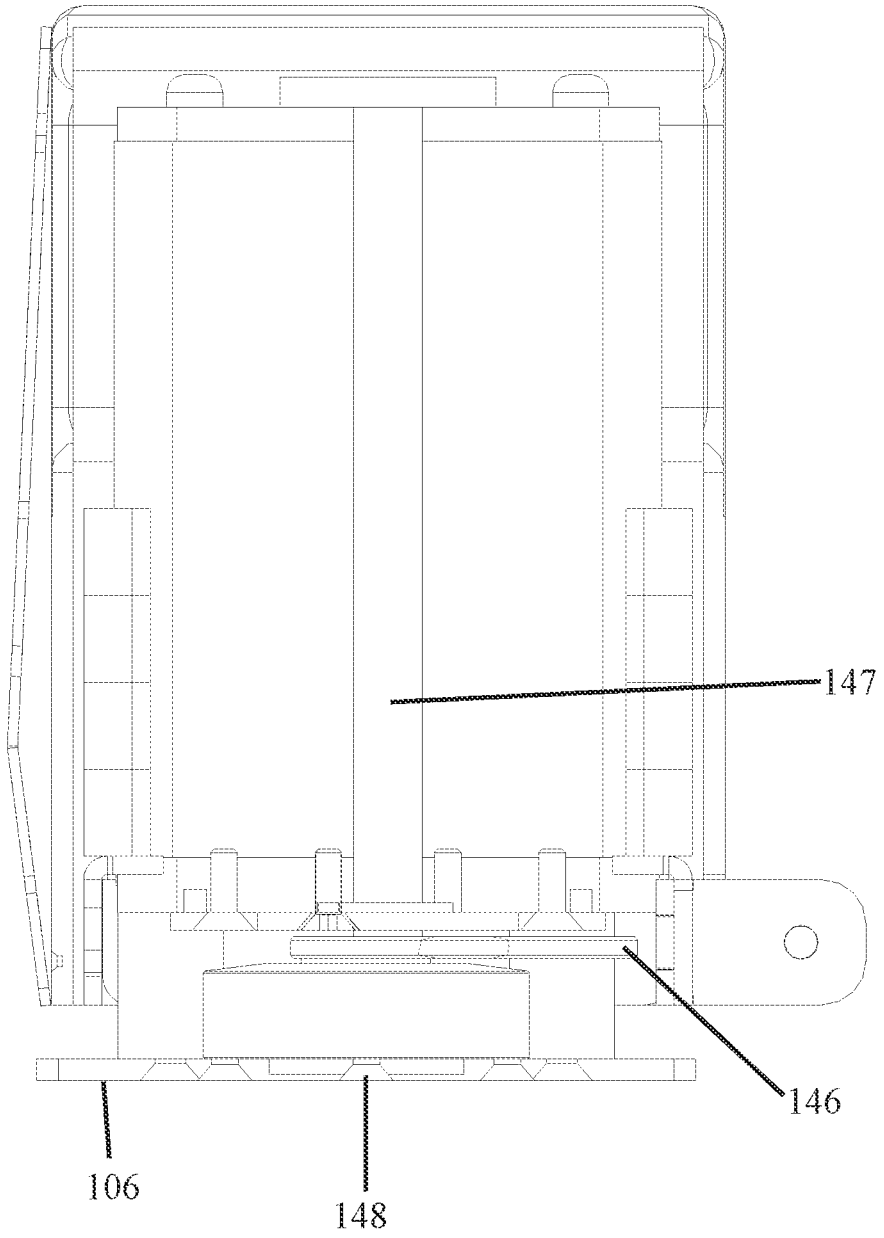
FIG. 15 is a sectional view thereof.
Figure 16:
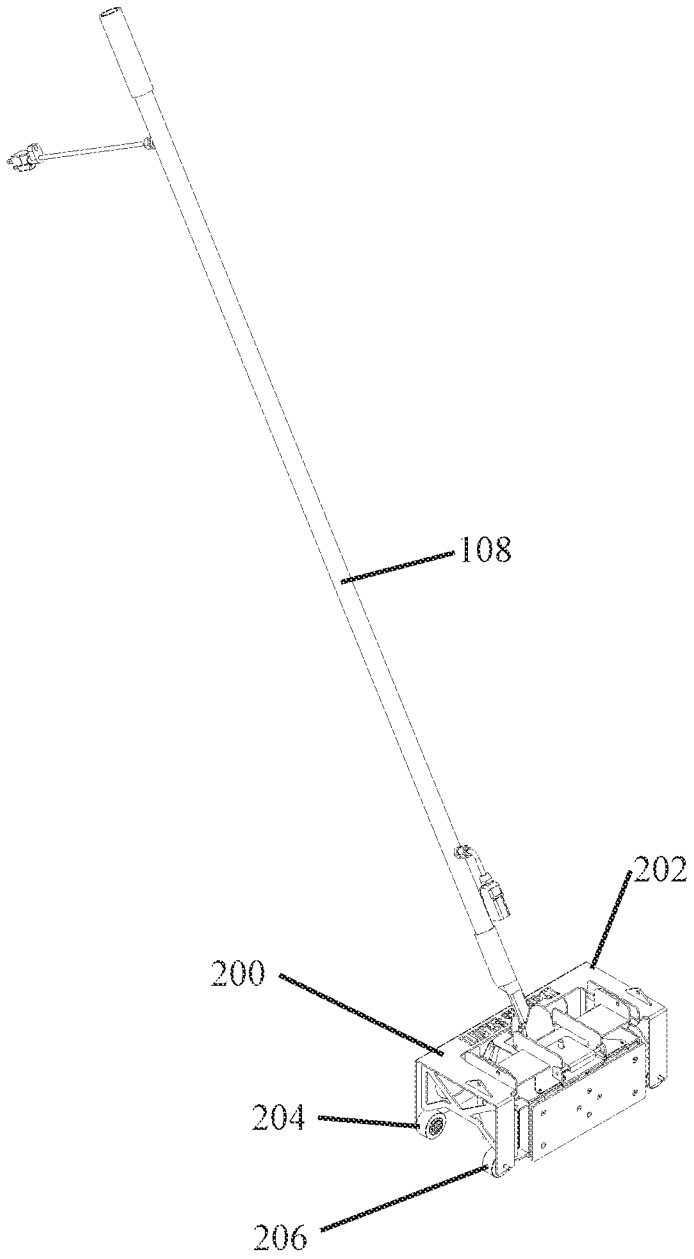
FIG. 16 is an environmental view of one embodiment of the present invention.
Figure 17:
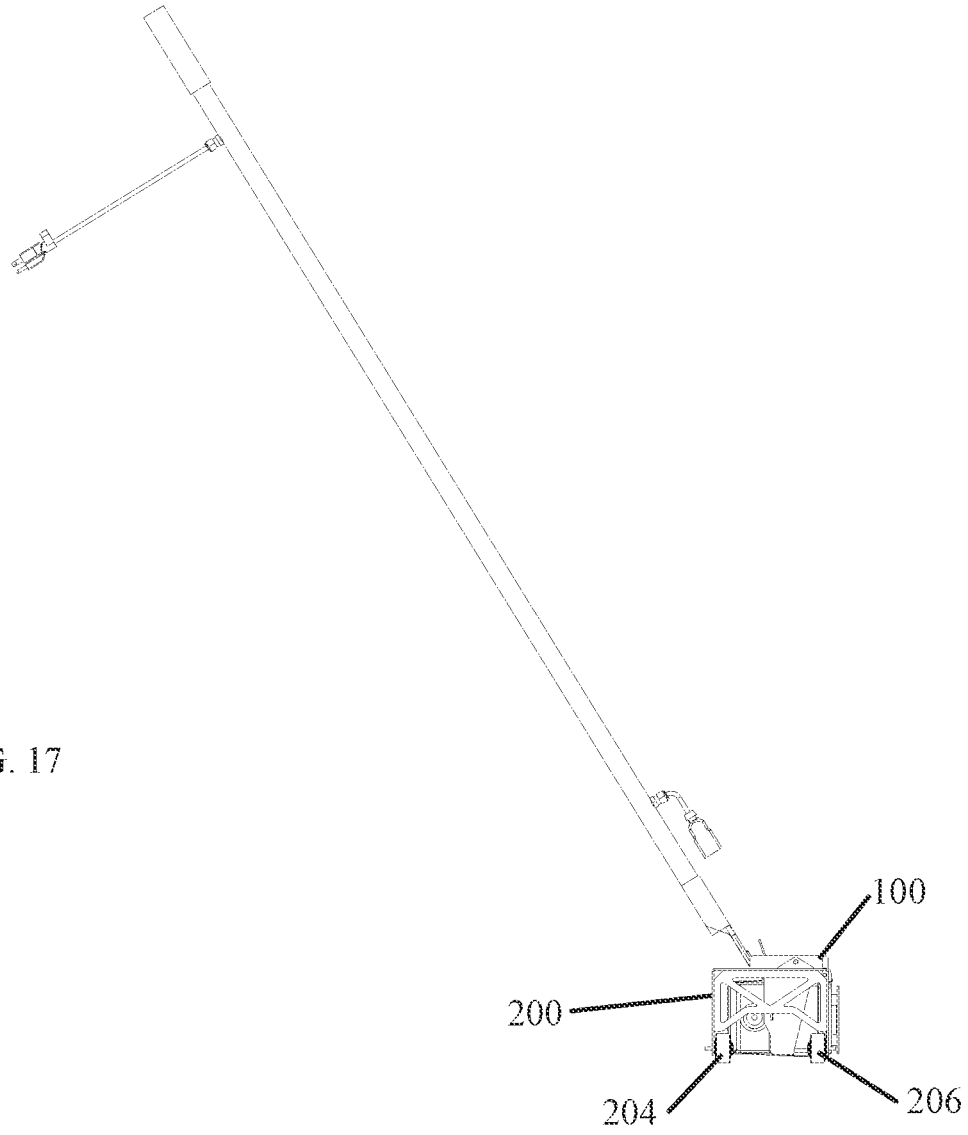
FIG. 17 is a left side view thereof.
Figure 18:
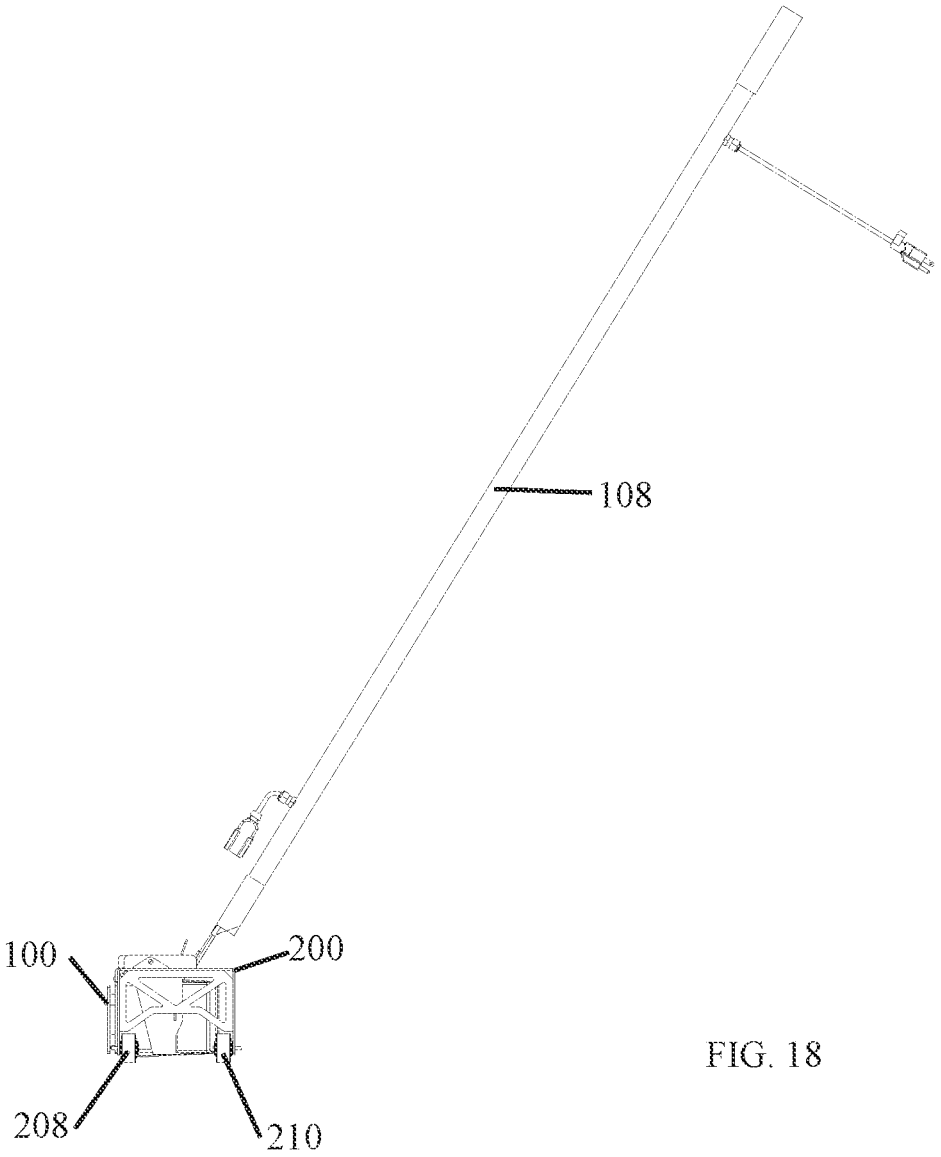
FIG. 18 is a right side view thereof.
Figure 19:
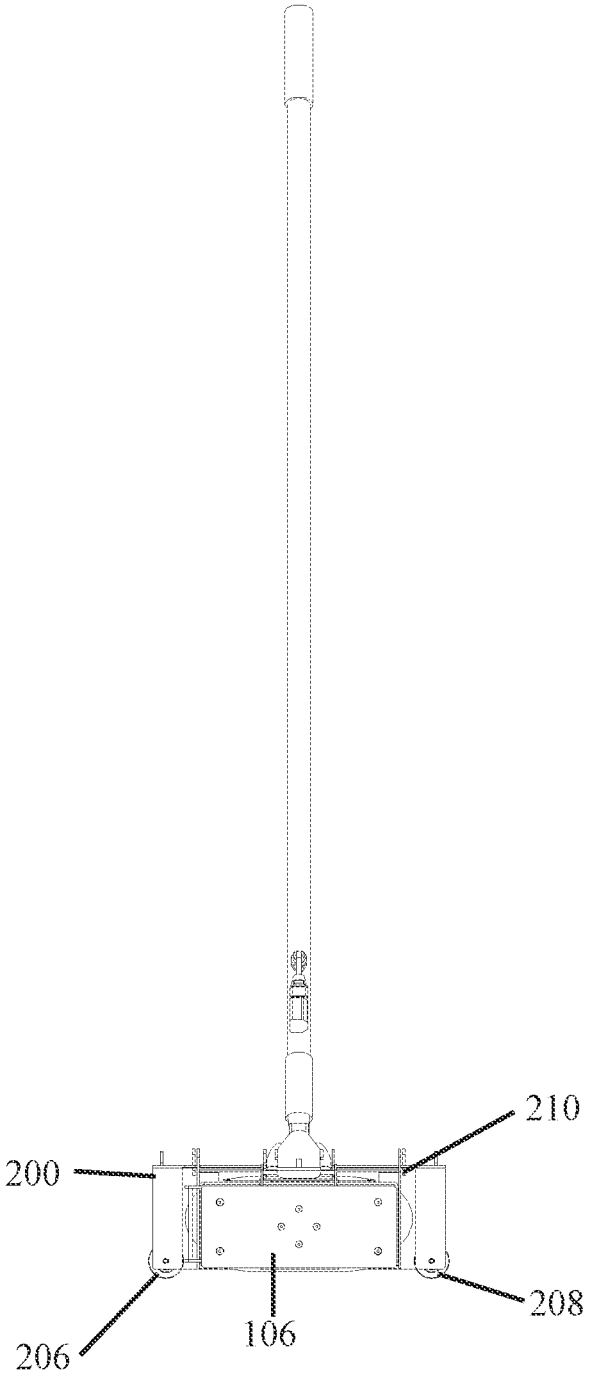
FIG. 19 is a front view thereof.
Figure 20:
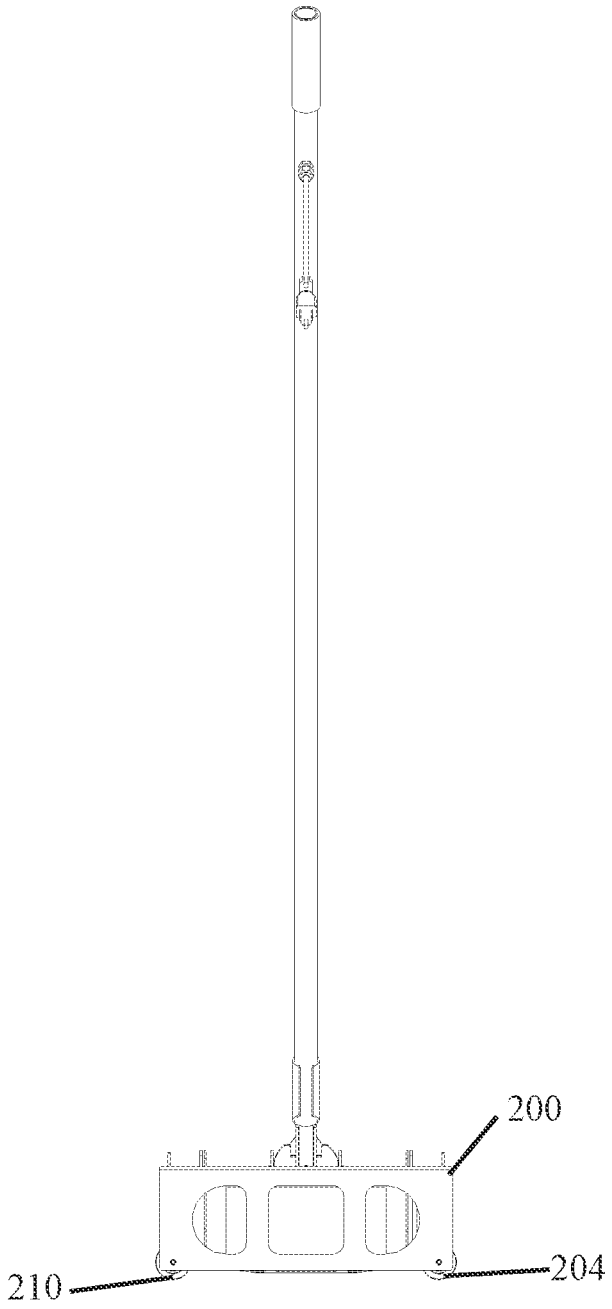
FIG. 20 is a rear view thereof.

FIG. 15 shows the attachment of the eccentric assembly 146 to the motor shaft 147. The shaft fastener 148 secures the eccentric assembly 146 to the driver plate 106.

FIGS. 16-32 show another embodiment of the present invention in which the floor machine 100 is oriented to the side and secured to a rolling attachment 200. The handle 108 secures to the rolling frame 202 with wheels 204, 205. The rolling frame 202 provides an opening in the front for placement of the driver plate.

FIGS. 16-20 show wheels 204, 206, 208, 210 attached to rolling attachment 200. The wheels are secured to the rolling attachment to allow movement in two directions, side to side. The placement of the handle 108 enables the user to exert a forward force on the driving plate 106 and the treatment attachment. Such a forward force presses the treatment attachment into the wall or baseboard to be cleaned. The wheels 204, 206, 208, 210 direct the rolling attachment 200 side to side to enable the user to traverse the wall with the treatment attachment.

Figure 21:
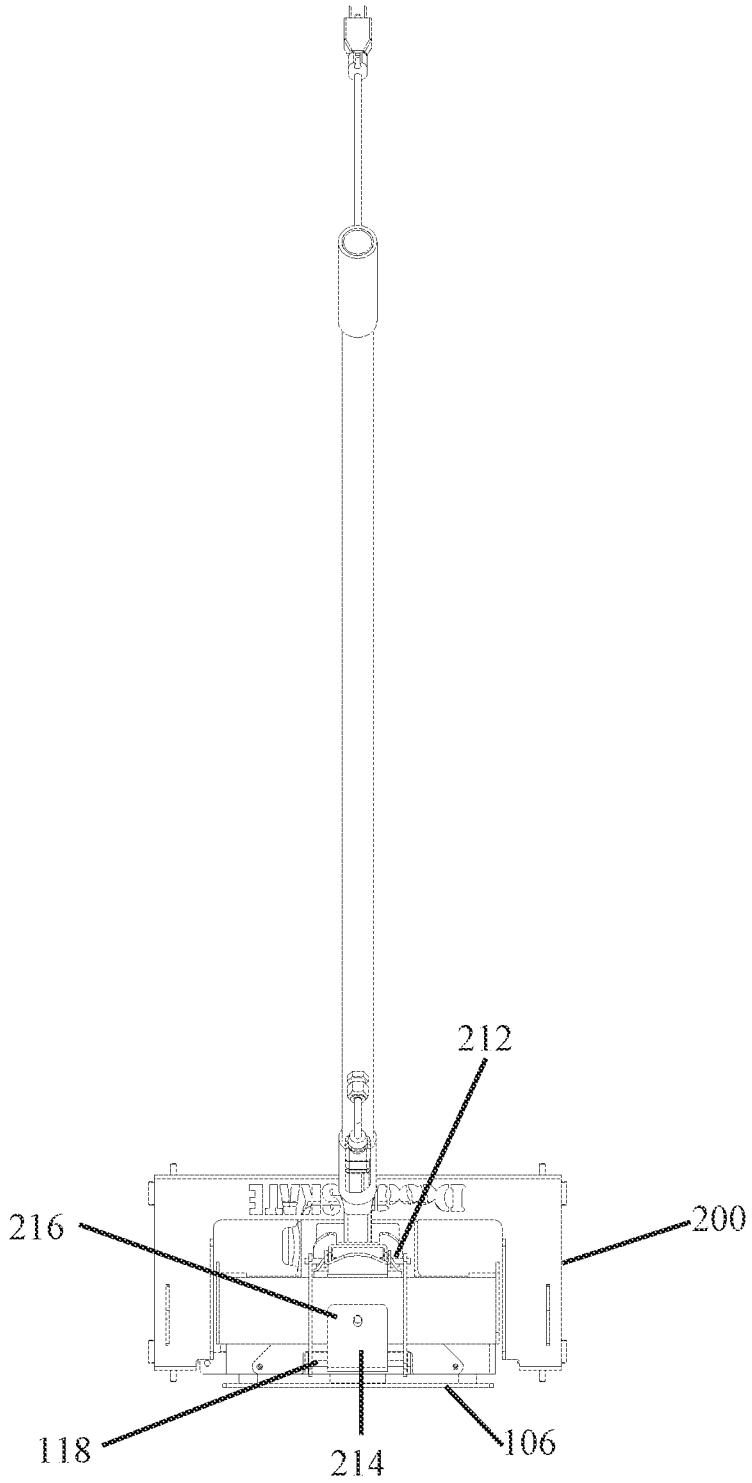
FIG. 21 is a top view thereof.

FIG. 21 shows the attachment of the floor machine 100 to the rolling attachment 200. The handle attaches to the attachment body 212 of the rolling attachment 200. Locking arm 214 is placed onto locking pin 216 to secure the attachment body 118 of the floor machine to the rolling attachment. The driving plate 106 extends forward from the rolling attachment 200 to allow the user to treat the wall and/or baseboards with the treatment attachment.

Figure 22:
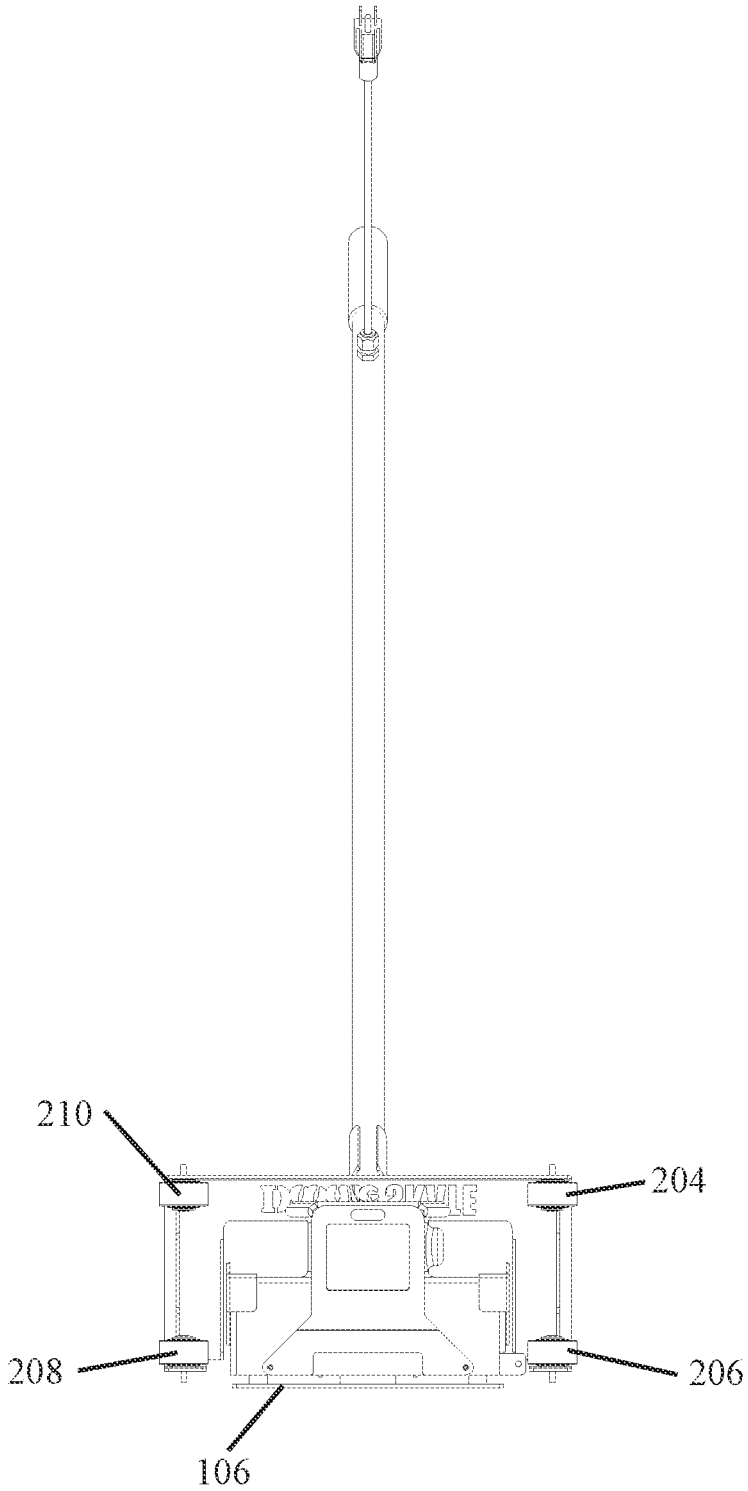
FIG. 22 is a bottom view thereof.
Figure 23:
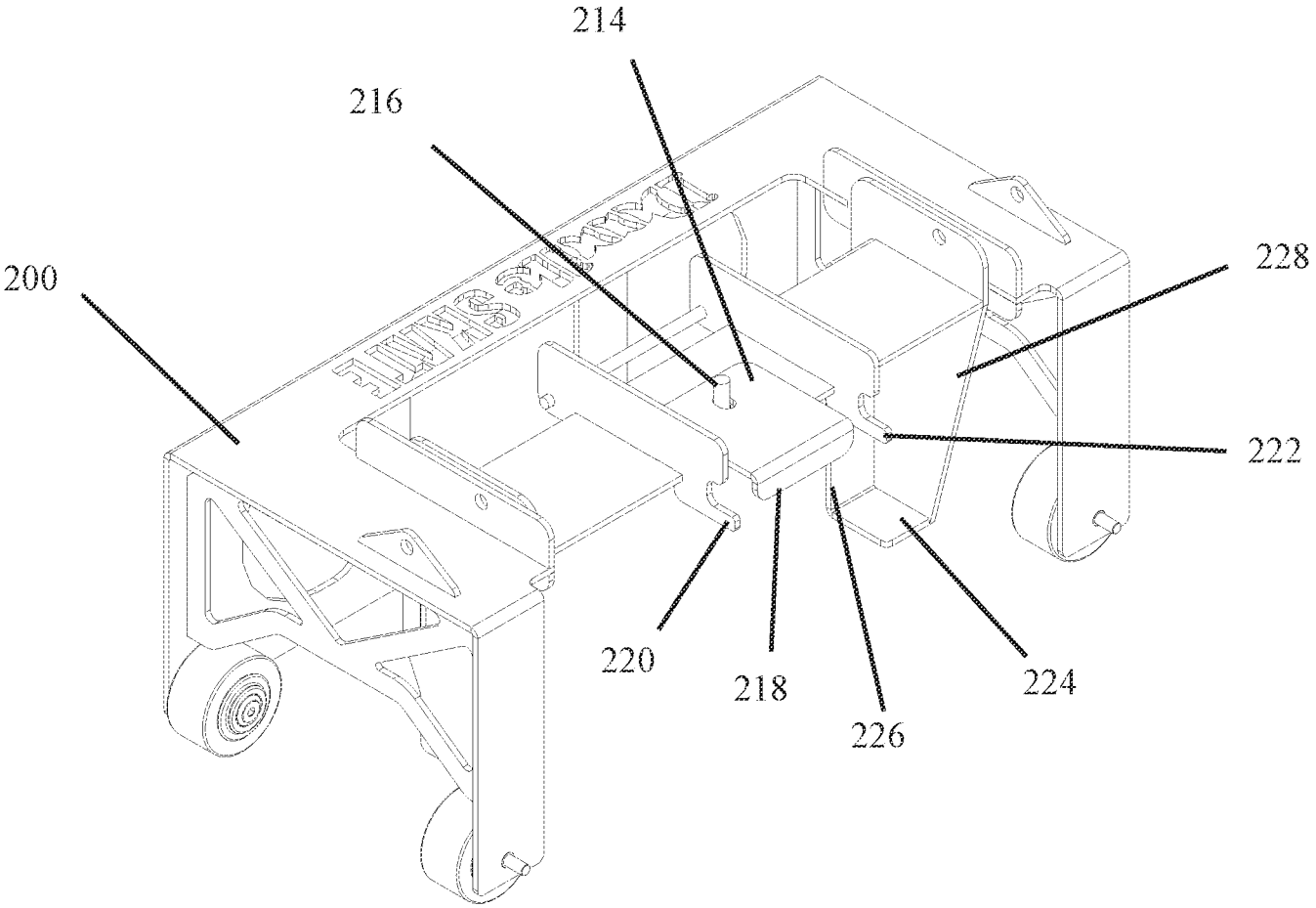
FIG. 23 is a perspective view of a rolling attachment of one embodiment of the present invention.
Figure 24:
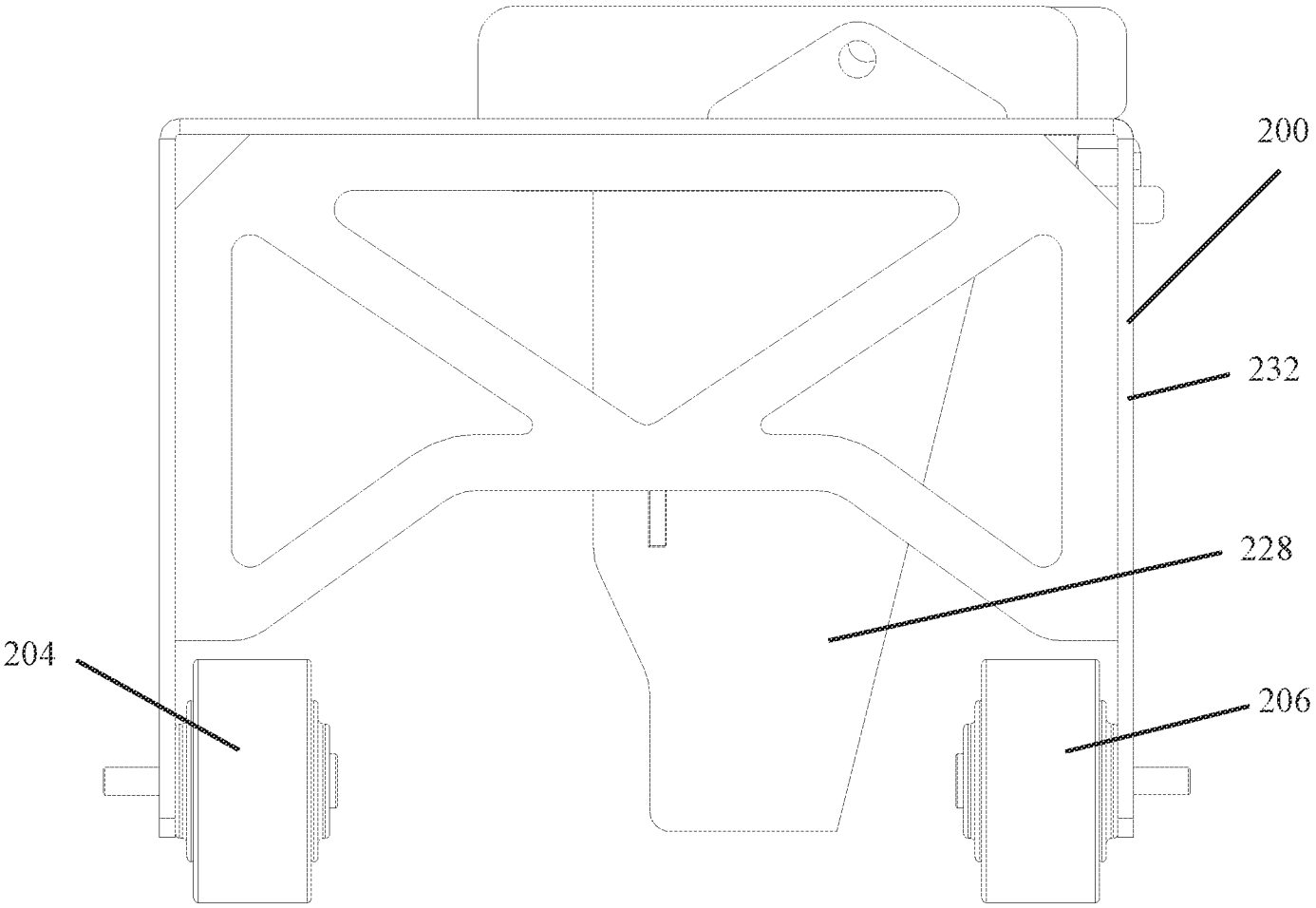
FIG. 24 is a left side view thereof, the right side view being a mirror image of the left side view.

FIG. 22 shows the attachment of wheels 204, 206, 208, 210 to the rolling attachment. In one embodiment, the wheels are attached in a fixed position to avoid pivoting of the wheels. Such attachment of the wheels 204, 206, 208, 210 assists with side to side movement for cleaning the walls and/or baseboards.

FIGS. 23-28 show the roller attachment 200 with the floor machine removed from the rolling attachment 200. Support body 228 positions the floor machine off of the ground and limits backwards movement. Support foot 224 maintains the floor machine above the ground to prevent dragging of the floor machine against the ground.

The user presses the floor machine into the wall and/or baseboard. The support leg 226 limits backwards movement of the floor machine. Therefore, the user can maintain the treatment attachment on the wall and/or baseboards without too much backward movement of the floor machine. The other side of rolling attachment 200 also provides a support body similar to support body 228.

The rolling attachment 200 also provides an upper attachment through support fingers 220, 222. Support fingers 220, 222 contact the attachment body 110. Locking arm 214 and locking finger 218 attach to locking pin 216 to secure attachment body 110 between the support fingers 220, 222 and locking finger 214 and locking arm 218.

Roller attachment 200 provides a front wall 232 and a rear wall 230. Wheels 204, 210 secure to rear wall 230. Wheel 206 secures to front leg 232. The support body 228 maintains the positioning of the cleaning body while in use.

Figure 25:
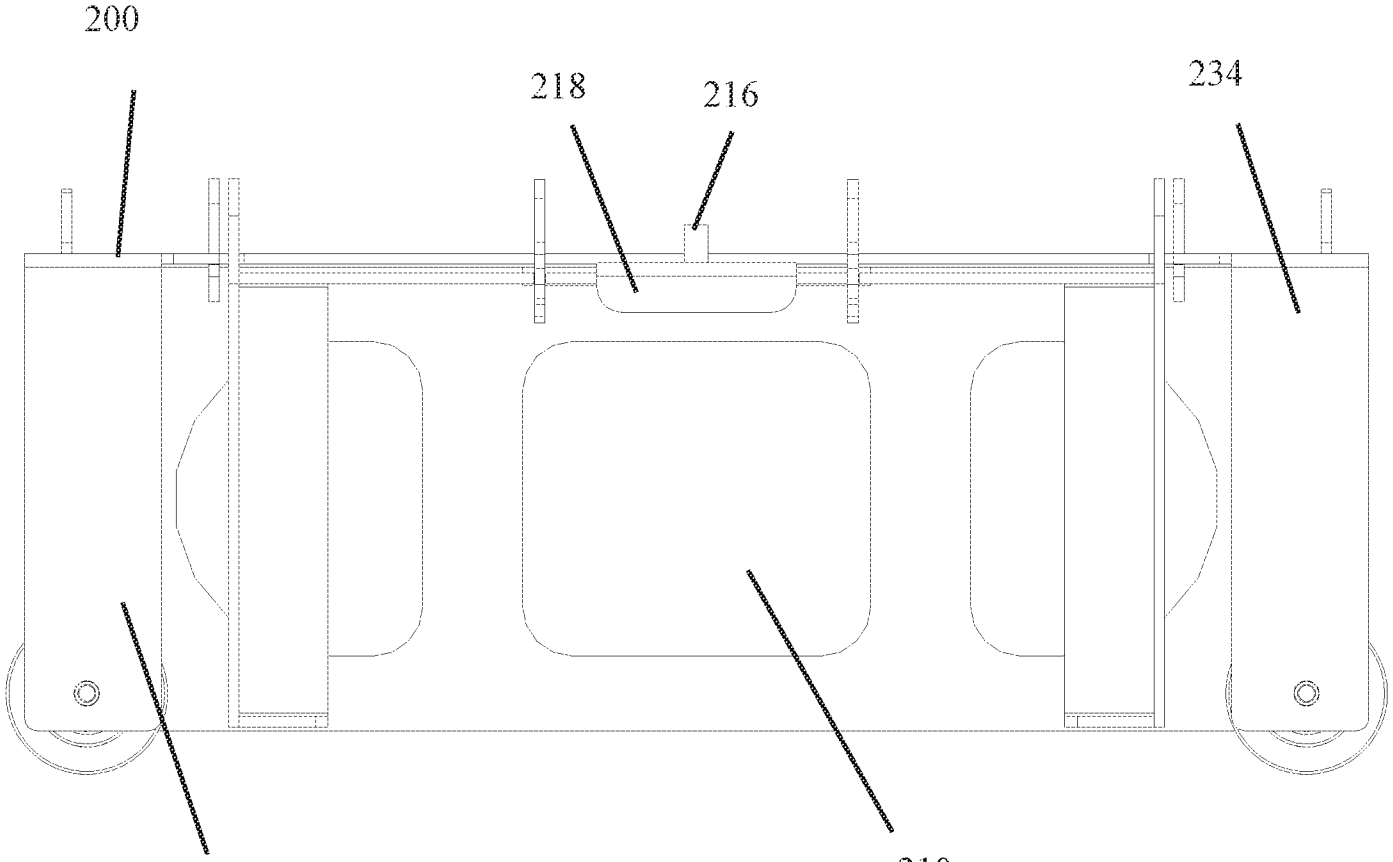
FIG. 25 is a front view thereof.

FIG. 25 shows the locking finger 218 attached to the locking pin 216. The locking finger 218 extends vertically downward to secure the attachment body to the rolling attachment 200. The front wheels secure to front legs 232, 234 to allow for movement from side to side. Opening 236 between front legs 232, 234 provides sufficient space for the driving plate and treatment attachment to contact the wall.

Figure 26:
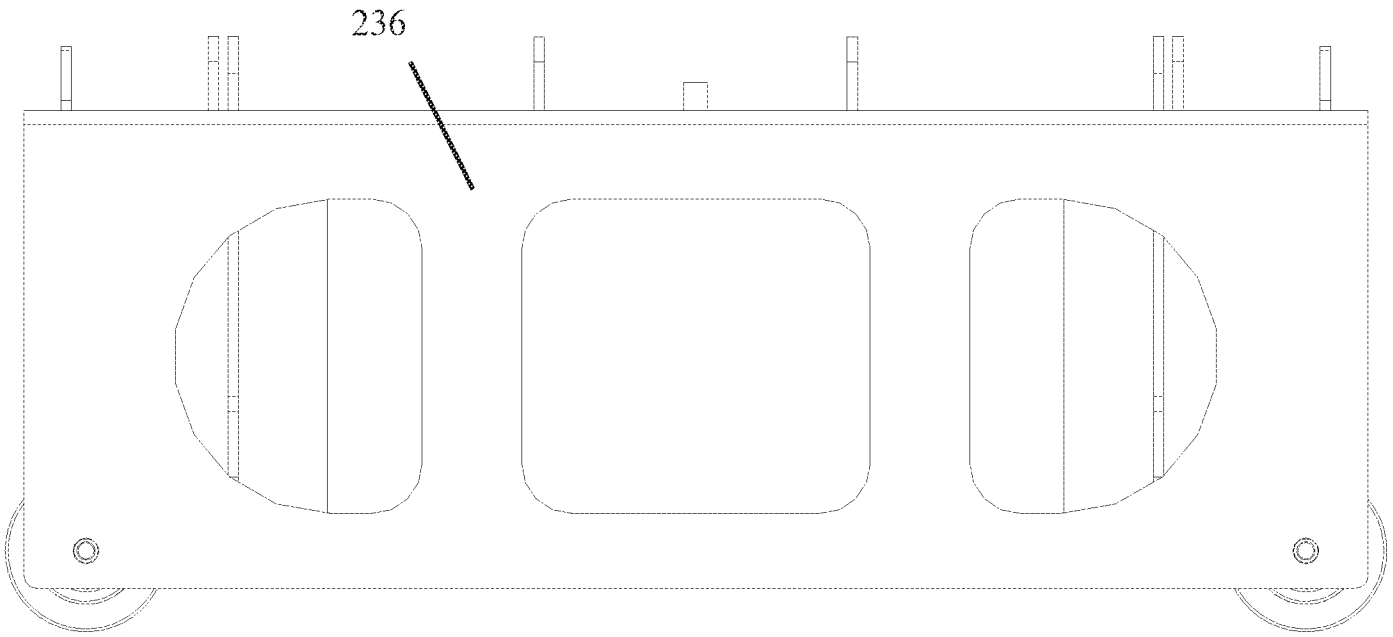
FIG. 26 is a rear view thereof.

FIG. 26 shows rear wall 230 and the attachment of the rear wheels to the rear wall 230.

Figure 27:
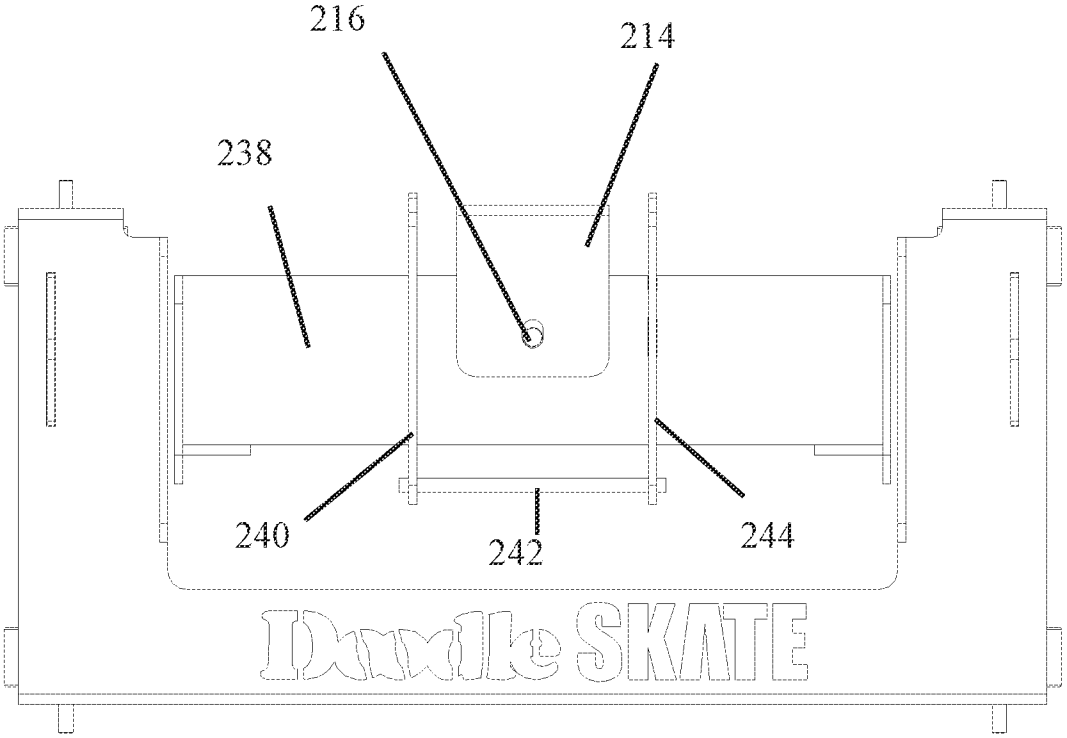
FIG. 27 is a top view thereof.
Figure 28:
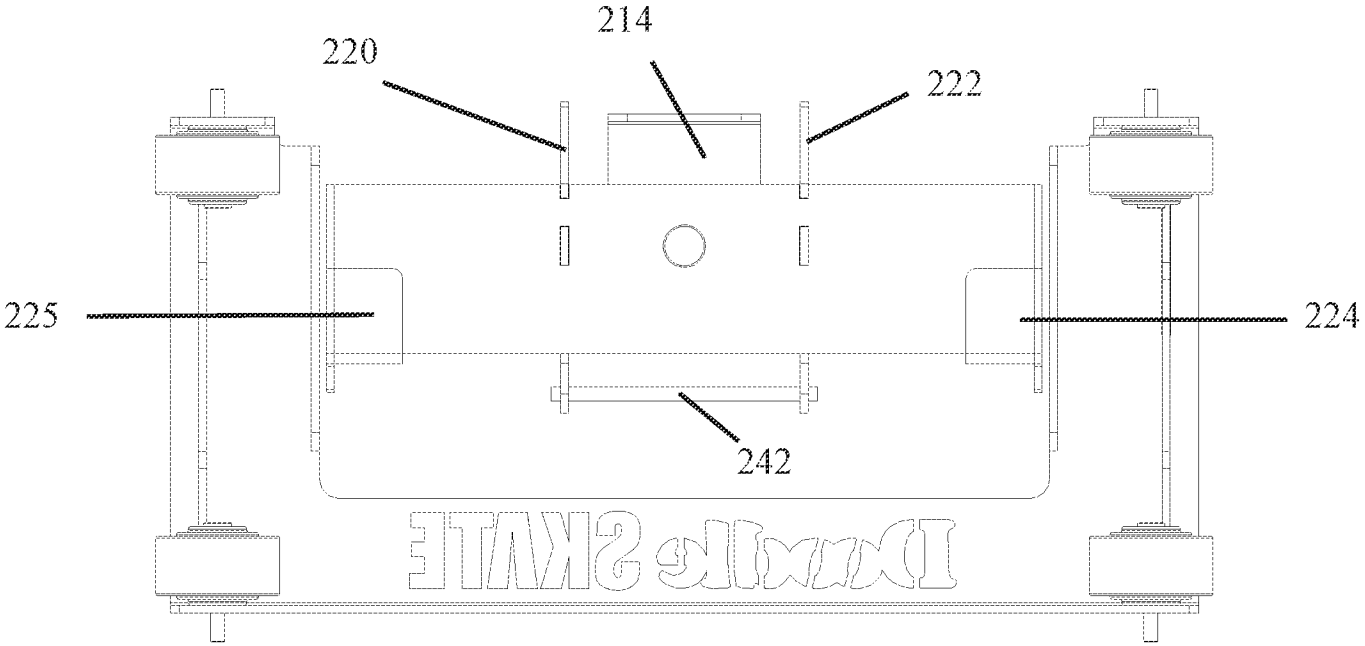
FIG. 28 is a bottom view thereof.

FIGS. 27 and 28 show the positioning of the locking pin 216 within the locking arm 214. The locking body 238 provides attachment shoulders 240, 244 for attachment body 242. The attachment body 242 provides an attachment neck similar to the attachment bodies described above.

FIGS. 27-28 also show the support fingers 220, 222 and support bodies 224, 225.

Figure 29:
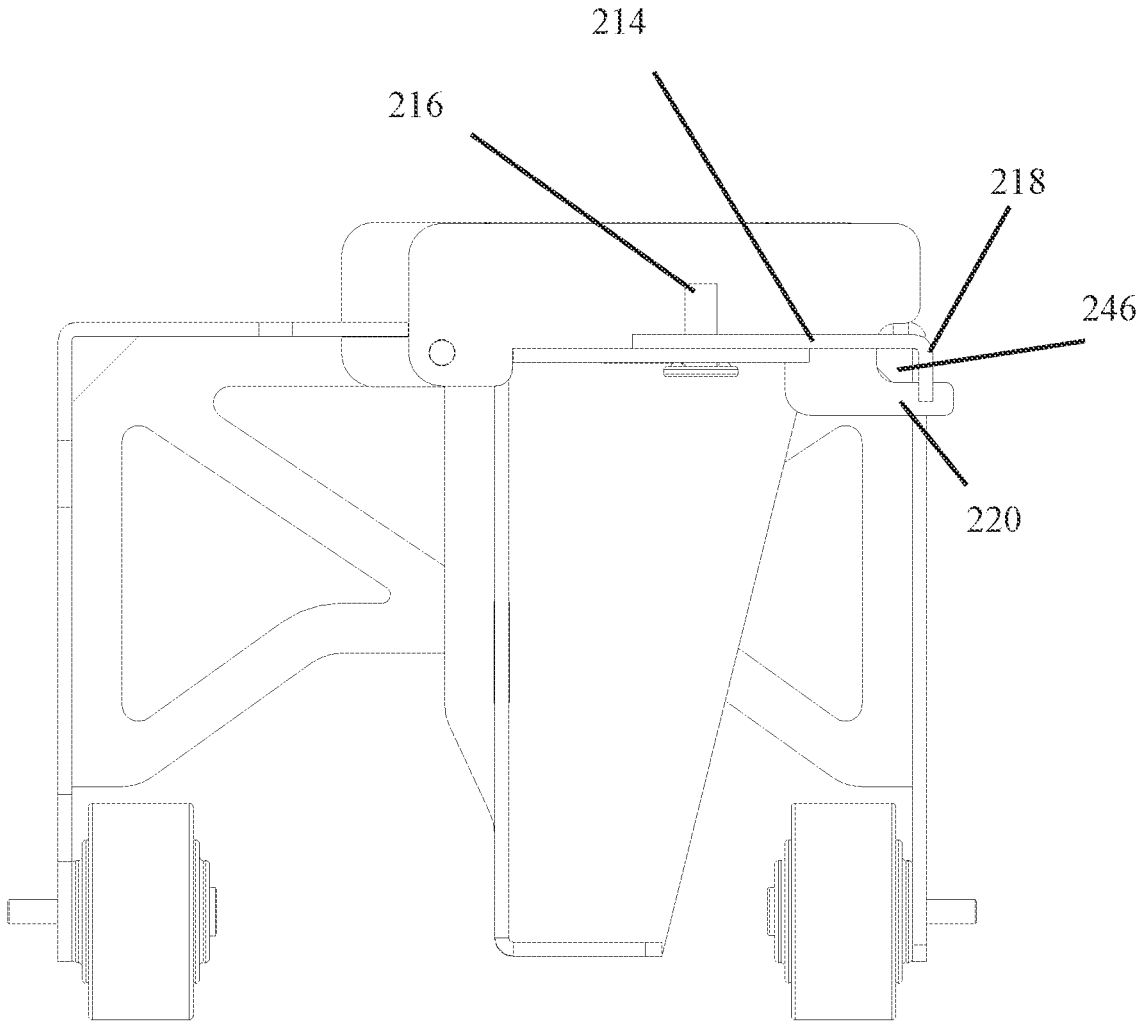
FIG. 29 is a sectional view thereof.

FIG. 29 shows the attachment aperture 246 formed by the support fingers 220, 222, locking arm 214, and locking finger 218. Locking pin 216 secures the locking arm 214 on to the rolling attachment to maintain the positioning of the locking arm 214 and locking finger 218. The locking finger 218 secures the attachment body of the floor machine within the attachment aperture 246 to secure the floor machine within the attachment aperture.

Figure 30:
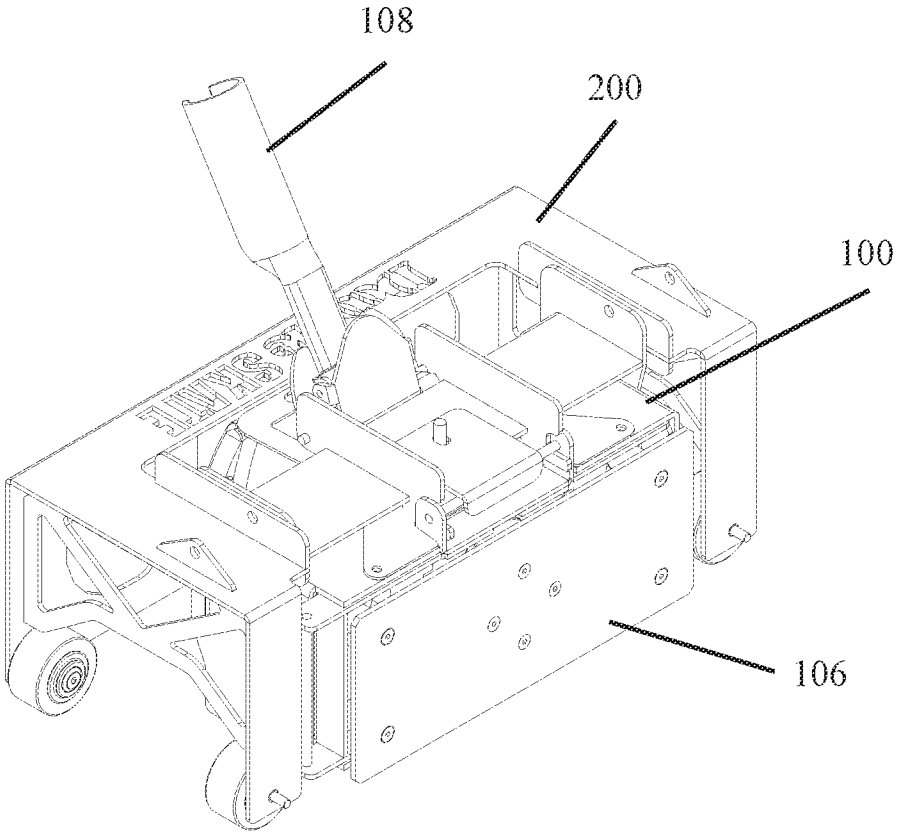
FIG. 30 is an environmental view thereof.

FIG. 30 shows handle 108 that secures to the rolling attachment. The floor machine 100 is secured to the rolling attachment. As discussed above, the rolling attachment 200 provides space between the front legs for exposing the driver plate 106 and treatment attachment to the wall and or baseboards.

Figure 31:
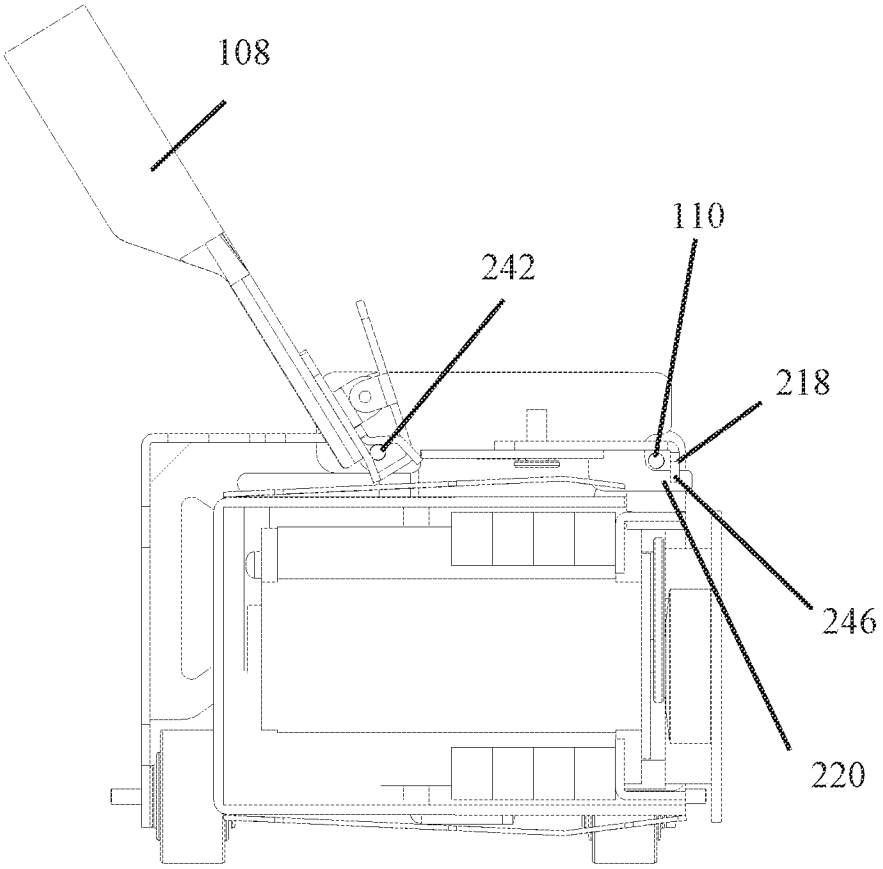
FIG. 31 is a sectional view thereof.

FIG. 31 shows the attachment of the handle 108 to the attachment body 242. The attachment of the handle to the attachment body is similar to the attachment of the handle to the attachment bodies of the floor machine described above.

Figure 32:
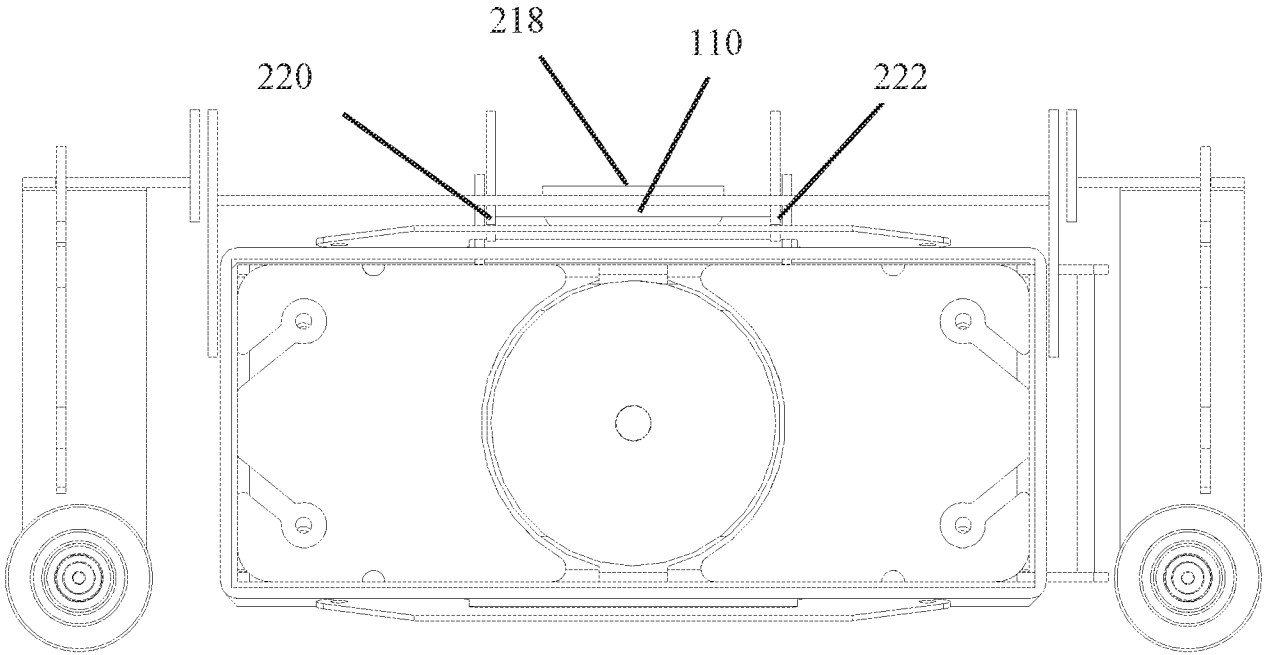
FIG. 32 is a sectional view thereof.

FIGS. 32-33 show the attachment of the floor machine to the rolling attachment. Attachment body 110 inserts into the attachment aperture 246. Attachment arm and attachment finger lift upwards from attachment pin. Attachment body 110 is placed onto support fingers 220, 222. The user then places the attachment arm and attachment finger 218 onto the attachment pin. The placement of the attachment arm and attachment finger on the attachment pin secures the attachment body into the attachment aperture 246. The user can then clean the baseboards and/or walls.

To remove the floor machine from the roller attachment, the user lifts the attachment finger 218 and attachment arm off of attachment pin. The user can then remove the floor machine from the support fingers 220, 222 and the roller attachment.

Figure 34A:
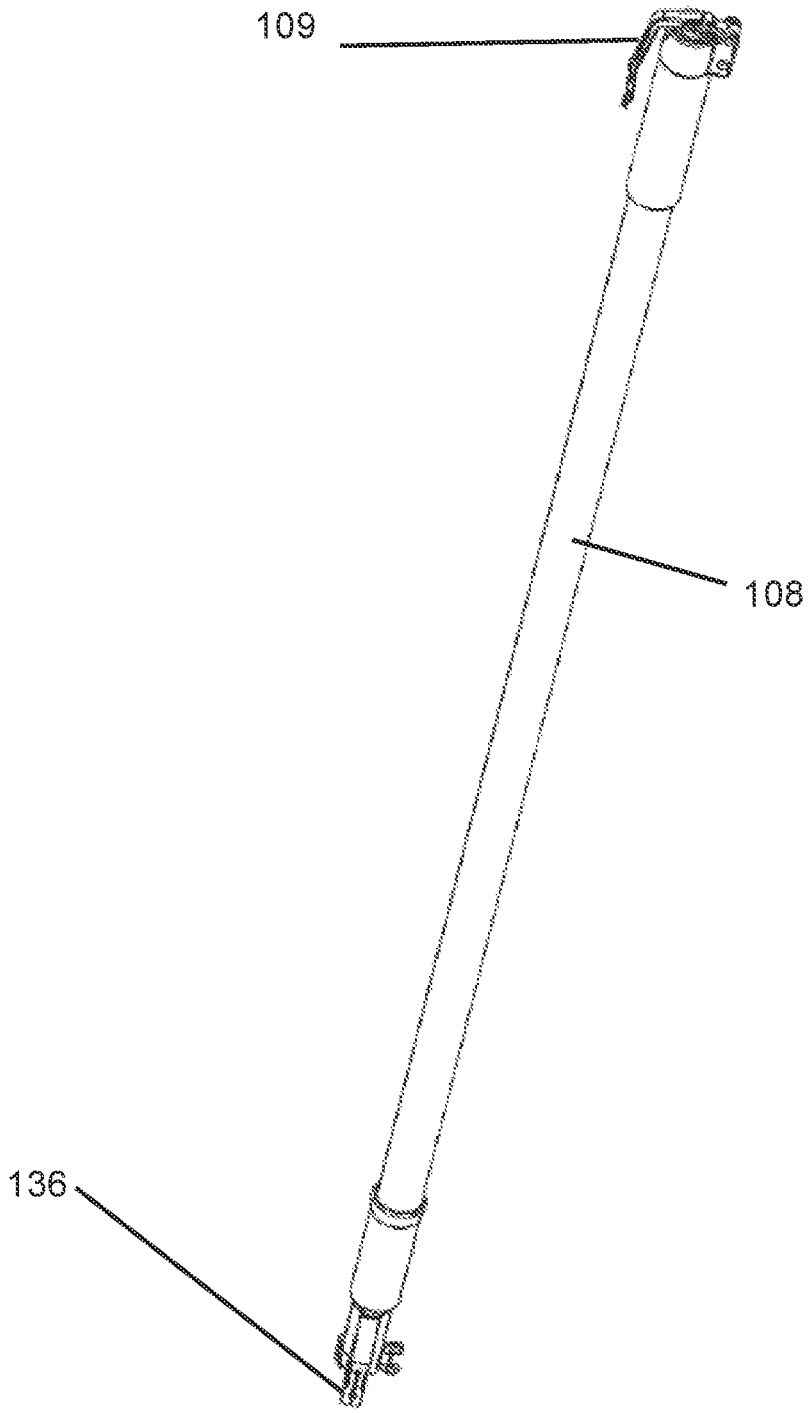
FIG. 34A is a perspective view of a handle of one embodiment of the present invention.
Figure 34B:
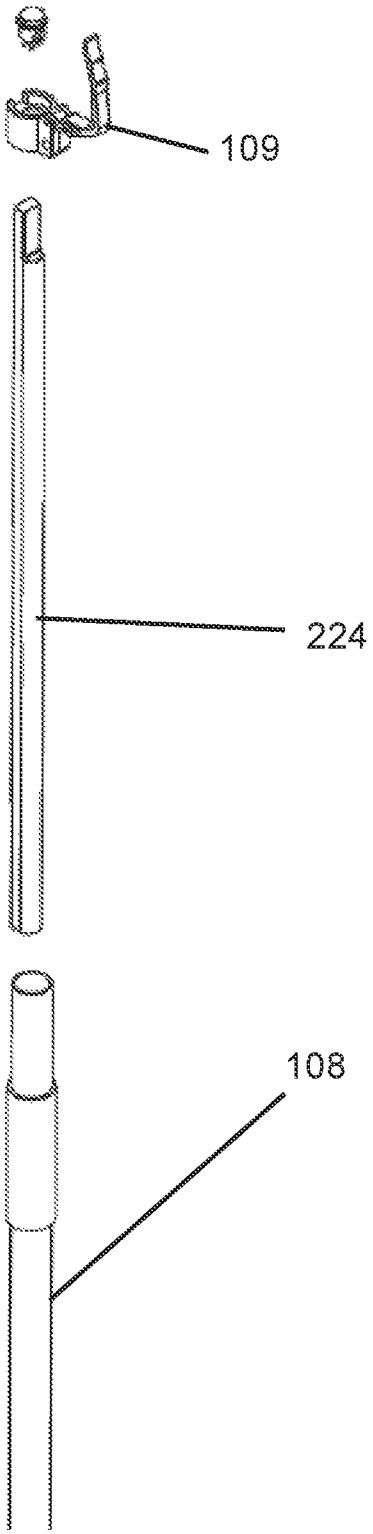
FIG. 34B is an exploded view thereof.
Figure 34C:
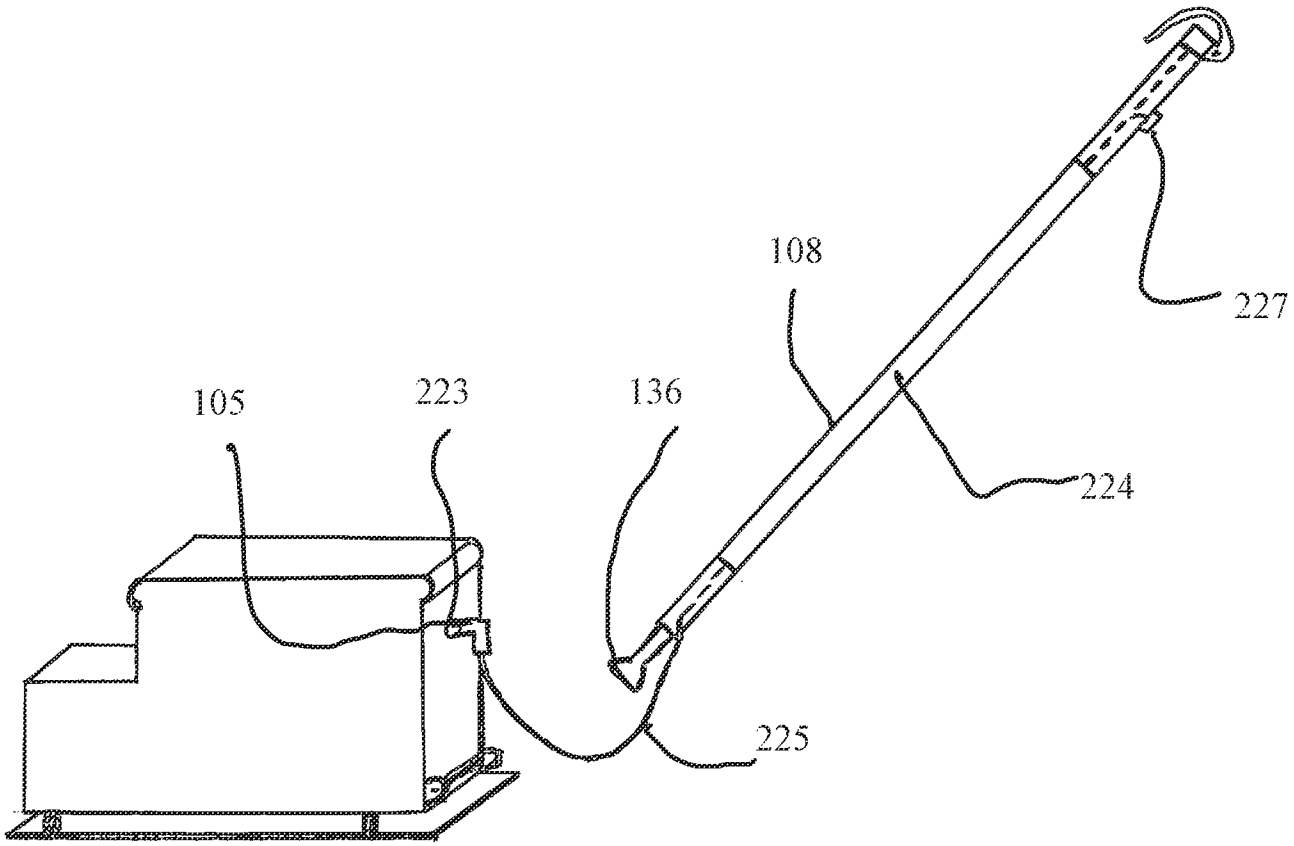
FIG. 34C is a sectional view thereof.
Figure 35:
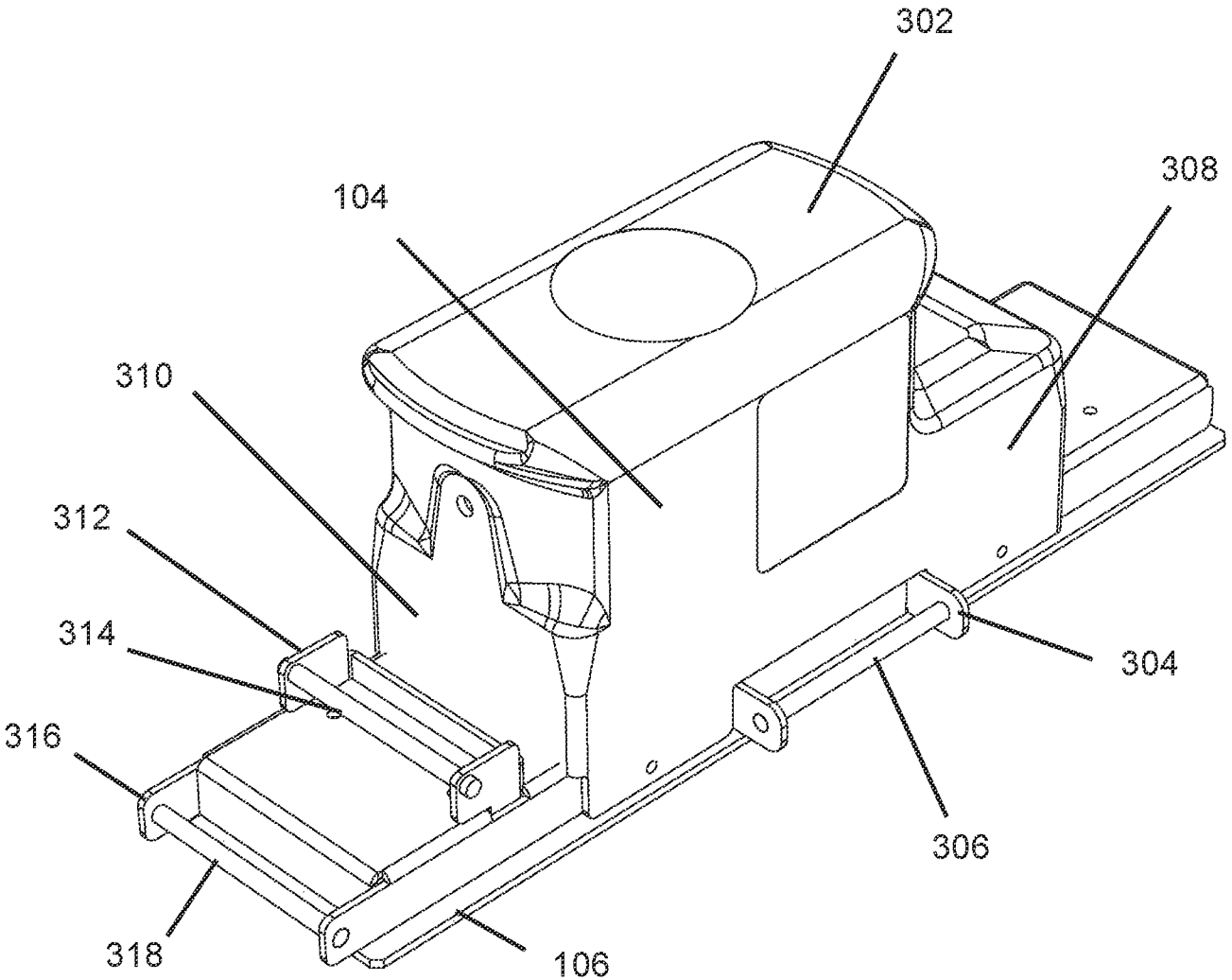
FIG. 35 is a rear perspective view of one embodiment of the present invention.

FIGS. 34A, 34B, and 34C show the handle 108 that attaches to the floor machines. The handle 108 provides an attachment head 136 that secures the handle 108 to the floor machine. The handle 108 provides trigger 109 that activates the motor to treat the floors. The trigger 109 causes rotation of the motor shaft to revolve the driver plate and the treatment attachment for treating the floor.

FIGS. 34B and 34C show power source 224. The power source 224 may include a battery or batteries. Such battery or batteries may include lithium ion batteries. The power source 224 provides electrical power to the motor via powering conductor 225 that electrically connects the power source 224, such as battery (ies), with the motor at power connection 105.

FIGS. 34B and 34C show a power source stored within the handle 108. In one embodiment, the power source is stored within a tubular section of the handle 108. The powering conductor 225 extends laterally outward proximate the end of the handle 108 that attaches to the housing. In one embodiment, the powering conductor 225 extends laterally outward from the tubular section of the handle 108. The charging conductor 227 connects to a charging source that charges the power source 224, such as the battery (ies). The charging conductor 227 is secured to the handle 108 towards the second end of the handle away from the attachment head 136.

The handle 108 and power source 224 detach from the floor machine and attach to the floor machine to provide a detachable power source stored within handle 108. The power connection 105 is located at power location 223 that is distinct from the attachment location of the attachment body at which attachment head 136 connects to the housing. The distinct locations of the power location and the attachment location allows different attachments of the handle with the housing.

To change power sources 224, the user simply applies a different handle, such as a replacement, with a charged power source 224. The user electrically connects the replacement power source 224 to the motor 104 for continued operation. In one embodiment, the user plugs the power source 224 into the power connection 105 of the housing to electrically connect the power source 224 with the motor. In one embodiment, lower electrical connection connects the power source 224 with the motor. The user can then continue operation of the floor machine with the replacement handle while the original handle charges.

The user charges the detached power source within the removed handle for later usage. The user electrically connects the detached power source to a charging source. In one embodiment, the user connects the upper electrical connection to the power source 224. Other embodiments may implement a different configuration of the electrical connections for connecting the power source with the motor and the charging source.

Figure 4:
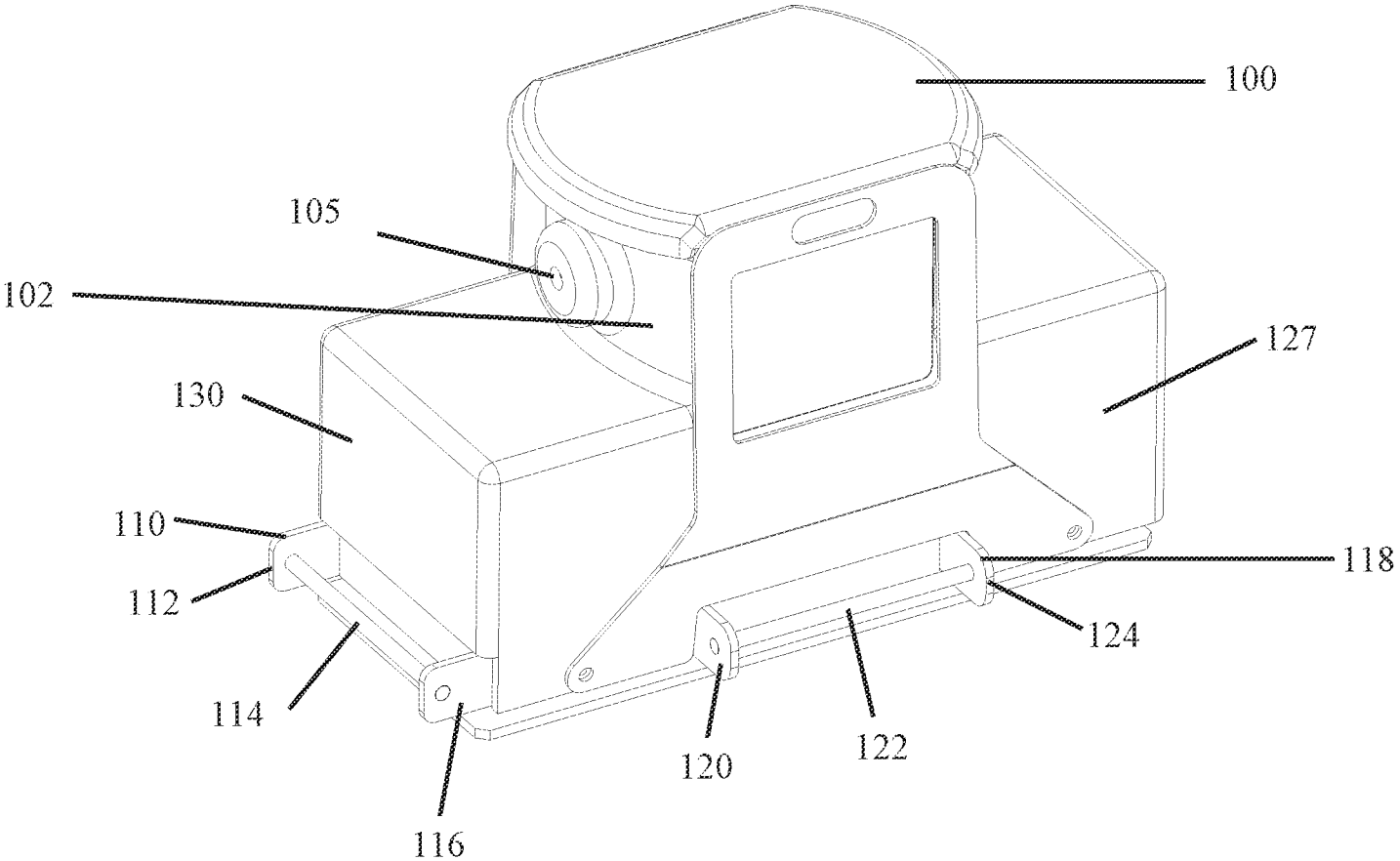
FIG. 4 is a rear perspective view thereof.
Figure 40:
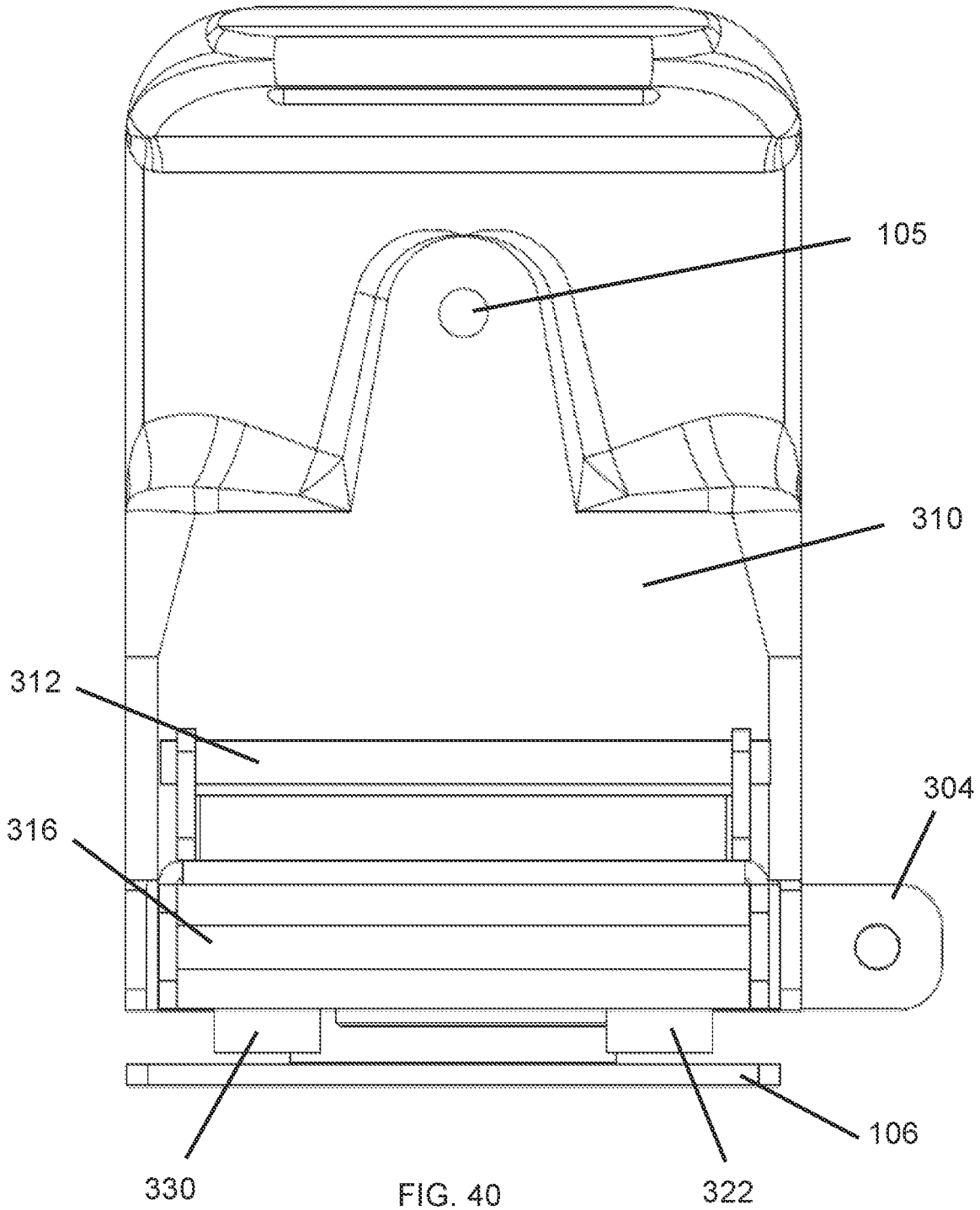
FIG. 40 is a right side view thereof.

The power source 224 can plug into the power connection 105 as shown in FIGS. 4 and 40. Such a power source 224 may use the lower electrical connector, such as the plug, towards the attachment head shown in FIGS. 2A and 2B, to electrically connect the power source 224 to the motor 104. The upper electrical connector, such as the plug, shown at the upper end of handle 108 electrically connects to a charging source that charges power source 224. In one embodiment, the power source 224 provides sufficient power to power the floor machine as if the floor machine was corded.

One embodiment of the floor machines allows for the motor to revolve the eccentric in different directions, such as clockwise and counterclockwise. The motor of the floor machines, such as floor machines 100, 300, 400 taught in the FIGURES can revolve in different directions by changing the rotation of the motor shaft.

Figure 43:
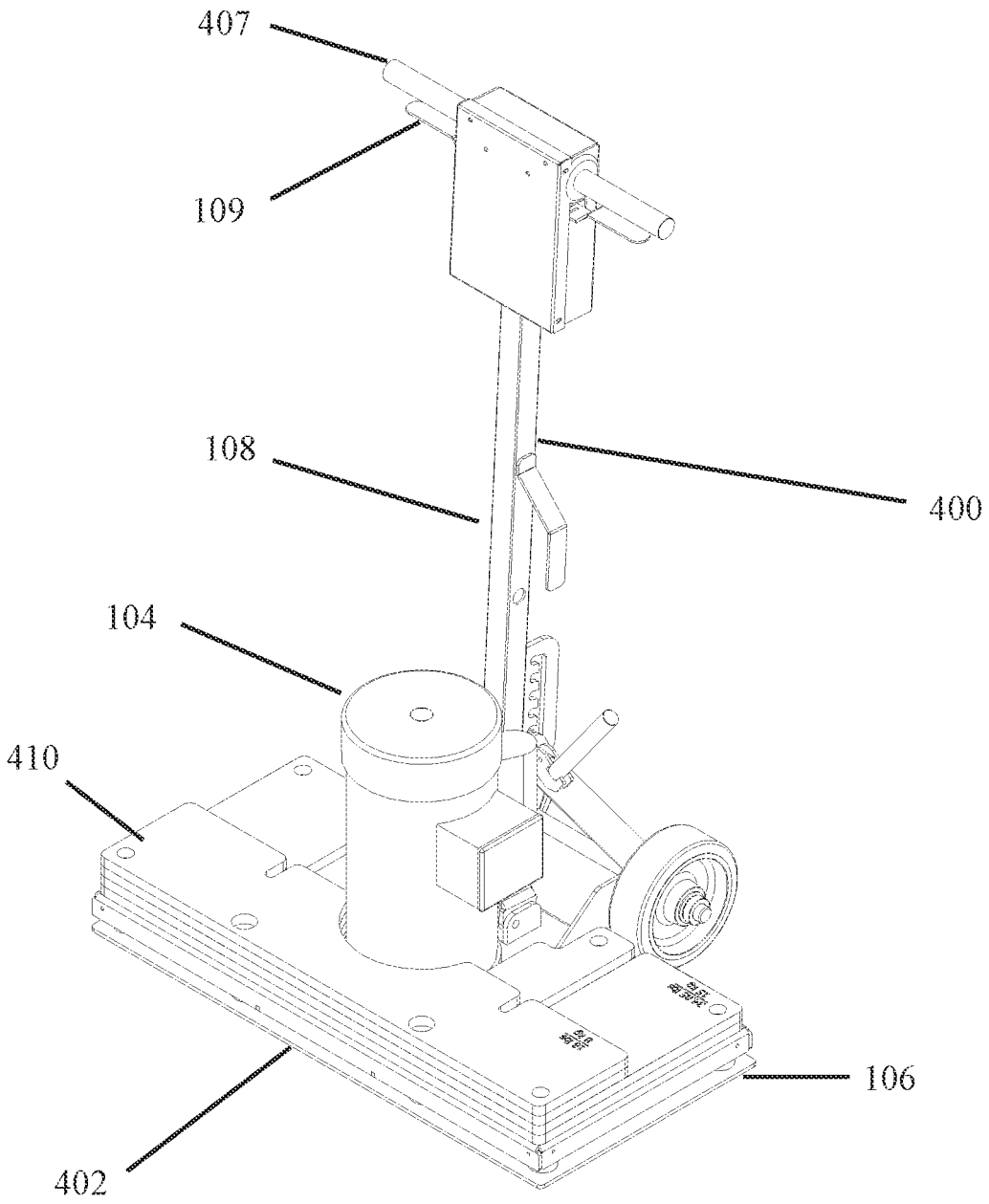
FIG. 43 is a front perspective view thereof.
Figure 44:
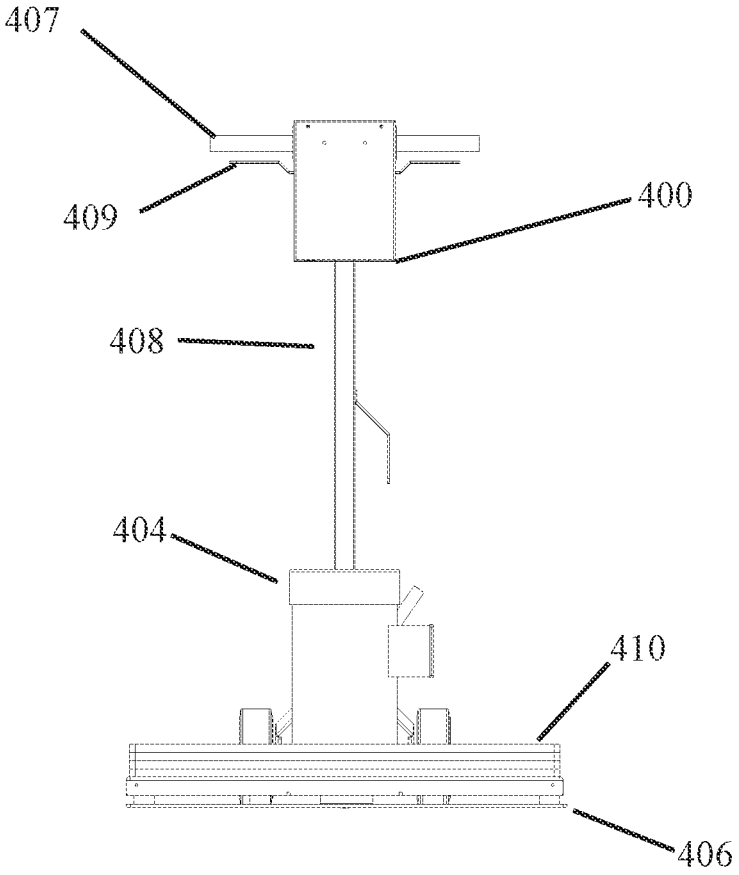
FIG. 44 is a front view thereof.
Figure 45:
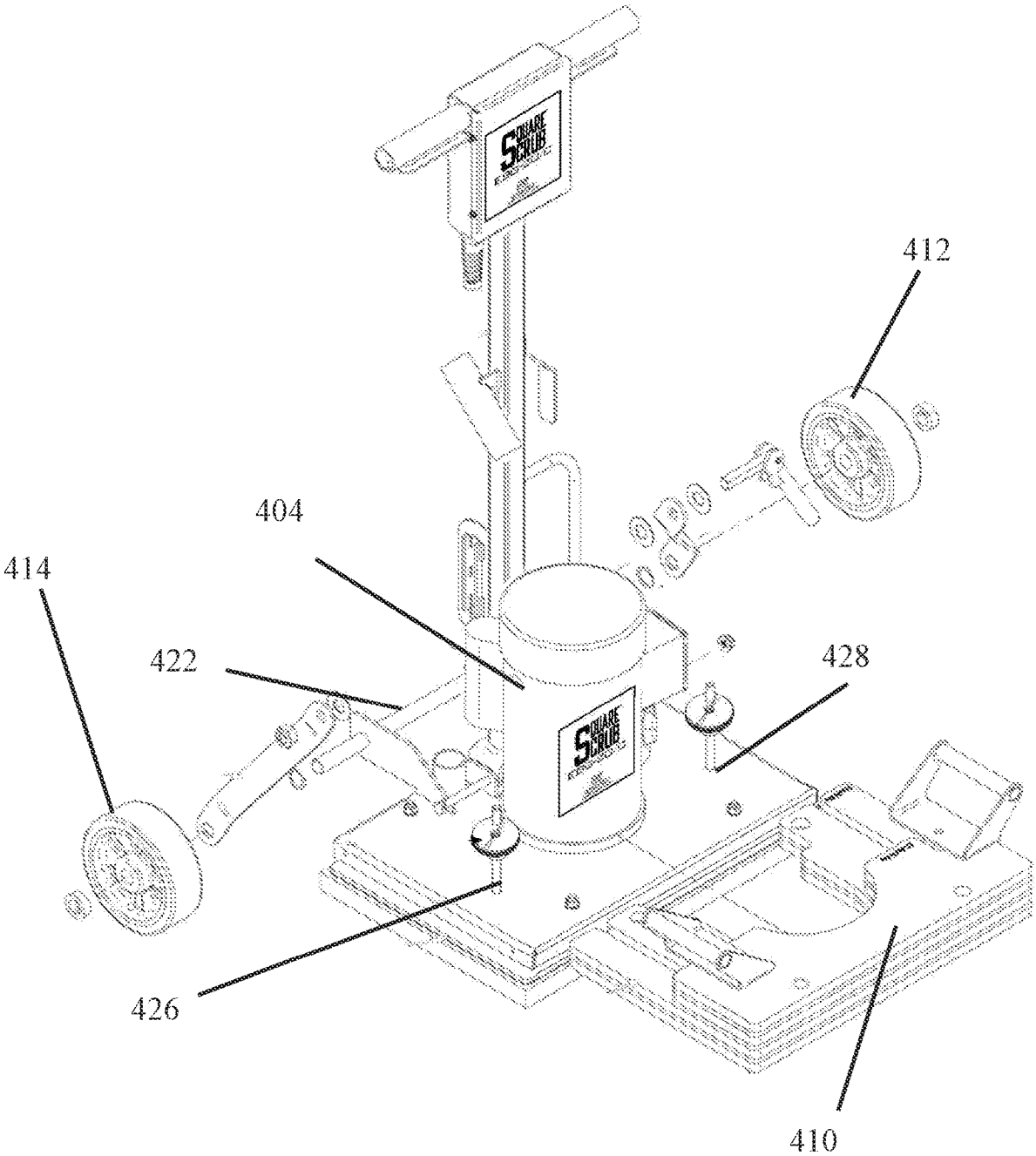
FIG. 45 is an exploded view thereof.
Figure 46:
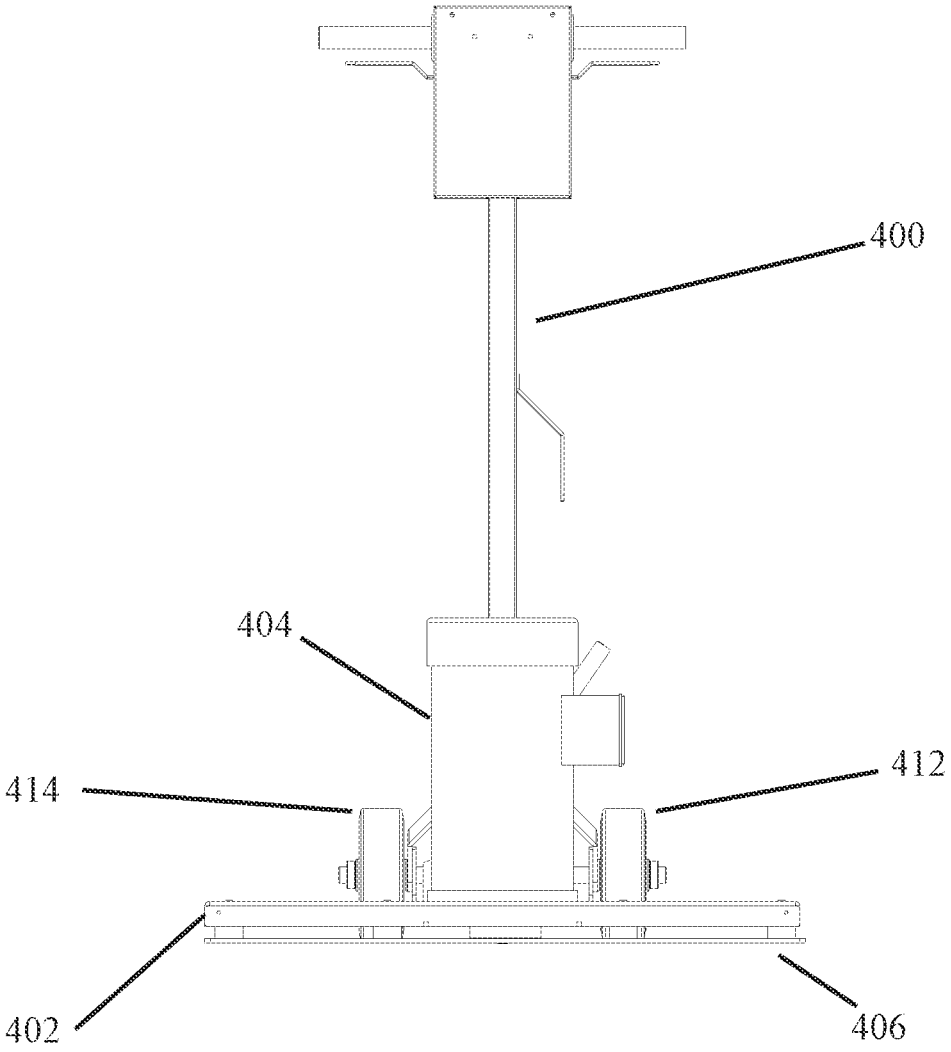
FIG. 46 is a front view thereof.

FIGS. 34A-34B and 43-51 show the handles 108 that secure to floor machines, such as floor machines 100, 300, 400. Handle 108 provides a grip 107, as shown in FIG. 43, and trigger 109 as shown in FIGS. 34A-34B and 43. The user depresses trigger 109 to activate motor 104. The motor 404 revolves driver plate 406 to which a treatment attachment is secured.

Trigger 109 activates the motor 104 to revolve the treatment attachment and driver plate around the motor. Trigger 109 activates the motor to rotate the shaft in a first direction such as clockwise. As long as the user continues to depress the trigger, the motor continues to rotate the shaft in the first direction. The user continues to treat the floor with the treatment attachment secured to the driver plate revolving around the motor in the first direction. The user releases the trigger 109 to stop rotating the shaft in the first direction. The user depresses the trigger 109 to activate the motor again.

In one embodiment, the motor continues to rotate the shaft in the first direction each time the user depresses the trigger 109. In another embodiment, the motor alternates the direction the motor rotates each time the user depresses the trigger 109 or activate the motor 104.

The motor implemented in the floor machine may be an electric motor, such as an AC motor. The AC motor may run in two different directions. The motor may rotate the shaft in two different directions, clockwise and counterclockwise. The rotation of the shaft in two different directions revolves the driver plate and the treatment attachment in two different directions around the motor. Such revolutions can be clockwise or counterclockwise.

In one embodiment, a switch causes the shaft of the motor to rotate in two different directions. The user simply toggles the switch to change the direction that the shaft rotates. The treatment attachment revolves around the motor in two different directions as a result of toggling the switch.

Another embodiment of the floor machine automatically alternates rotation of the motor shaft each time the user depresses trigger 109. The user depresses the trigger 109 to revolve the driver plate and the treatment attachment around the motor in a first direction, such as clockwise. The motor continues to revolve the driver plate and treatment attachment in the first direction as long as the user continues to depress the trigger 109. The user releases the trigger to stop the floor machine.

The user then depresses the trigger 109 again to revolve the driver plate and the treatment attachment around the motor. The motor alternates the direction of rotation to a second direction, such as counterclockwise, to revolve the driver plate and the treatment attachment around the motor in the second direction. The motor continues to revolve the driver plate and the treatment attachment in the second direction as long as the user continues to depress the trigger 109. The user releases the trigger to stop the floor machine. In such an embodiment, the floor machine alternates the direction of revolving the driver plate and the treatment attachment each time the user depresses the trigger 109 or otherwise activates the motor 104.

A motor controller directs the motor to operate in the first direction and the second direction. The motor controller may be a solid state device that automatically alternates the direction of rotation between the first direction and the second direction each time the user depresses trigger 109. The motor controller may be a solid state device that automatically alternates the direction of rotation between the first direction and the second direction each time the motor is activated.

Power cord plugs into a power source that powers the motor 104. The motor 104 revolves the driver plate 106 and the treatment attachment. The floor machine 400 prepares floors and otherwise treats floors. The floor machine recoats, strips, polishes, scrubs, cleans, removes floor finish, repairs flooring, sands, and accomplishes other floor needs.

FIGS. 35-42 show another embodiment of floor machine 300 with multiple attachment bodies 304, 312, 316 and attachment necks 306, 314, 318 similar to the attachment bodies with attachment shoulders and attachment necks described above. Attachment bodies 304, 312, 316 secured to the housing 302 enable attachment of the handle to the housing 302. The motor 104 within the housing 302 revolves the driver plate 106 for treating the floor.

The housing 302 provides multiple attachment bodies 304, 312, 316 to adjust the orientation of the housing with the handle. Adjusting the orientation enables the floor machine 300 to reach different areas. Adjusting the orientation also changes the width of the housing in the relation to the handle to alter the width of the area being treated by the user.

To increase the width of the treatment area, the user attaches the handle 108 to attachment body 304 at rear side 308. To narrow the width of the treatment area, the user attaches the handle 108 one of attachment bodies 312, 316 on side 310. Side 310 provides a smaller width than side 308 to change the configuration of the handle 108 in relation to the preparation body 106. Attachment bodies 312, 316 provide different attachment points to alter the usage of the floor machine 300.

Figure 36:
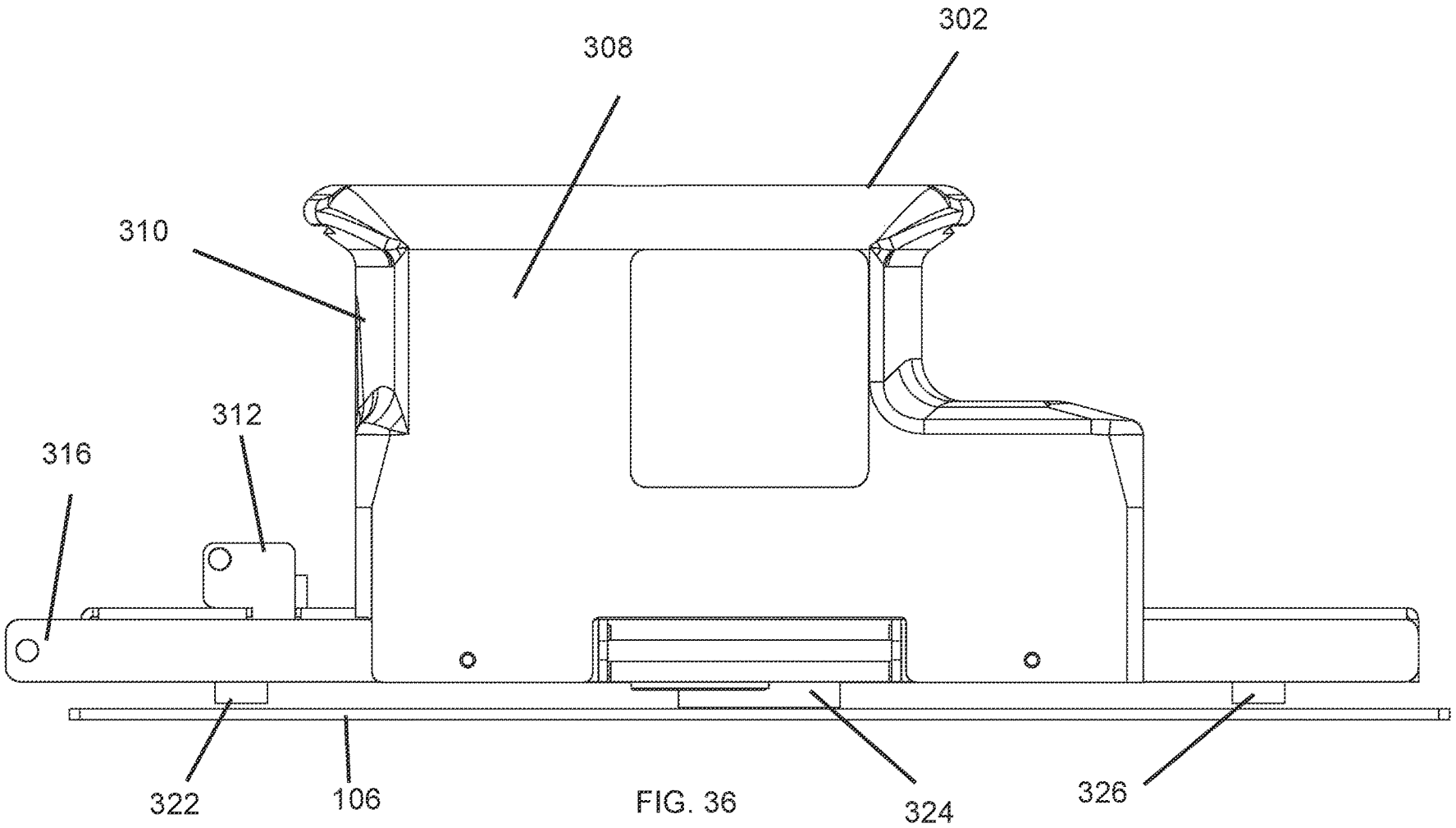
FIG. 36 is a rear view thereof.
Figure 37:
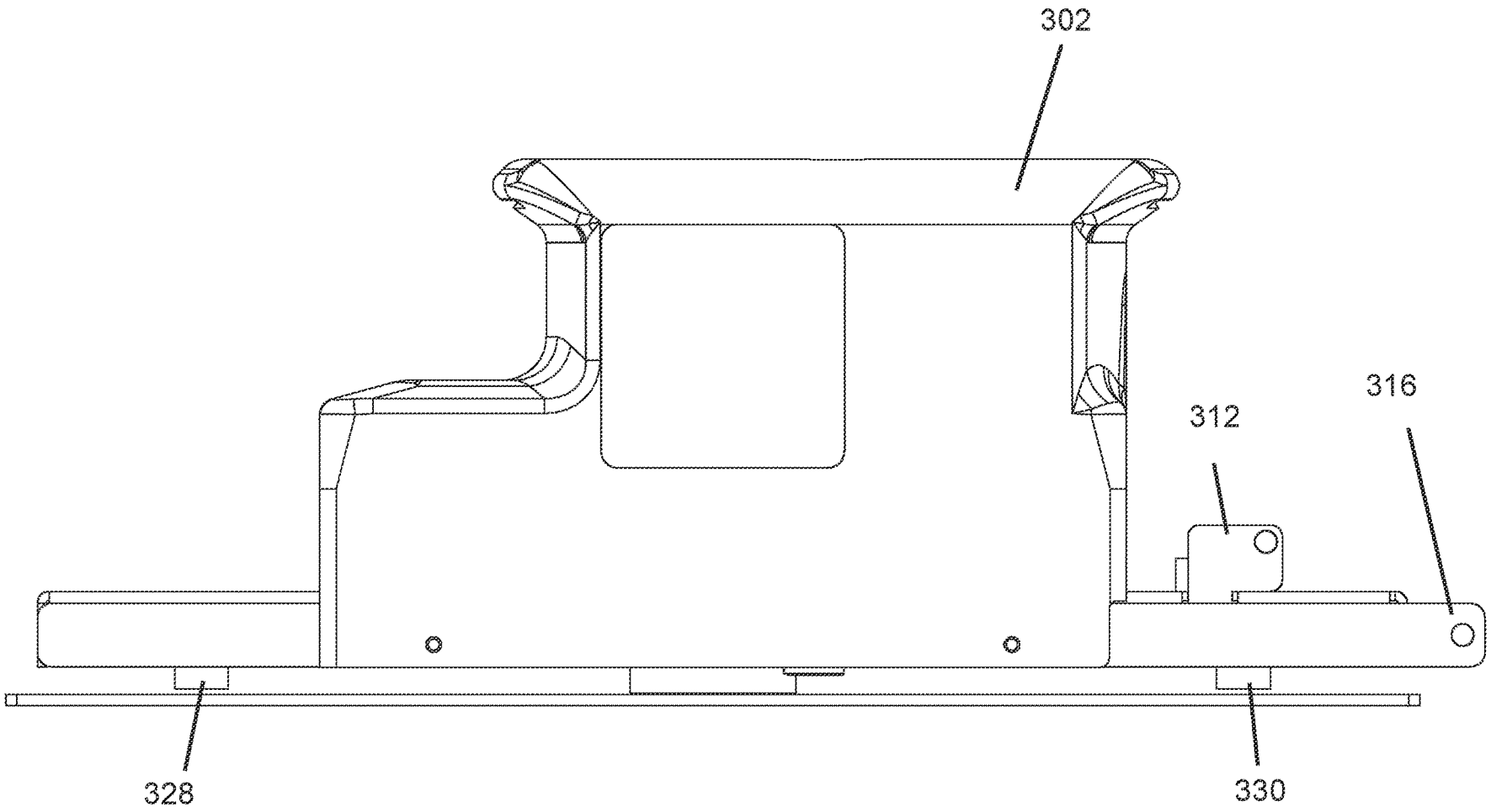
FIG. 37 is a front view thereof.

FIG. 36 shows the attachment body 304 on side 308 of housing 302. The attachment body 304 of one embodiment is aligned with the eccentric 324. The eccentric 324 secures to the driver plate 106 to which the treatment attachment attaches for treating the floor.

Referring to FIGS. 36-39, the isolator bodies 322, 326, 328, 330 function similar to the isolator bodies shown above and described below. The isolator bodies 322, 326, 328, 330 are a wear item to be replaced for maintenance of the machine. The isolator bodies 322, 326, 328, 330 provide shock absorption, noise reduction, and control of the motor 104 to prevent the machine from pulling to one side.

Figure 38:
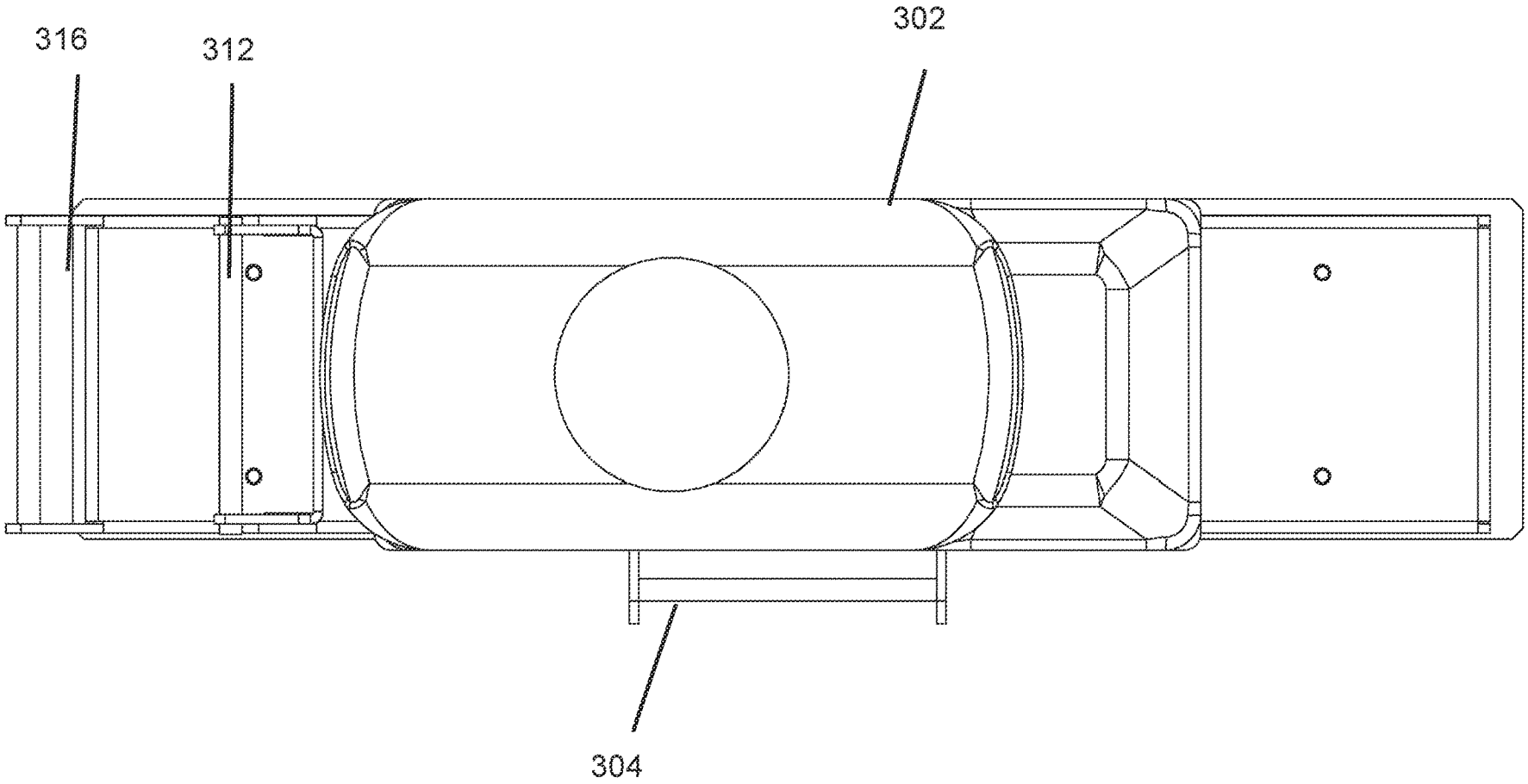
FIG. 38 is a top view thereof.
Figure 39:
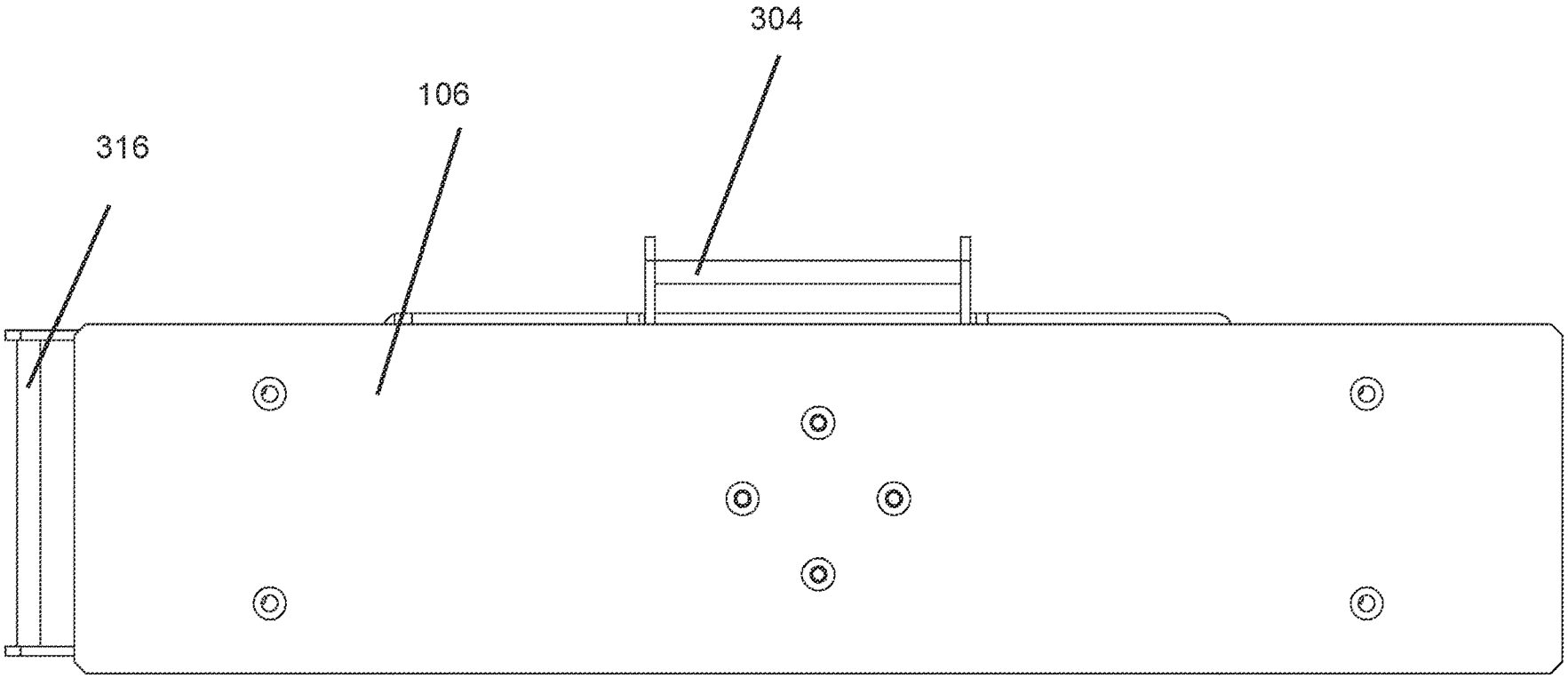
FIG. 39 is a bottom view thereof.

FIGS. 38-40 show the attachment bodies 312, 316 aligned with the eccentric 324. Outer attachment body 316 is positioned laterally outward from the driver plate 106 such that attachment body 316 is not positioned directly above the driver plate 106. Attachment body 312 is positioned laterally interior of the outer attachment body 316. Attachment body 312 is positioned directly above driver plate 106.

FIG. 40 shows that attachment body 312 is positioned vertically above attachment body 316 to alter the orientation of the handle with the housing 302. Attachment body 316 is positioned at or near the vertical height of attachment body 304 wherein the attachment necks of attachment bodies 304, 316 are on the same plane.

The power source plugs into power connection 105 for powering the motor within the housing. The power source may be a corded plug into an electrical outlet or a portable power source such as a battery or batteries.

Figure 41:
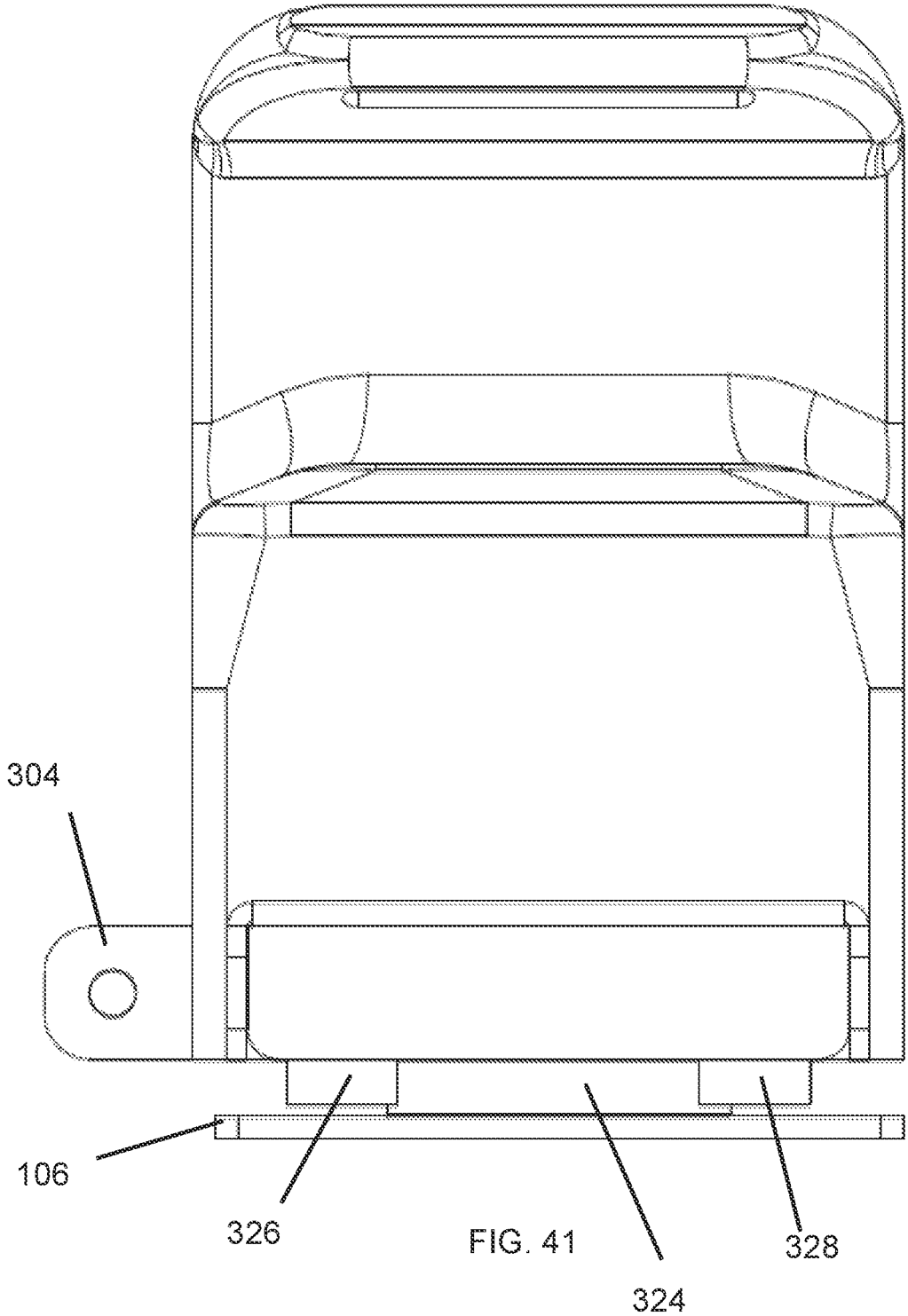
FIG. 41 is a left side view thereof.

FIGS. 40-41 show the relationship of the isolator bodies 322, 326, 328, 330 with the driver plate 106. The isolator bodies 322, 326, 328, 330 provide some vertical space between the housing 302 and the driver plate 106. The isolator bodies 322, 326, 328, 330 are positioned between the housing 302 and the driver plate 106. The isolator bodies 322, 326, 328, 330 are positioned above the driver plate 106 such that the isolator bodies 322, 326, 328, 330 do not contact the driver plate 106.

Figure 42:
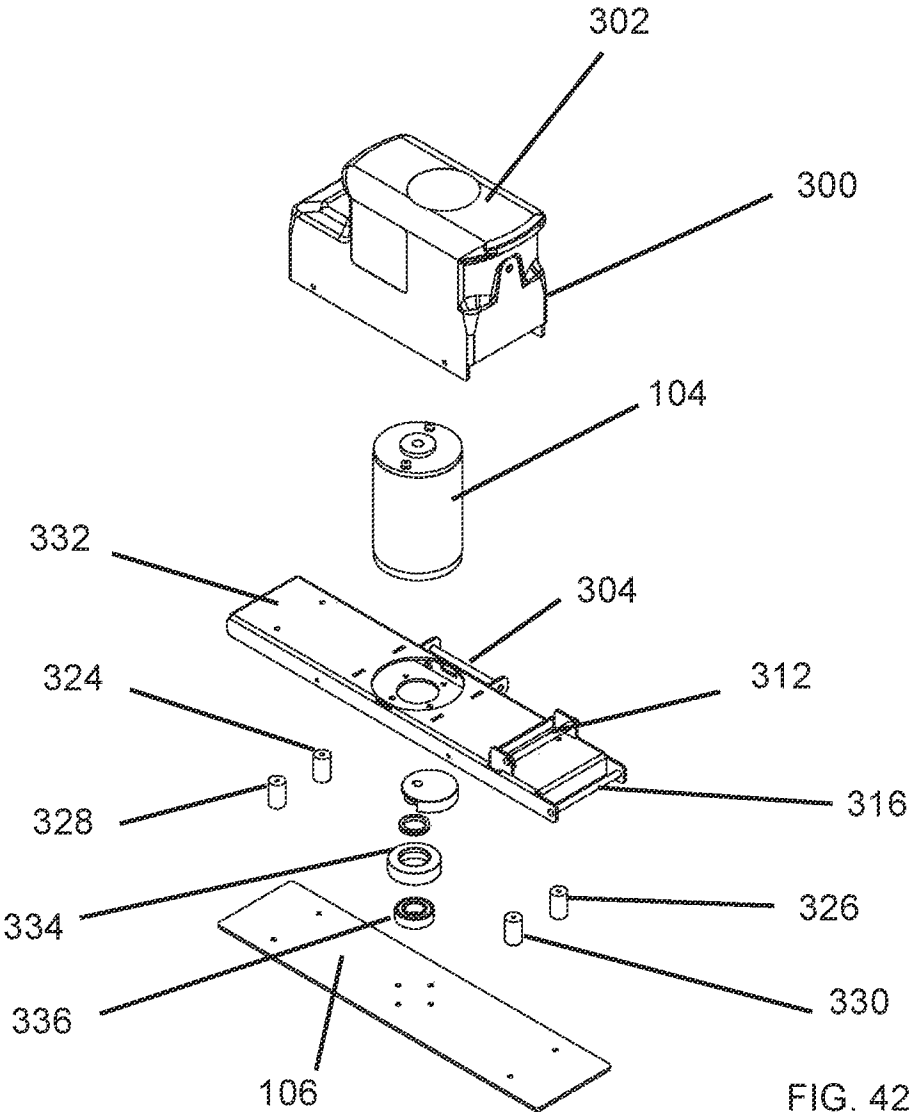
FIG. 42 is an exploded view thereof.

FIG. 42 shows an exploded view of the floor machine 300. Eccentric 324 attaches to the shaft of motor 104. A treatment attachment similar to treatment attachment 434 shown in FIG. 56 secures to an attachment surface, a bottom surface, of driver plate 106. The eccentric 324 revolves the driver plate 106 around the shaft of motor 104. The motor 104 of one embodiment revolves the eccentric in a first direction and a second direction, such as clockwise and counterclockwise.

The treatment attachment secures to the housing 302 and driver plate 106 for contacting the floor. Different types of treatment attachments attach to the housing 302 and driver plate 106 depending on the floor surface and the task to be completed. Examples of treatment attachments may include an SQP pad, an SHO pad, a microfiber pad, a wet pad, a tile and grout wet pad, a scrubber, a scrub brush, a tile and grout brush, a carpet cleaning pad, a sandscreen, sandpaper, an abrader plate, stone polishing pads, vacuum braised diamond, resin diamonds, polypads, polishing pads, tooltip diamonds, a sponge, and an enhancer pad, as well as other floor treatment materials. The treatment attachment secures to the driver plate 106.

Frame 332 secures to the housing 302 and the driver plate 106. The frame 332 provides attachment bodies 304, 326, 330.

In one embodiment, the eccentric 324 offsets the attachment of the driver plate 106 and treatment attachment 434 one half inch (½ inch) from the shaft of the motor 104. The half inch offset revolves the treatment attachment in a circular pathway with a radius of the offset of a half inch.

In another embodiment, the eccentric 430 offsets the attachment of the driver plate 106 and treatment attachment 434 one quarter inch (¼ inch) from the shaft of the motor 104. The half inch offset revolves the treatment attachment in a circular pathway with a radius of the offset of a quarter inch.

In another embodiment, the eccentric 430 offsets the attachment of the driver plate 106 and treatment attachment 434 one eighth inch (⅛ inch) from the shaft of the motor 104. The half inch offset revolves the treatment attachment in a circular pathway with a radius of the offset of an eighth inch.

The eccentric 430 of one embodiment offsets the driver plate 106 and treatment attachment ranging from one eighth of an inch (⅛ inch) to one and half inches (1½ inches) from the shaft of the motor 104. The offset revolves the treatment attachment in a circular pathway with a radius ranging from ⅛ of an inch to one and a half inches.

FIG. 42 also shows the isolator bodies 322, 326, 328, 330 as described above that provide shock absorption, noise reduction, and control of the motor 104 to prevent the machine from pulling to one side.

Bearings 336 positioned within bearing cup 334 allow revolving the driver plate 106 by the eccentric 324. The bearing cup 334 seals the bearing 336 to extend the life of the bearings 336.

Referring to FIG. 43, the floor machine 400 provides a handle 108 attached to a motor 104 and frame 402. A floor treatment attachment attaches to the driver plate 106 of the frame 102 for treatment of the flooring. The treatment attachment varies according to the desired task to be accomplished by the floor machine 400. The shaft of the motor 104 attaches to an eccentric to an offset position to revolve the treatment attachment around the offset attachment. The motor 104 revolves the treatment attachment to complete the desired task on the floor. Such offset attachment appears to vibrate the treatment attachment. In another embodiment, the motor 104 vibrates the treatment attachment.

The treatment attachment secures to the frame 402 for contacting the floor. Different types of treatment attachments may attach to the frame depending on the floor surface and the task to be completed. Examples of treatment attachments may include an SQP pad, an SHO pad, a microfiber pad, a wet pad, a tile and grout wet pad, a scrubber, a scrub brush, a tile and grout brush, a carpet cleaning pad, a sandscreen, sandpaper, an abrader plate, stone polishing pads, vacuum braised diamond, resin diamonds, polypads, polishing pads, tooltip diamonds, a sponge, and an enhancer pad, as well as other floor treatment materials. The treatment attachment secures to the driver plate 106.

FIGS. 43-46 show the ability to increase the weight of the floor machine 400. The user may add weights 410, such as slotted weights, to the floor machine 400 to increase the weight of the floor machine 400. The increased weight enables the floor machine 400 to treat floors differently. The weight retention fingers 426, 428, such as bolts with nuts, secure the weights 410 to the floor machine 400.

Different weights may be added or removed to treat different floor types. The weights may also be added or removed for the different treatments of the floors. The user secures the weights 410 with the retention fingers 426, 428. Slots of the weights 410 insert onto the retention fingers 426, 428. The user tightens the retention fingers 426, 428 to secure the weights 410. The user installs different configurations of the weights for treating the floors.

FIGS. 45 and 49-51 show wheels 412, 414 with axle 422. The user can apply force to axle 422 via the user's foot to place the device on the wheels 412, 414 for transportation. The axle 422 also serves as the axle for the wheels 412, 414.

Figure 47:
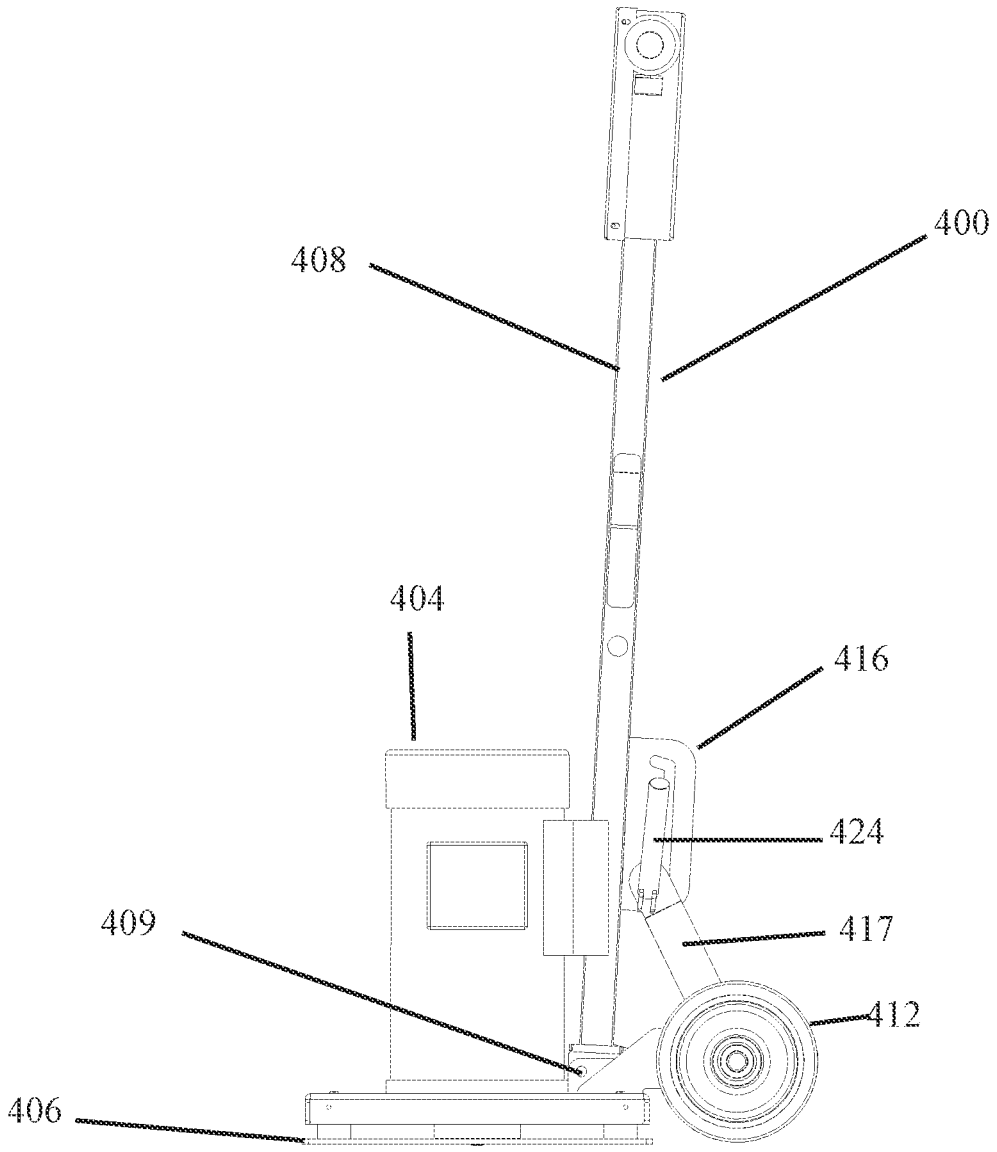
FIG. 47 is a right side view thereof.
Figure 48:
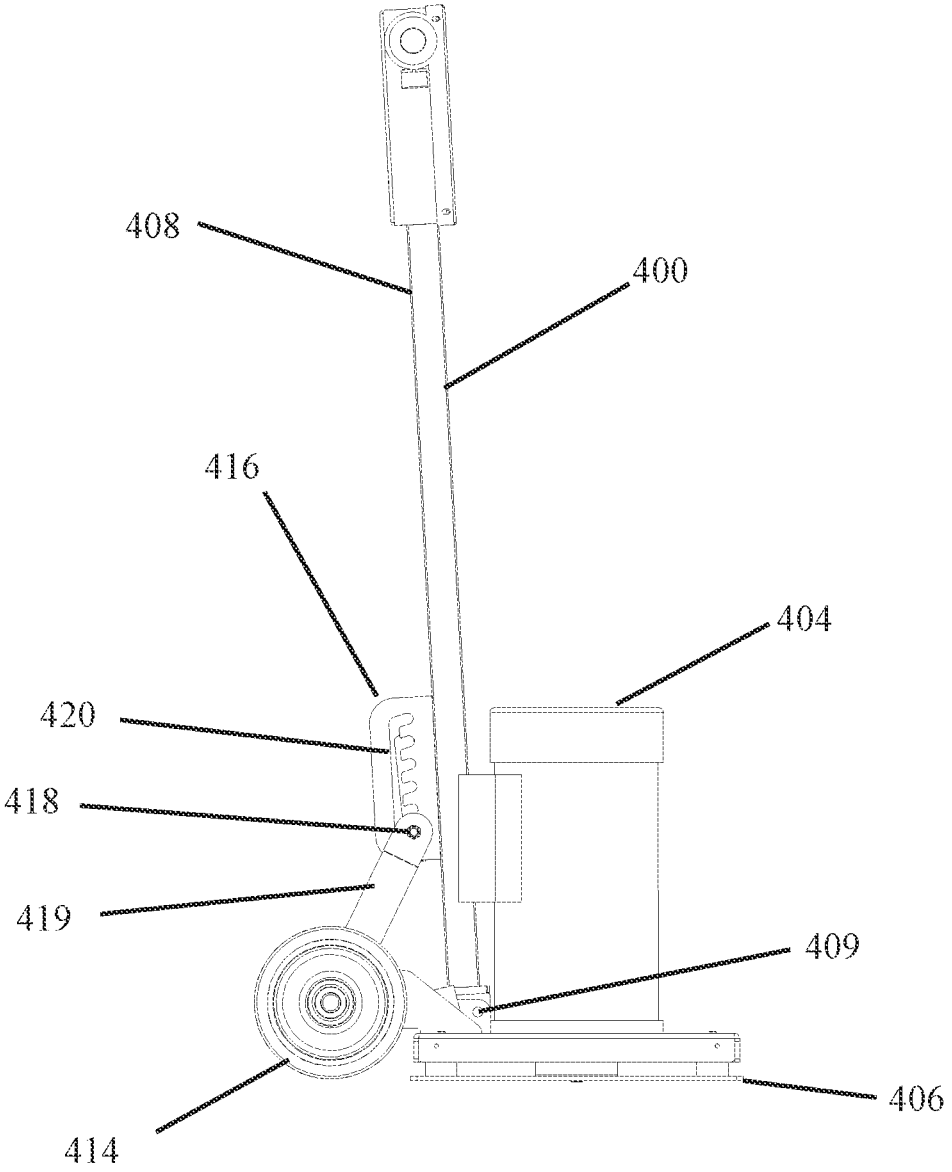
FIG. 48 is a left side view thereof.

FIGS. 47 and 48 show adjustment body 416 to which support legs 417, 419 attach. Adjustment finger 418, such as a bolt, secures the support legs 417, 419 to the adjustment body 416. The adjustment finger 418 travels along track 420 of the adjustment body 416. Placement of the adjustment finger 418 throughout the track 420 adjusts the height of the handle 108.

Handle 108 attaches to the frame at pivot 409. The pivotal attachment of the handle 108 to the frame adjusts the height of the handle 108. Pivot 409 secures the handle 108 to the frame. Pivoting handle 108 away from the motor 104 lowers the handle for the user. Likewise, pivoting handle 108 towards the motor 104 raises the handle for the user. Moving the adjustment finger 418 up the track 420 lowers the handle 108. Moving the adjustment finger 418 down the track 420 raises the handle 108.

Figure 49:
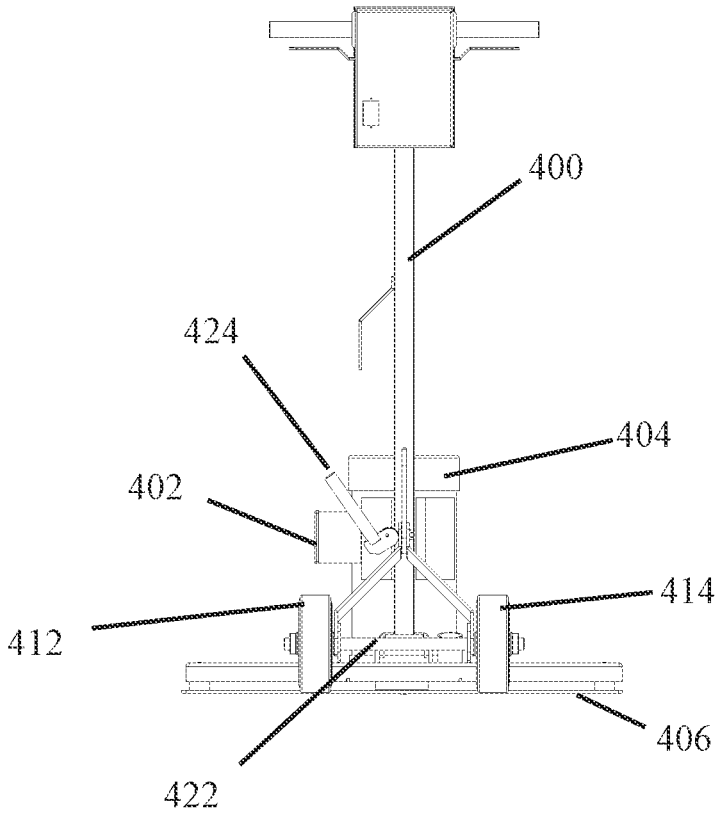
FIG. 49 is a rear view thereof.

FIG. 49 shows the rear view of the floor machine 400. The user adjusts the positioning of the adjustment finger 418 through track 420 with handle 424. Axle 422 secured to wheels 412, 414 simplifies transporting the floor machine. The user raises the treatment attachment secured to driver plate 106 off of the floor for transporting the floor machine 400.

Figure 50:
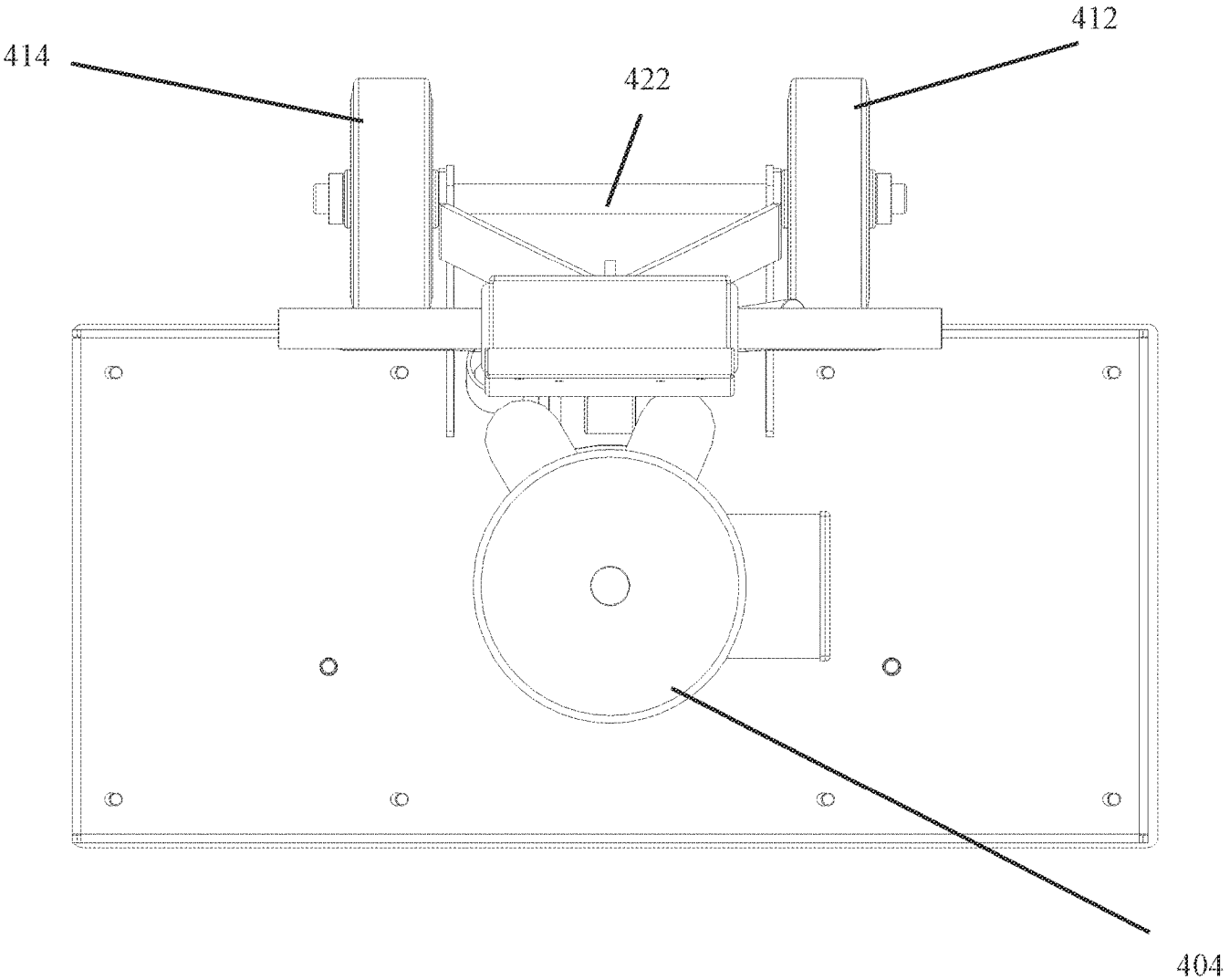
FIG. 50 is a bottom view thereof.

FIG. 50 shows a top view of the motor 104. Wheels 412, 414 secured to the axle 422 simplify transporting the motor 104 as shown in FIGS. 50 and 51.

Figure 51:
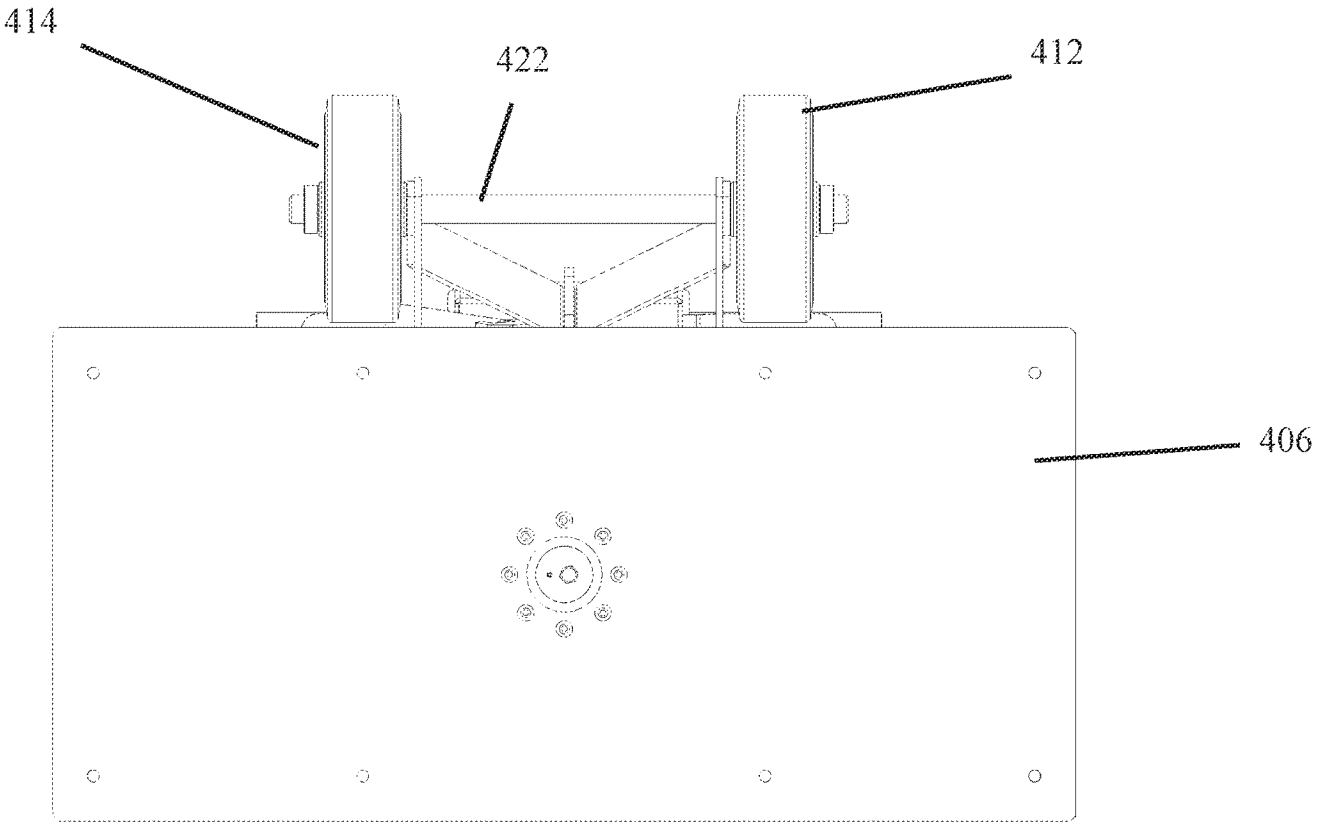
FIG. 51 is a bottom view thereof.

FIG. 51 shows a bottom view of the driver plate 106. Driver plate 106 provides a bottom gripping surface. The gripping surface may be constructed from felt, hook and loop fasteners, protrusions, grips, anchors, etc. The bottom gripping surface of driver plate 106 provides a surface to which the treatment attachment attaches. The bottom gripping surface is located on the bottom of the driver plate 106 and secures the treatment attachment to the frame 402 and the floor machine 400.

The attachment surface, such as the bottom gripping surface, of the driver plate 106 provides gripping feet 434. The gripping feet provide protrusions extending vertically downward from the gripping surface of driver plate 106 to secure a treatment attachment to the gripping surface.

Figure 52:
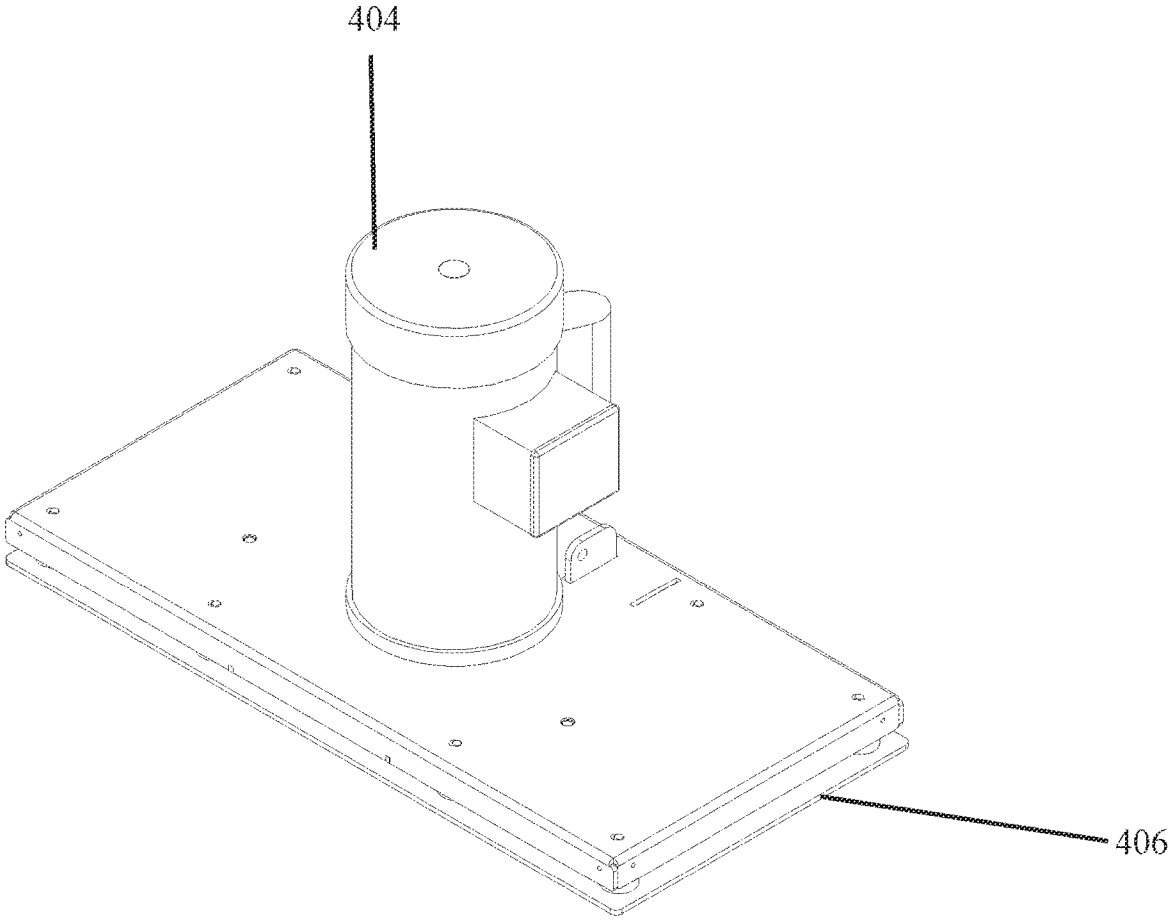
FIG. 52 is a partial perspective view thereof.

FIG. 52 shows a perspective view of the motor 104 and the driver plate 106. The driver plate 106 revolves around the motor 104.

Figure 53:
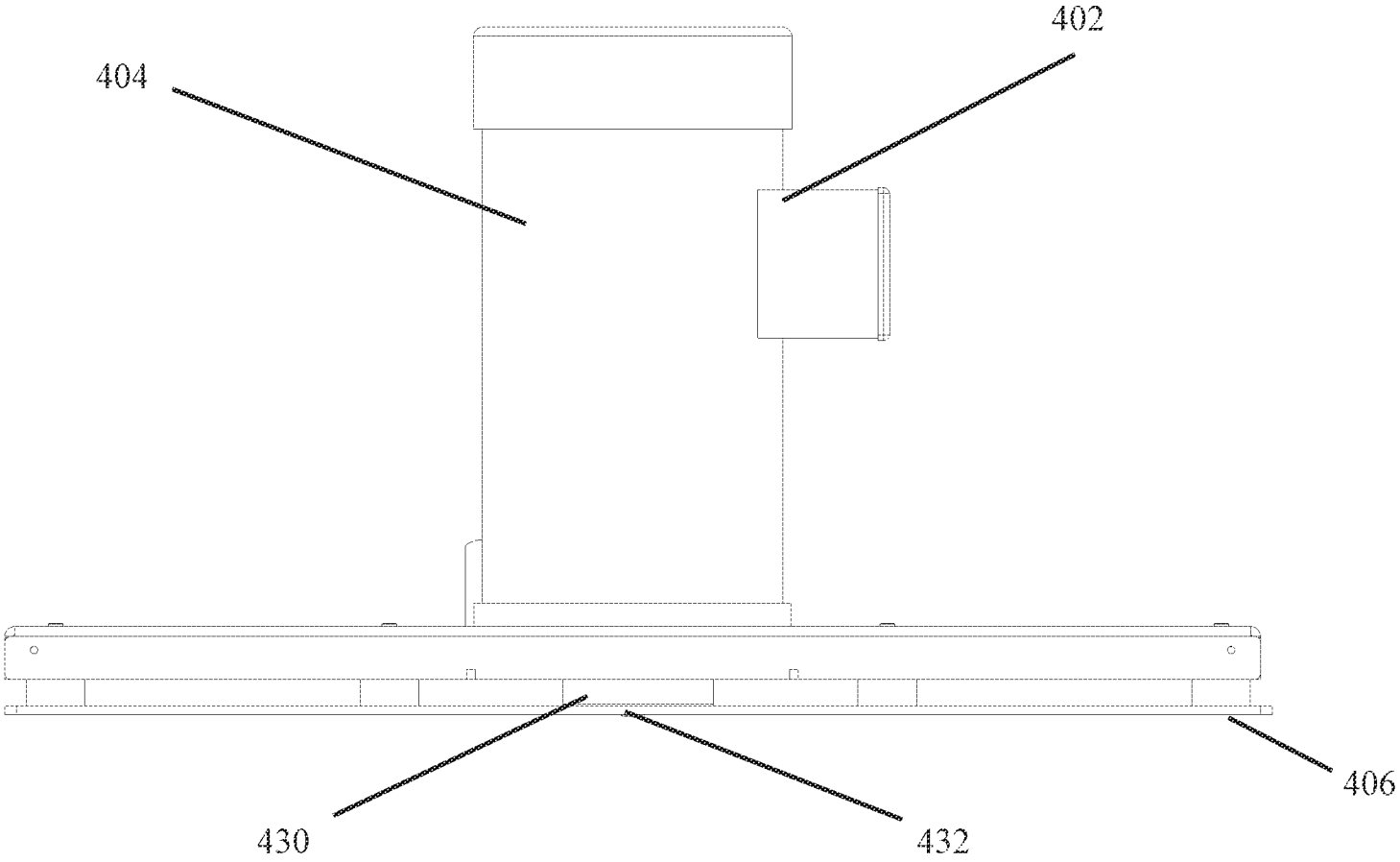
FIG. 53 is a partial front view thereof.
Figure 54:
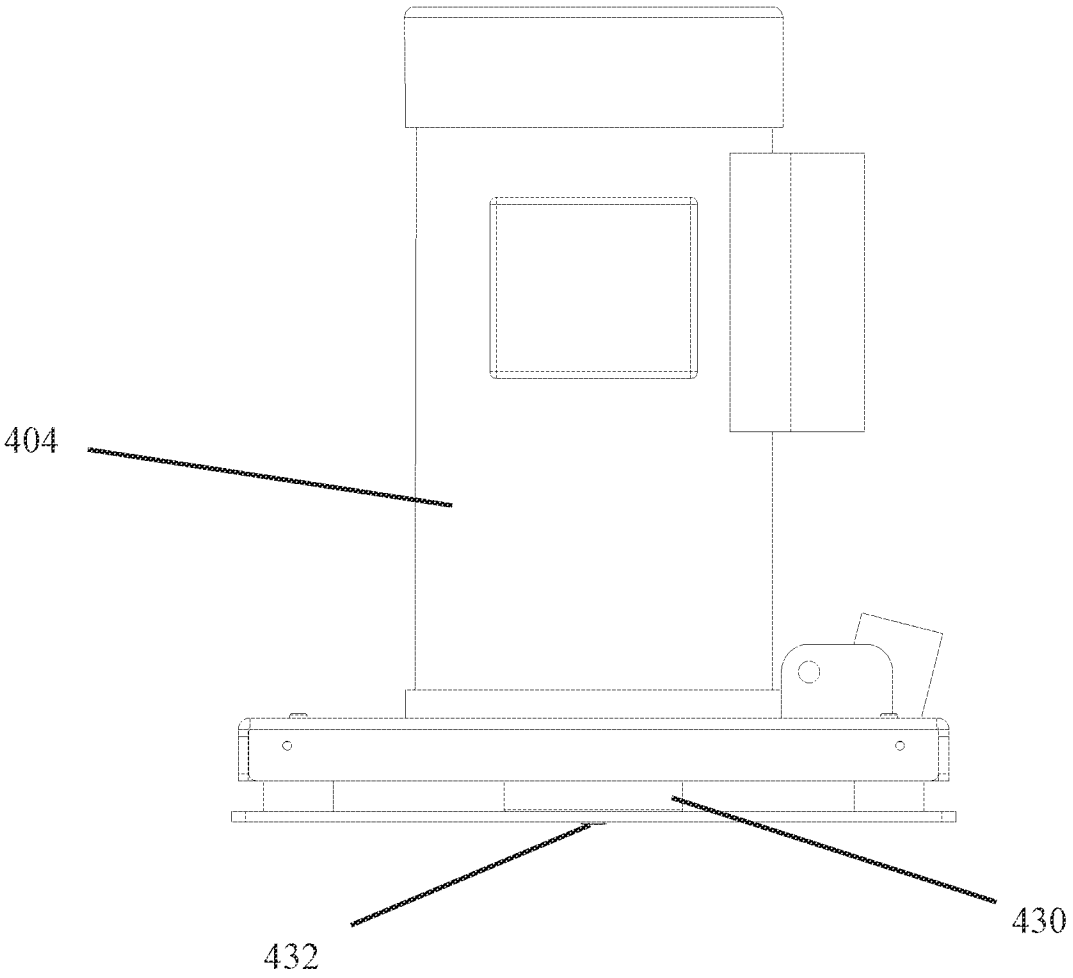
FIG. 54 is a right side view thereof.
Figure 55:
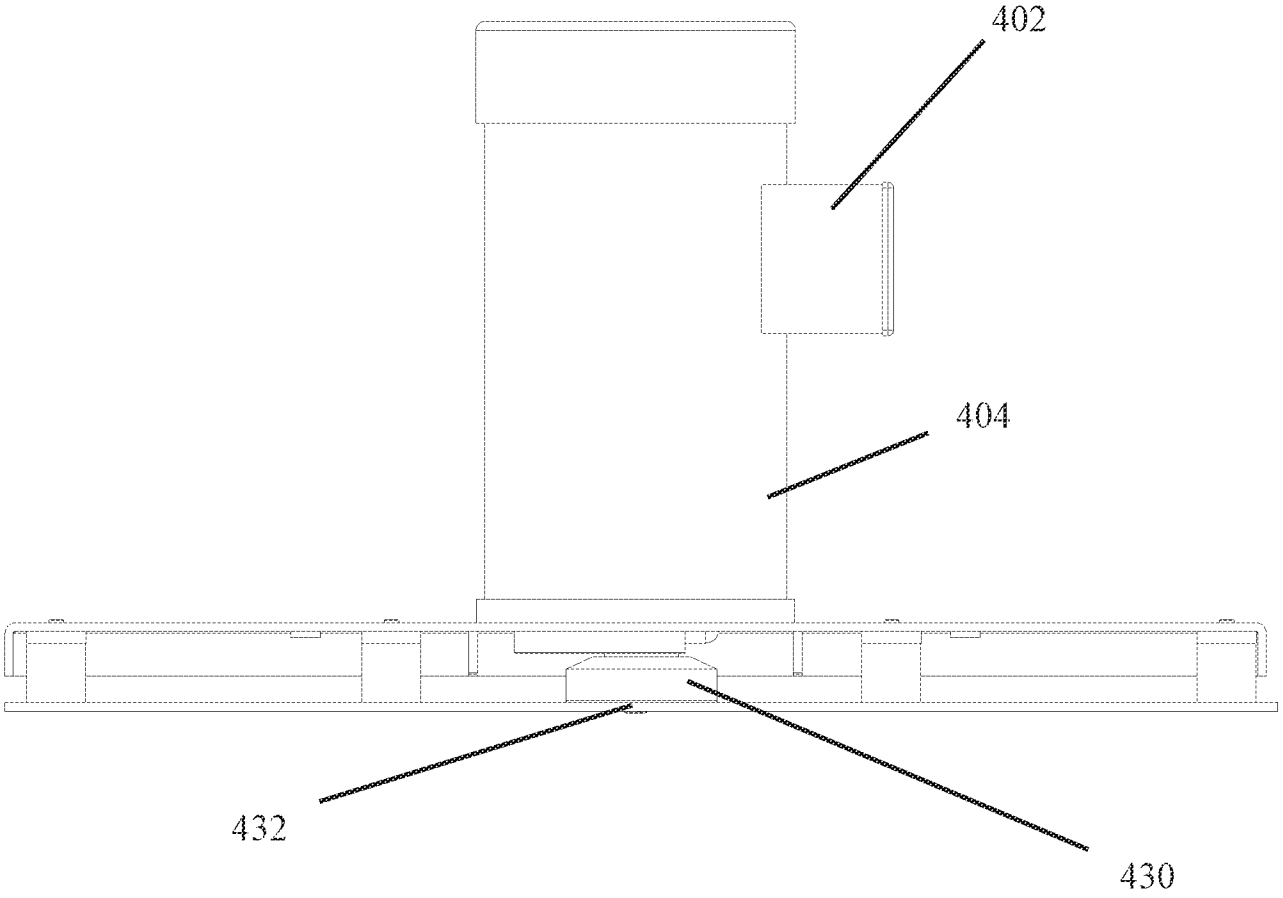
FIG. 55 is a front view thereof.

FIGS. 53-55 show the eccentric 430 secured to motor 104. Fastener 432 secures the driver plate 106 to the eccentric 430. Eccentric 430 offsets the driver plate 106 from the motor 104. The offset revolves the driver plate 106 around the motor 104. Such offset revolves the treatment attachment for treating the floor.

Figure 56:
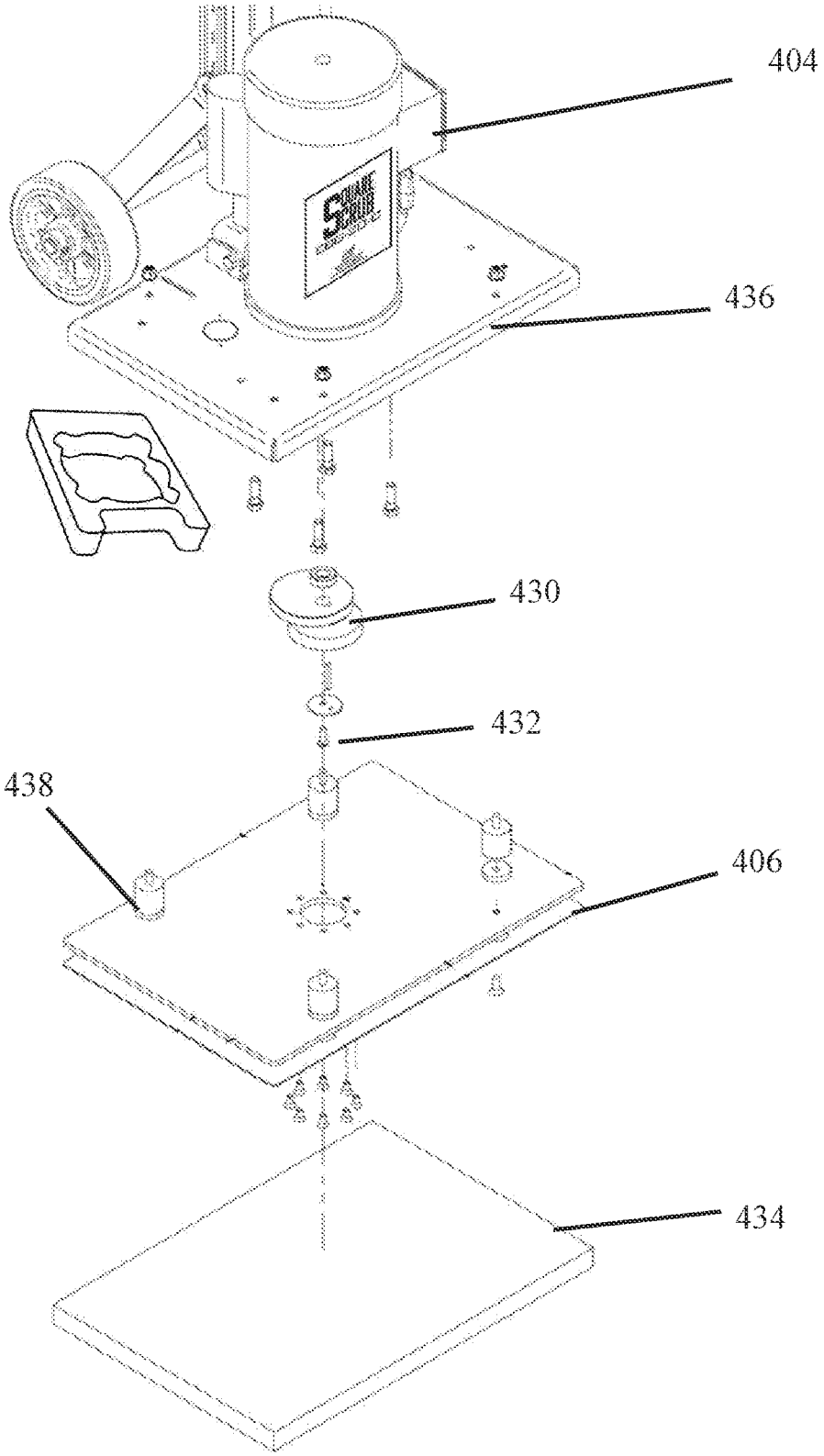
FIG. 56 is an exploded view thereof.

FIG. 56 shows an exploded view of the offset attachment. Eccentric 430 attaches to the shaft of motor 104. Fastener 432 secures the driver plate to the eccentric 430. Treatment attachment 434 secures to the bottom surface of driver plate 106. The eccentric 430 revolves the driver plate 106 around the shaft of motor 104. The motor 104 of one embodiment revolves the eccentric in a first direction and a second direction, such as clockwise and counterclockwise.

Treatment attachment 434 secures to the frame and driver plate 106 for contacting the floor. Different types of treatment attachments 434 attach to the frame and driver plate 106 depending on the floor surface and the task to be completed. Examples of treatment attachments may include an SQP pad, an SHO pad, a microfiber pad, a wet pad, a tile and grout wet pad, a scrubber, a scrub brush, a tile and grout brush, a carpet cleaning pad, a sandscreen, sandpaper, an abrader plate, stone polishing pads, vacuum braised diamond, resin diamonds, polypads, polishing pads, tooltip diamonds, a sponge, and an enhancer pad, as well as other floor treatment materials. The treatment attachment 434 secures to the driver plate 106.

In one embodiment, the eccentric 430 offsets the attachment of the driver plate 106 and treatment attachment 434 one half inch (½ inch) from the shaft of the motor 104. The half inch offset revolves the treatment attachment in a circular pathway with a radius of the offset of a half inch.

In another embodiment, the eccentric 430 offsets the attachment of the driver plate 106 and treatment attachment 434 one quarter inch (¼ inch) from the shaft of the motor 104. The half inch offset revolves the treatment attachment in a circular pathway with a radius of the offset of a quarter inch.

In another embodiment, the eccentric 430 offsets the attachment of the driver plate 106 and treatment attachment 434 one eighth inch (⅛ inch) from the shaft of the motor 104. The half inch offset revolves the treatment attachment in a circular pathway with a radius of the offset of an eighth inch.

The eccentric 430 of one embodiment offsets the driver plate 106 and treatment attachment 434 ranging from one eighth of an inch (⅛ inch) to one and half inches (1 ½ inches) from the shaft of the motor 104. The offset revolves the treatment attachment in a circular pathway with a radius ranging from ⅛ of an inch to one and a half inches.

FIG. 56 also shows the isolator bodies 438. The isolator bodies 438 are a wear item to be replaced for maintenance of the machine. The isolator bodies 438 provide shock absorption, noise reduction, and control of the motor 104 to prevent the machine from pulling to one side.

Figure 57:
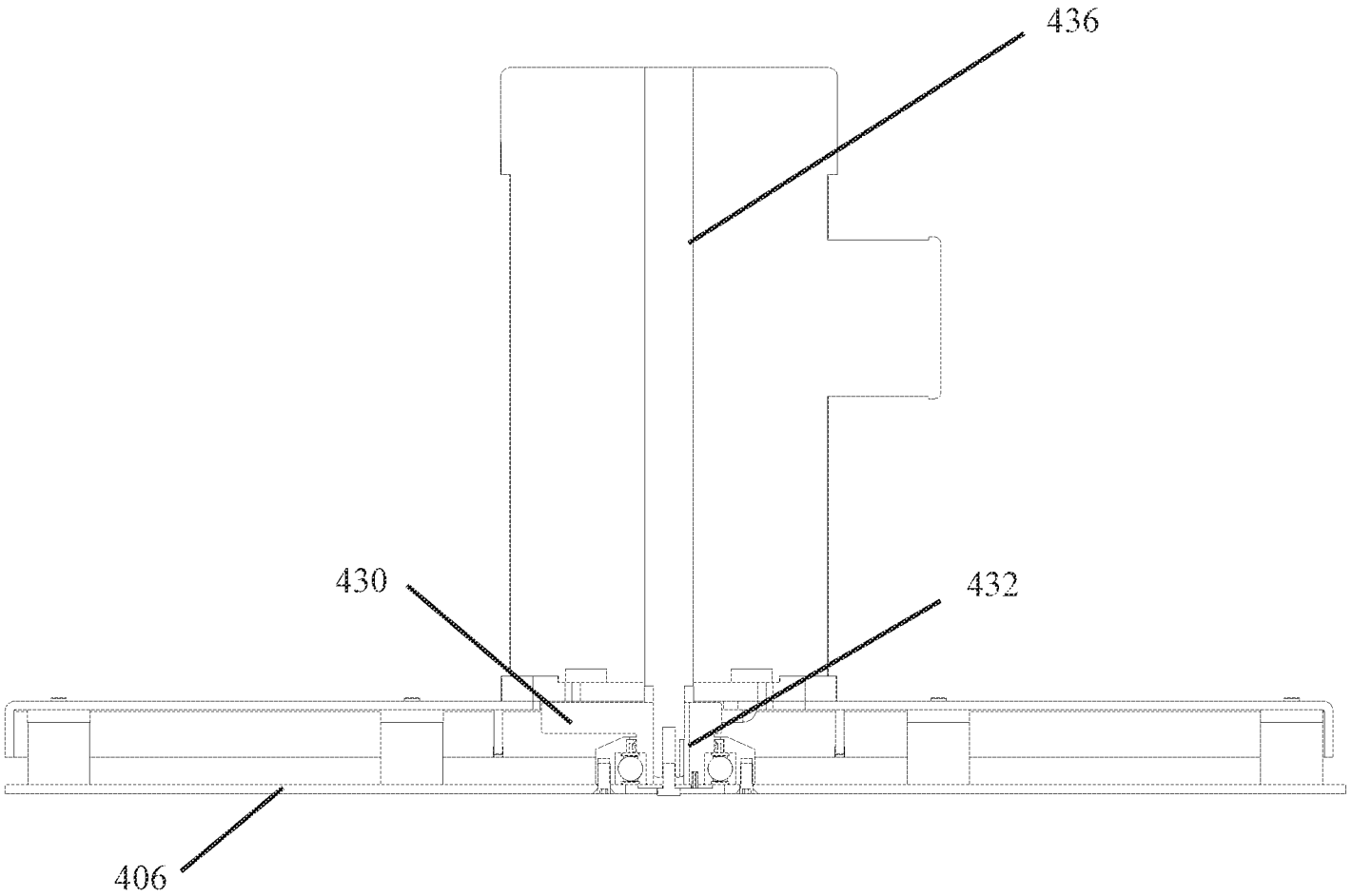
FIG. 57 is a sectional view thereof.
Figure 58:
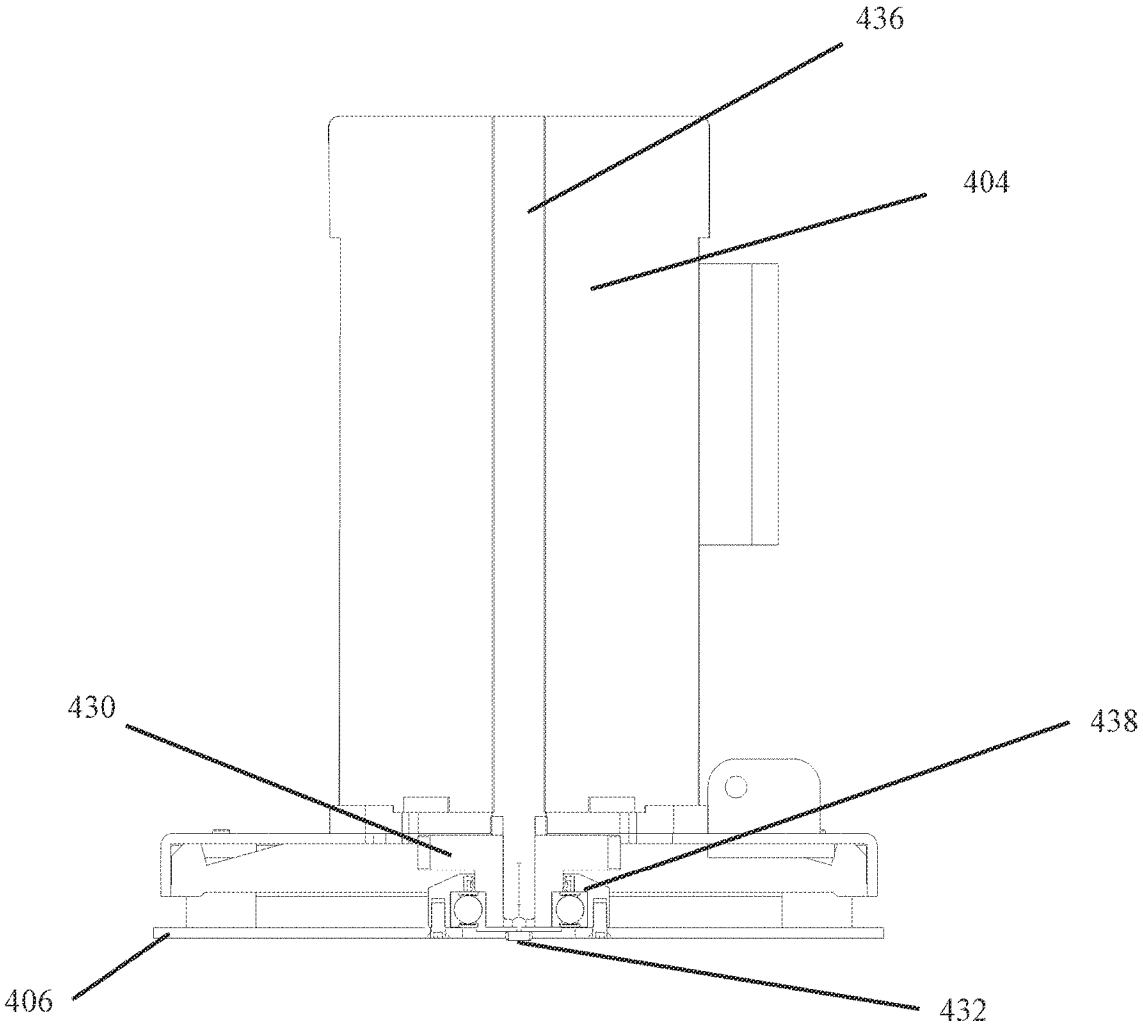
FIG. 58 is a sectional view thereof.

FIGS. 57-58 show shaft 436 of motor 104 secured to the eccentric 430 via fastener 432. Bearing assembly 438 constrains motion of the driver plate 106 and treatment attachment to the desired revolution. The bearing assembly 438 is selected according to the desired revolution caused by eccentric 430.

Figure 59:
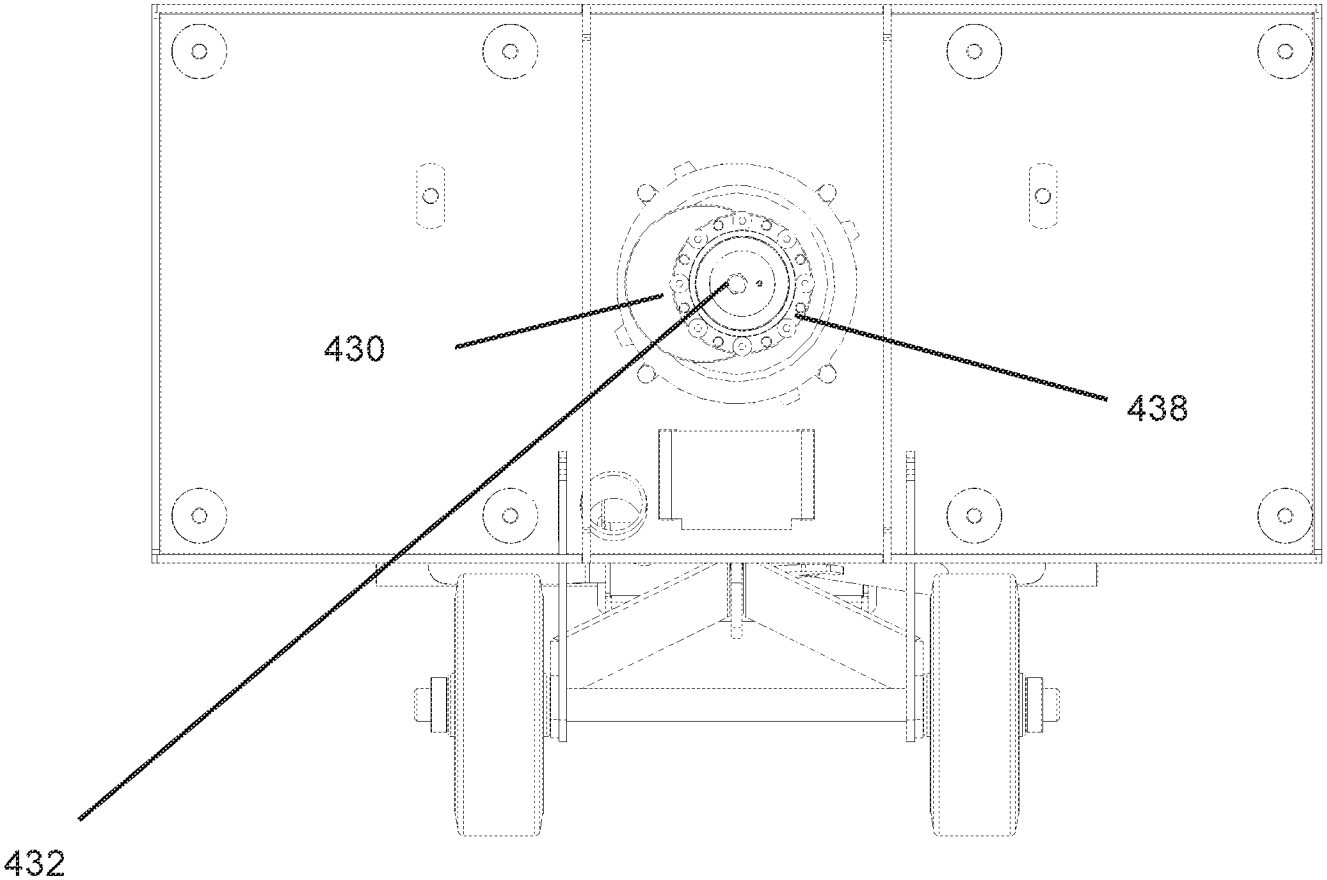
FIG. 59 is a partial bottom view thereof.
Figure 60:
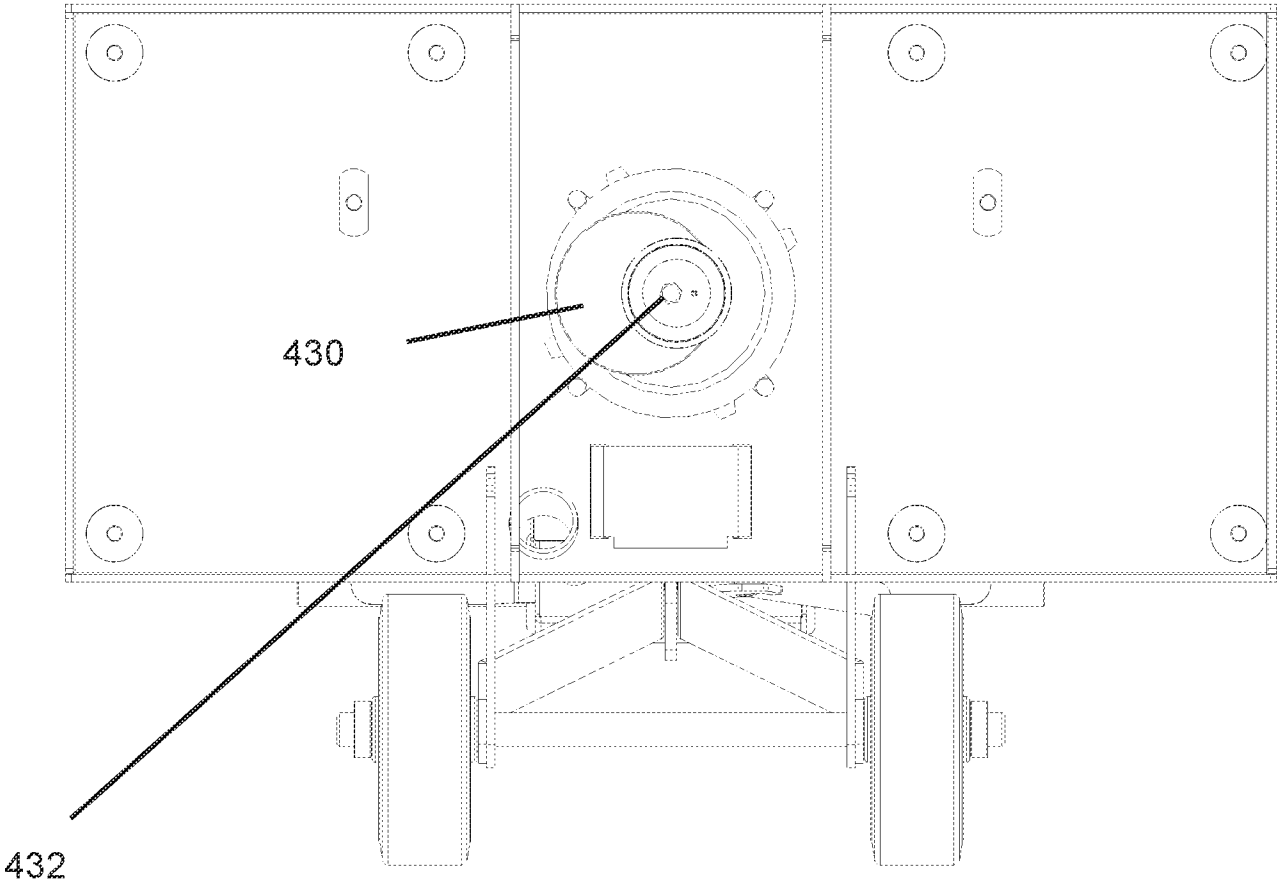
FIG. 60 is a partial bottom view thereof.

FIGS. 59-60 show bottom views of the floor machine in which the driver plate has been removed to show the eccentric 430 and fastener 432. Bearing 438 secures to the driver plate 106 as shown in FIGS. 56, 58.

The bearing 438 of the eccentric assembly attaches to motor and the eccentric 430. Eccentric assembly offsets the attachment of the driver plate with the motor. Fastener 432 secures the eccentric assembly with the motor. Offsetting fastener 432 in relation to the driver plate surface enables the treatment attachment to revolve around the motor and the shaft.

FIG. 60 shows the bearing removed to show the offset relationship of fastener 432 with eccentric 430. As indicated above, the eccentric 430 offsets the fastener 432 half an inch (½ inch) from the shaft of the motor. The half inch offset revolves the treatment attachment in a pathway having a half inch radius from the shaft. In another embodiment, the eccentric 430 offsets the fastener 432 one quarter of an inch (¼ inch) from the shaft of the motor. The half inch offset revolves the treatment attachment in a pathway having a quarter inch radius from the shaft. In another embodiment, the eccentric 430 offsets the fastener 432 one eighth of an inch (⅛ inch) from the shaft of the motor. The half inch offset revolves the treatment attachment in a pathway having a one eighth of an inch radius from the shaft. The eccentric 430 of one embodiment offsets the fastener 432 ranging from one eighth of an inch (⅛ inch) to one and half inches (1 ½ inches) from the shaft of the motor. The offset revolves the treatment attachment in a pathway having a radius ranging from an eighth of an inch to one and a half inches from the shaft.

The floor machine of the present invention provides multiple attachment bodies to change the orientation of the floor machine with the handle. Such changes in orientation increase the functionality of the floor machine. The floor machines are also capable of operation in two different direction by revolving the driver plate in different directions. Such changes in operation increase the life of the treatment attachment for treating the surface areas.

The floor machines also provide a removable power source stored within a removable handle. Upon depleting the power source, the user simply replaces the handle with a handle storing a charged power source. The user can then charge the removed handle for later use. Such a handle provides for cordless operation of the floor machine.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An apparatus for treating a surface, the apparatus comprising:

a housing storing a motor that agitates a treatment attachment;

a handle that attaches to the housing;

a power source stored within the handle, wherein the power source powers the motor;

a tubular section of the handle, wherein the power source is at least partially stored within the tubular section of the handle;

a driving plate secured to the housing, wherein the treatment attachment attaches to the driving plate, wherein the motor revolves the driving plate;

a first attachment body and a second attachment body secured to the housing, wherein the handle releasably attaches to either the first attachment body or the second attachment body.

2. The apparatus of claim 1 further comprising:

a shaft of the motor extending vertically downward;

an eccentric assembly secured to the shaft;

the driving plate secured to the eccentric assembly, wherein the eccentric assembly offsets the driving plate in relation to the shaft, wherein the motor revolves the driving plate around a shaft of the motor.

3. The apparatus of claim 1 further comprising:

a powering conductor extending externally from the handle, wherein the powering conductor attaches to the housing to power the motor.

4. The apparatus of claim 3 further comprising:

a first end of the handle that attaches to the housing;

a second end of the handle located opposite the first end;

wherein the powering conductor is located approximate the first end of the handle, wherein the powering conductor extends laterally outward from the tubular section of the handle.

5. The apparatus of claim 4, further comprising battery stored within the handle, wherein a majority of the weight of the battery is located toward the first end of the handle.

6. The apparatus of claim 1 further comprising:

a charging conductor that attaches to a charging source to charge the power source within the handle.

7. The apparatus of claim 6 further comprising:

a first end of the handle that attaches to the housing;

a second end of the handle located opposite of the first end;

wherein the charging conductor is located approximate the second end of the handle.

8. An apparatus for treating a surface, the apparatus comprising:

a housing storing a motor that agitates a treatment attachment;

a handle that attaches to the housing;

a power source stored within the handle, wherein the power source powers the motor;

a powering conductor extending externally outward from the handle, wherein the powering conductor electrically connects the power source with the motor;

a driving plate secured to the housing wherein the treatment attachment attaches to the driving plate, wherein the motor revolves the driving plate;

wherein the motor is secured to an attachment body;

a shaft of the motor extending vertically downward;

an eccentric assembly secured to the shaft; and the driving plate secured to the eccentric assembly wherein the eccentric assembly offsets the driving plate in relation to the shaft, the driving plate located below the motor, wherein the motor revolves the driving plate around a shaft of the motor.

9. The apparatus of claim 8, wherein the handle releasably attaches to the housing.

10. The apparatus of claim 8 further comprising:

a tubular section of the handle, wherein the power source is at least partially stored within the tubular section.

11. The apparatus of claim 10 further comprising:

a first end of the handle that attaches to the housing;

a second end of the handle located opposite the first end;

wherein the powering conductor is located approximate the first end of the handle, wherein the powering conductor extends laterally outward from the tubular section of the handle.

12. The apparatus of claim 11 further comprising:

a charging conductor that attaches to a charging source to charge the power source within the handle, wherein the charging conductor attaches proximate the second end of the handle.

13. The apparatus of claim 8 further comprising:

a tubular section of the handle, wherein the power source is stored entirely within the tubular section.

14. An apparatus for treating a surface, the apparatus comprising:

a housing storing a motor that agitates a treatment attachment;

a handle that releasably attaches to the housing at an attachment location;

a battery stored within the handle, wherein the battery powers the motor;

a powering conductor that electrically connects the battery with the motor, wherein the powering conductor releasably attaches to the housing at a power location, wherein the power location is distinct from the attachment location;

a driving plate secured to the housing wherein the treatment attachment attaches to the driving plate, wherein the motor revolves the driving plate; and a first attachment body and a second attachment body secured to the housing, wherein the handle releasably attaches to either the first attachment body or the second attachment body.

15. The apparatus of claim 14 further comprising:

a tubular section of the handle, wherein the battery is at least partially stored within the tubular section of the handle.

16. The apparatus of claim 14 further comprising:

a powering conductor extending externally from the handle, wherein the powering conductor attaches to the housing to power the motor, a first end of the handle that attaches to the housing;

a second end of the handle located oppose of the first end;

wherein the powering conductor is located approximate the first end of the handle, wherein the powering conductor extends laterally outward from the handle.

* * * * *